US010751235B2

(12) United States Patent
Ernst

(10) Patent No.: US 10,751,235 B2
(45) Date of Patent: Aug. 25, 2020

(54) ADJUSTABLE CAMBER WHEELCHAIR DEVICES, SYSTEMS AND METHODS

(71) Applicant: Chad Robert Ernst, Gainesville, GA (US)

(72) Inventor: Chad Robert Ernst, Gainesville, GA (US)

( * ) Notice: Subject to any disclaimer, the term of this patent is extended or adjusted under 35 U.S.C. 154(b) by 322 days.

(21) Appl. No.: 15/839,047

(22) Filed: Dec. 12, 2017

(65) Prior Publication Data

US 2018/0296411 A1 Oct. 18, 2018

Related U.S. Application Data

(60) Provisional application No. 62/555,883, filed on Sep. 8, 2017, provisional application No. 62/485,545, filed on Apr. 14, 2017.

(51) Int. Cl.
*A61G 5/10* (2006.01)

(52) U.S. Cl.
CPC ..... *A61G 5/1097* (2016.11)

(58) Field of Classification Search
CPC ..... B60G 2200/46; B60G 2300/24; A61G 5/1097
USPC ..... 280/5.521, 86.751
See application file for complete search history.

(56) References Cited

U.S. PATENT DOCUMENTS 4,351,540 A * 9/1982 Minnebraker ..... A61G 5/00 280/250.1
4,405,142 A * 9/1983 Whetstine ..... A61G 5/00 16/19
4,515,383 A * 5/1985 Minnebraker ..... A61G 5/08 280/250.1
4,592,570 A * 6/1986 Nassiri ..... A61G 5/00 280/250.1
RE32,242 E * 9/1986 Minnebraker ..... A61G 5/00 280/250.1
5,060,962 A 10/1991 McWethy
5,131,672 A * 7/1992 Robertson ..... A61G 5/00 280/250.1
5,143,391 A * 9/1992 Robertson ..... A61G 5/00 280/250.1
5,176,393 A * 1/1993 Robertson ..... A61G 5/00 180/907

(Continued)

FOREIGN PATENT DOCUMENTS

WO 0841052 5/1998
WO 2018191620 10/2018

OTHER PUBLICATIONS

Ernst, Chad Robert; International Search Report and Written Opinion for PCT Application No. PCT/US18/27493, filed Apr. 13, 2018, dated Jun. 29, 2018, 14 pgs.

*Primary Examiner* — Jacob D Knutson
*Assistant Examiner* — Conan D Duda
(74) *Attorney, Agent, or Firm* — The Sladkus Law Group

(57) ABSTRACT

Wheelchair devices and systems that have wheels with adjustable camber. The device has a bracket attached to a wheelchair and a receiver configured to couple to the axle of the wheel. The position of the receiver relative to the bracket can be adjusted by the user to alter the position of the axle relative to the bracket, thereby altering the camber in the rear wheel. A top portion of the rear wheel can remain in a vertical plane of travel regardless of the amount of camber in the wheel and a bottom portion of the rear wheel can remain in a horizontal plane.

16 Claims, 50 Drawing Sheets

(56) References Cited

U.S. PATENT DOCUMENTS 5,197,786 A * 3/1993 Eschenburg ..... B60B 37/00 180/258
5,233,743 A * 8/1993 Robertson ..... A61G 5/00 156/304.5
5,259,635 A * 11/1993 Picker ..... A61G 5/00 280/250.1
5,267,745 A * 12/1993 Robertson ..... A61G 5/00 280/250.1
5,294,142 A * 3/1994 Weege ..... A61G 5/10 280/304.1
5,333,894 A * 8/1994 Mayes ..... A61G 5/10 280/250.1
5,421,598 A * 6/1995 Robertson ..... A61G 5/00 280/250.1
5,480,172 A * 1/1996 James ..... A61G 5/00 280/250.1
5,590,893 A * 1/1997 Robinson ..... A61G 5/00 280/250.1
5,605,345 A * 2/1997 Erfurth ..... A61G 5/08 135/67
5,662,345 A 9/1997 Kiewit
5,851,018 A 12/1998 Curran et al.
6,168,177 B1 1/2001 Schillo et al.
6,182,992 B1 2/2001 Garven, Jr.
6,412,804 B1 * 7/2002 Dignat ..... A61G 5/10 180/65.51
8,042,824 B2 * 10/2011 Borisoff ..... A61G 5/1097 280/250.1
2001/0011805 A1 * 8/2001 Kueschall ..... A61G 5/1091 280/250.1
2002/0109399 A1 * 8/2002 Papac ..... B60B 33/0005 301/111.01
2003/0034635 A1 2/2003 Ludovici
2003/0227151 A1 12/2003 Schreiber et al.
2006/0049593 A1 * 3/2006 Schreiber ..... A61G 5/1097 280/86.751
2006/0055143 A1 * 3/2006 Schreiber ..... A61G 5/1078 280/250.1
2006/0076169 A1 4/2006 Brendel et al.
2006/0087098 A1 * 4/2006 Peterson ..... B60B 33/0007 280/304.1
2006/0087103 A1 * 4/2006 Schreiber ..... A61G 5/1054 280/649
2007/0246907 A1 * 10/2007 Huber ..... A61G 5/1097 280/250.1
2009/0085321 A1 * 4/2009 Ludovici ..... A61G 5/10 280/250.1
2009/0166996 A1 * 7/2009 Spindle ..... A61G 5/02 280/250.1
2010/0007114 A1 * 1/2010 Papi ..... A61G 5/1054 280/304.1
2010/0123296 A1 * 5/2010 Chelgren ..... A61G 5/1078 280/124.1
2012/0013098 A1 * 1/2012 Hart ..... A61G 5/06 280/250.1
2013/0187355 A1 * 7/2013 Slorance ..... A61G 5/02 280/250.1
2015/0272794 A1 * 10/2015 Sorqvist ..... A61G 5/023 192/217
2016/0325585 A1 * 11/2016 Hays ..... A61G 5/1089
2018/0133075 A1 * 5/2018 Jacobsson ..... A61G 5/047
2019/0314228 A1 * 10/2019 Horacek ..... A61G 5/128

* cited by examiner

600

ADJUSTABLE CAMBER WHEELCHAIR DEVICES, SYSTEMS AND METHODS

CROSS-REFERENCE TO RELATED PATENT APPLICATIONS

This application claims the benefit of U.S. Provisional Application No. 62/555,883, filed on Sep. 8, 2017 and 62/485,545 filed on Apr. 14, 2017, each of which applications are herein incorporated by reference in their entirety.

FIELD OF THE INVENTION

The present invention relates generally to adjustable wheelchairs and more particularly, wheelchairs in which adjustments to the camber of the wheelchair can be made easily without tools.

BACKGROUND OF THE INVENTION

Wheelchair camber is an angling of the rear wheels of a wheelchair relative to a conventional wheel that is vertical. If the wheelchair has cambered rear wheels, the top of the wheels are closer to the rider and the bottom of the wheels are farther away. Camber is conventionally measured in degrees from perpendicular relative to the surface on which the wheel rests. A higher degree represents a more angled wheel (relative to a vertical plane that is perpendicular to the ground). For example, a zero degree camber is defined as a wheel camber where the axle of the wheel is positioned horizontally and thus the wheels are located perpendicular to the ground in a vertical plane.

As camber is increased, the width of the wheelchair across the bottom increases. This adds lateral stability to the system by increasing the wheelchairs footprint which can be useful, for example, on hills. Increasing the camber can also place the push rims in a more ergonomic position for pushing and makes turning the wheelchair quicker.

Too much camber, however, can make fitting through doorways and other tight spaces a problem. What is needed then is a wheelchair with a wheel camber that can be easily be adjustable lower or having a smaller degree of camber to fit through doorways, and easily adjustable higher or having a greater degree of camber to give the rider stability, better control of the wheelchair and other benefits.

SUMMARY

Presented herein are wheelchair devices and systems that have wheels with adjustable camber, and methods of adjusting this camber. In one aspect, the adjustable camber wheelchair of the present application allows the user to easily adjust the rear wheels of a wheelchair chair about and between a first position, in which the wheels are located in a vertical plane substantially perpendicular to the ground or other surface upon which the chair is positioned, and a second position in which the wheels are not located in a vertical plane substantially perpendicular to the ground.

In one aspect, the system comprises a bracket coupled to the wheelchair and a plurality of receivers coupled to the bracket. The bracket can be securedly attached to a portion of the wheelchair frame. In one aspect, the wheelchair can be a new wheelchair assembled with the bracket attached. Alternatively, a conventional wheelchair can be retrofit with the bracket to convert the conventional wheelchair to an adjustable camber wheelchair. The receiver can be sized and configured to engage both the axle of the wheel and the bracket. In one aspect, the axel of the wheel can be positioned in a bore defined in the receiver. In another aspect, the receiver can slidingly or rotatingly engage a portion of the bracket so that the angle of the axle, and thus the wheel, relative to the frame can be selectively adjusted.

In use, a top portion of the rear wheel can remain in a vertical plane of travel regardless of the amount of camber in the wheel. Similarly, a bottom portion of the rear wheel can remain in a horizontal plane. Because the bottom of the wheel does not raise or lower during the camber change the frame of the chair can stay in the same relative position to the ground or other surface regardless of what camber option is chosen. Because the frame of the chair stays in the same relative position to the ground the caster of the front wheels can be unchanged regardless of what camber option is chosen.

Related methods of operation are also provided. Other apparatuses, methods, systems, features, and advantages of the adjustable camber wheelchair will be or become apparent to one with skill in the art upon examination of the following figures and detailed description. It is intended that all such additional apparatuses, methods, systems, features, and advantages be included within this description, be within the scope of the adjustable camber wheelchair, and be protected by the accompanying claims.

DESCRIPTION OF THE INVENTION

Figure 1:
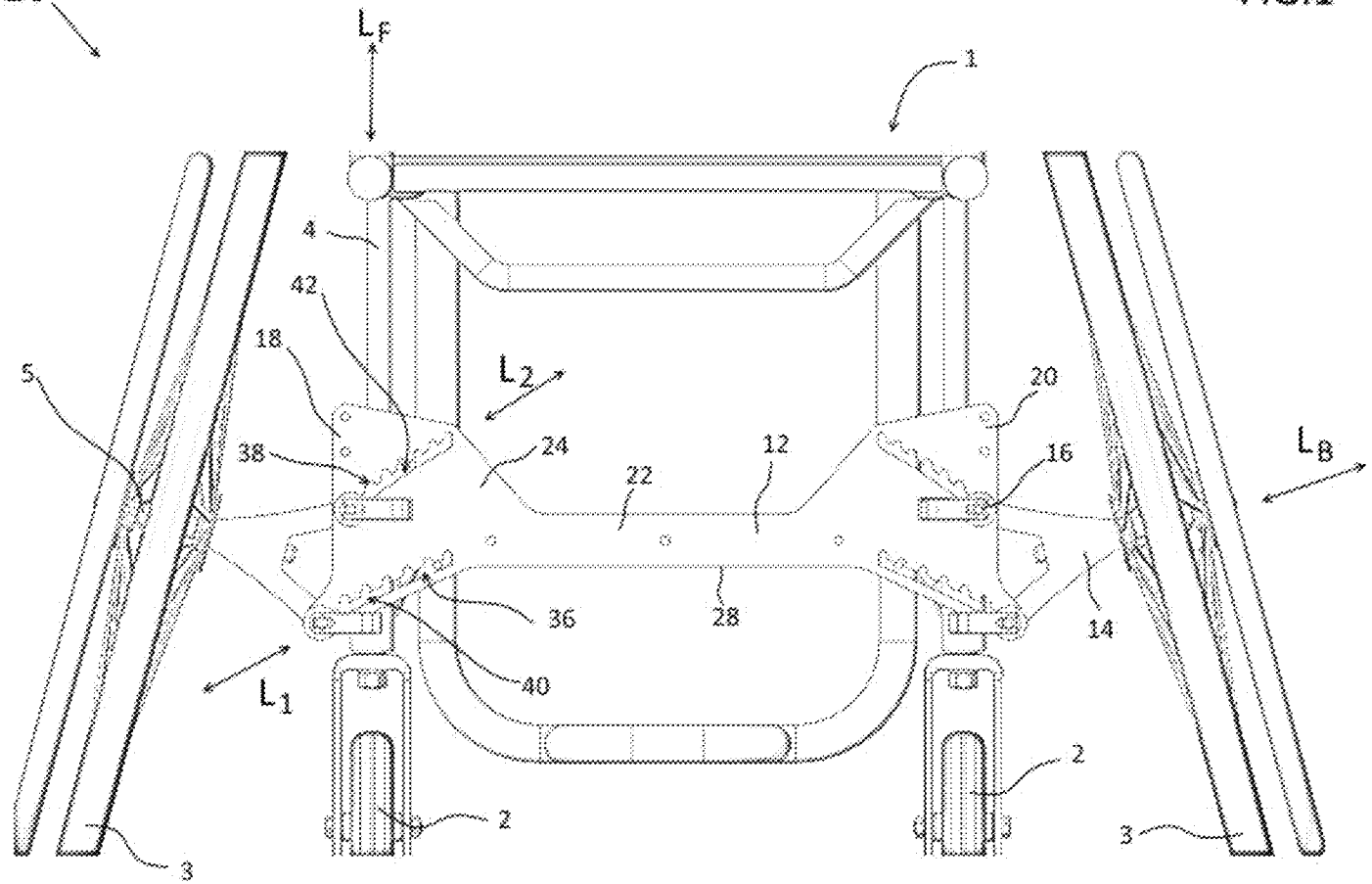
FIG. 1 is a rear elevational view of a wheelchair device and system having an adjustable camber of the present application, according to one aspect, in which the wheels are positioned in a cambered position.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to an "element"

includes aspects having two or more elements unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The application relates to wheelchair devices and systems that have wheels with adjustable camber, and methods of adjusting this camber. A conventional wheelchair 1 has a pair of front wheels 2, a pair of rear wheels 3 and a wheelchair frame 4 to position the wheels in the desired places. Each wheel can have an axle 5 that couples the wheel to a portion of the frame. For example, the axle can be a quick release axle such as a push pin with releasable locking balls. The adjustable camber wheelchair of the present application allows the user to easily adjust the rear wheels 3 of the chair from a first position, in which the axle is positioned horizontally and thus the wheels are located substantially perpendicular to the ground in a vertical plane (i.e. uncambered or having zero degrees of camber), and a second position in which the axle is not positioned horizontally and thus the wheels are not located perpendicular to the ground in a vertical plane (i.e., cambered or having a camber angle $\alpha$).

In one embodiment and as illustrated in FIGS. 1-6, the system 10 comprises a bracket 12 coupled to the wheelchair 1, a plurality of receivers 14 coupled to the bracket and at least one locking pin 16 for each receiver. In use, an end of the receiver can slidingly engage a portion of the bracket 12 and another end of the receiver 14 can be configured to rotatably couple the axle 5 of the rear wheel 3 to the receiver. The at least one locking pin can releasably secure the receiver 14 to the bracket 12 in the desired position.

Figure 2:
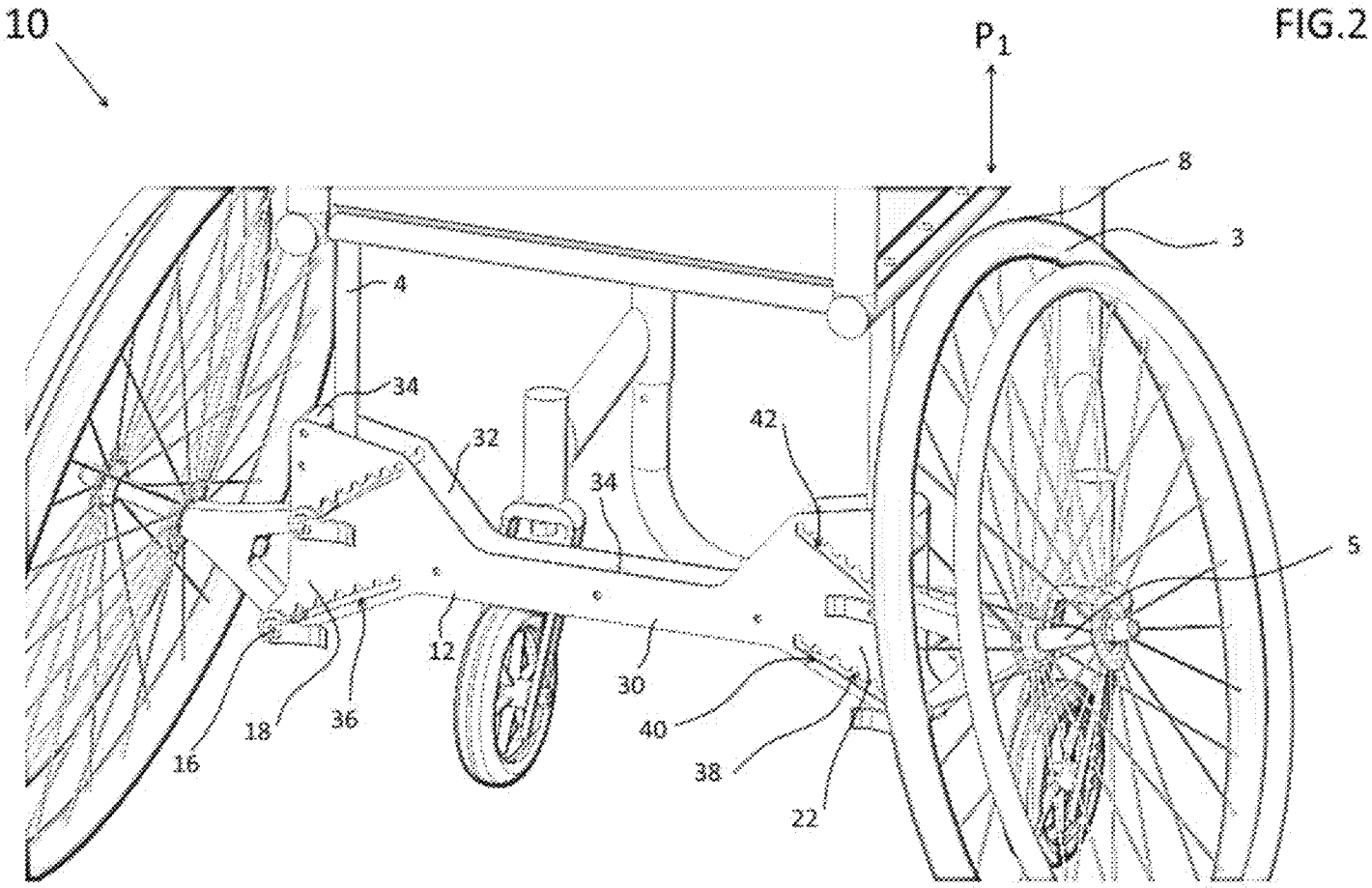
FIG. 2 is perspective view of the wheelchair device and system of FIG. 1.
Figure 3:
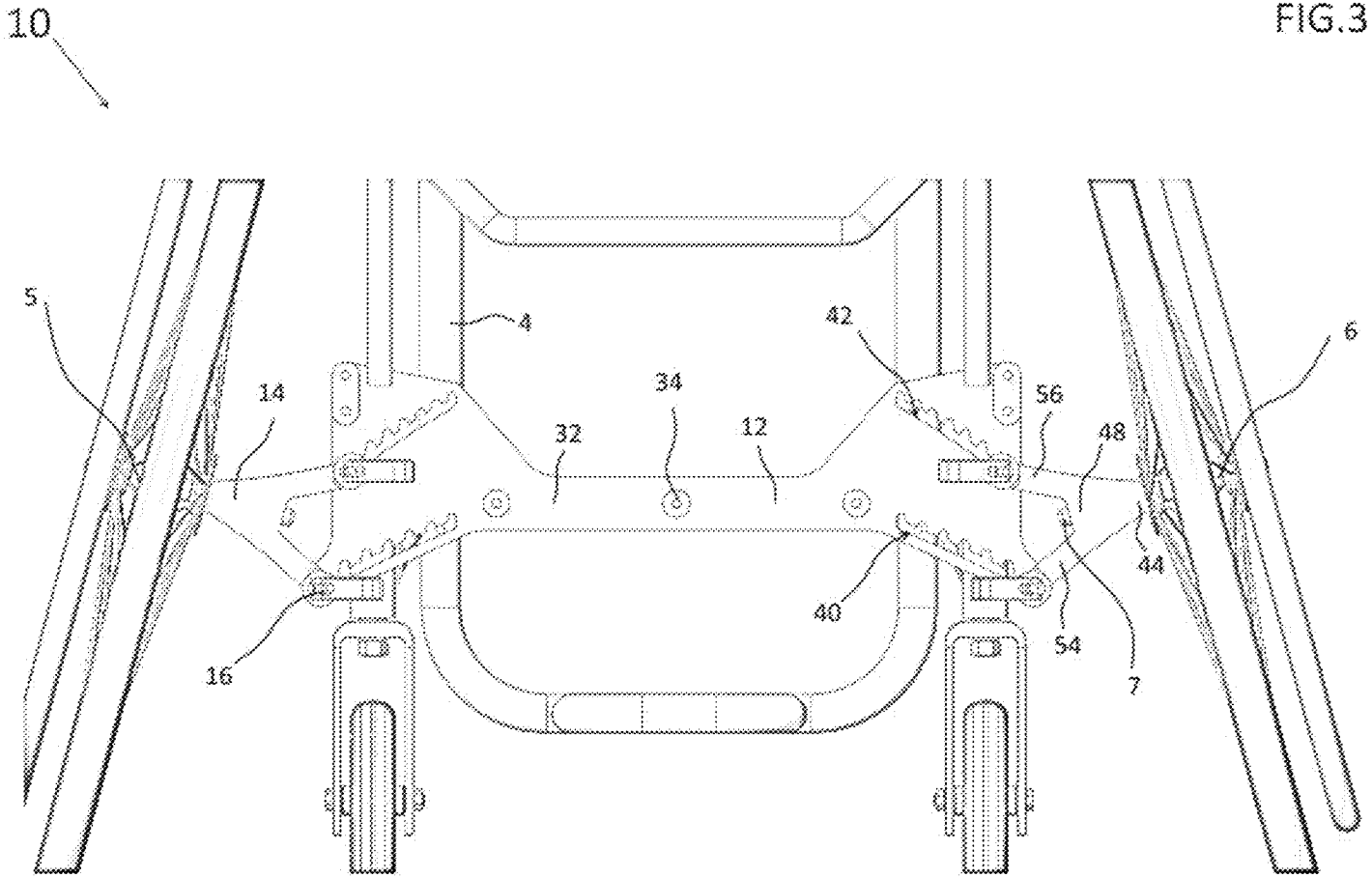
FIG. 3 is a rear elevational view of the wheelchair device and system of FIG. 1.

The bracket 12 can be a rigid element having a first end 18, an opposed second end 20 and a central portion 22 extending therebetween. In one aspect, the bracket can be substantially planar having a first face 24, an opposed second face 26 and a sidewall 28 extending therebetween. In another aspect, the bracket can comprise a first plate 30 and a second plate 32 spaced from the first plate a predetermined distance that cooperate to form the bracket 12. As seen in FIG. 2, for example, the first plate can be positioned on a first side of the wheelchair frame 4 and the second plate can be positioned on a second side of the wheelchair frame such that the plate are spaced the predetermined distance. Spacers 34 can be used to maintain the plates 30, 32 the predetermined distance apart. The bracket 12 can be a plate formed from a rigid material such as for example, steel, stainless steel, titanium, aluminum, carbon fiber and the like.

At least one slot 36 can be defined in each of the first end 18 and the second end 20 of the bracket 12. In one aspect, the slot can be sized and configured to receive a portion of the locking pin 16 therein. In another aspect, the slot 36 can be a substantially linear slot having a longitudinal axis $L_1$ at an acute angle relative to the longitudinal axis $L_F$ of the frame 4. For example, the acute angle between the longitudinal axis $L_1$ of the first slot and the longitudinal axis $L_F$ of the frame can be less than 30 degrees, about 30 degrees, about 45 degrees, about 60 degrees or greater than 60 degrees. Optionally, at least a portion of the slot 36 can be arcuate in shape. In another aspect, the position and shape of the slot can be selected so that in use, described more fully below, a top portion 8 of the wheel 4 can remain in a vertical plane $P_1$ of travel regardless of the camber of the wheel and/or so the frame 4 of the chair stays in the same relative position to the ground regardless of what camber option is chosen.

In another aspect, the at least one slot 36 defined in each of the first end 18 and the second end 20 of the bracket 12 can comprise a plurality of slots. For example, the at least one slot can comprise a first slot 40 and a second slot 42 defined in each end. In this aspect, the first slot can have the longitudinal axis $L_1$ and the second slot can have a longitudinal axis $L_2$. In another aspect, the longitudinal axis $L_2$ of the second slot 42 can be at an acute angle relative to the longitudinal axis $L_1$ of the first slot. Alternatively, the first slot 40 can be substantially parallel to the second slot. In yet another aspect, the at least one slot 36 defined in the first end 18 of the bracket can be a substantial mirror image of the at least one slot defined in the second end 20 relative to a vertical plane positioned through the back of the wheelchair 1. Thus, the longitudinal axis of the first slot 40 and/or the second slot 42 of the first end 18 can be at substantially the same acute angle relative to the longitudinal axis $L_F$ of the frame 4 as the respective first slot 40 and/or the second slot 42 of the second end 20.

In a further aspect, a plurality of notches 38 can be defined in a wall of the at least one slot 36. For example, the notches can be defined in an upper wall and/or a lower wall of the slot. In this aspect, the notches can be sized and configured to receive a portion of the locking pin 16 therein. In yet another aspect, the notches can be positioned so that the locking pin and the receiver 14 are coupled to the bracket in a predetermined position corresponding to each notch 38.

Figure 4:
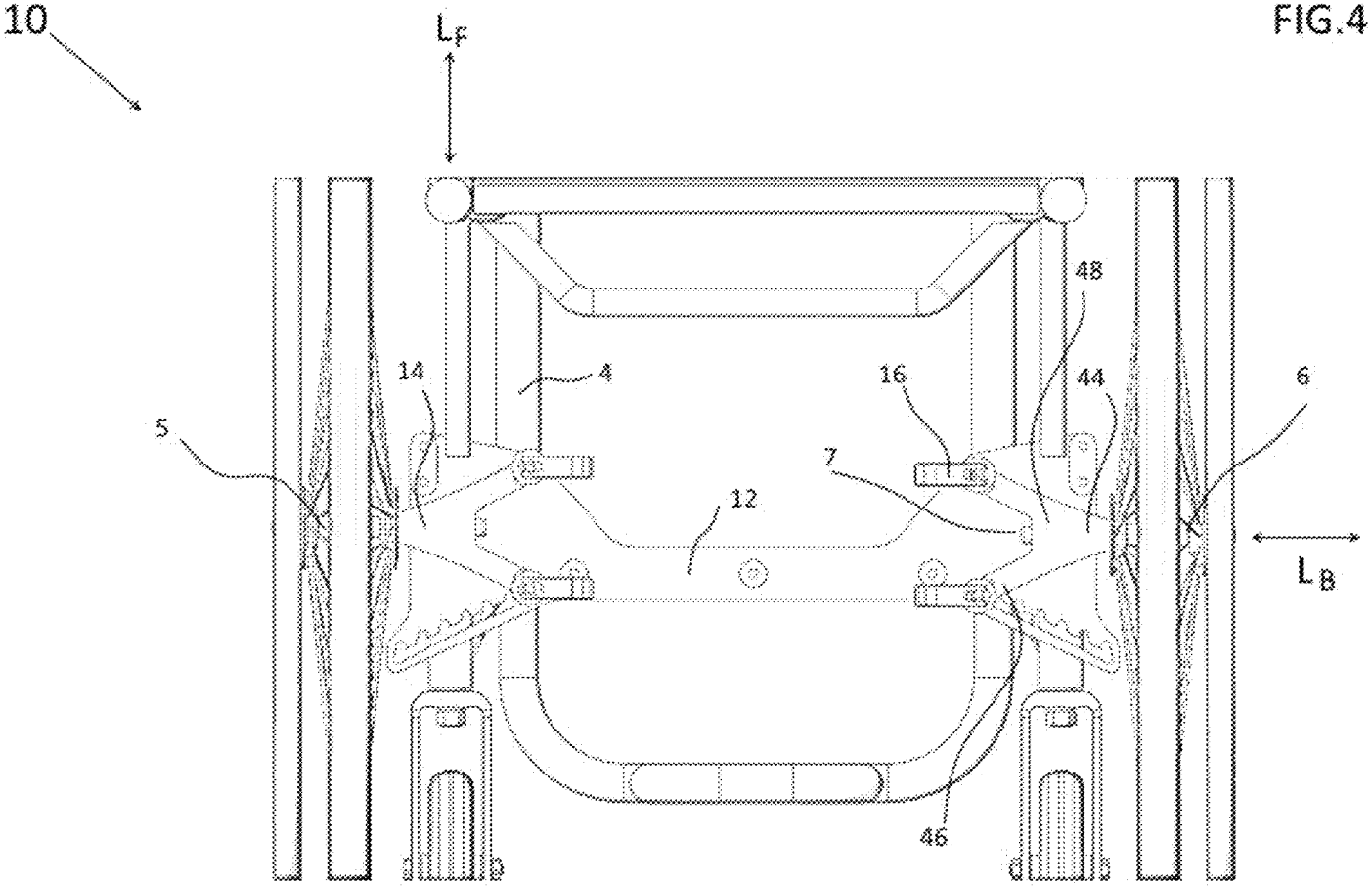
FIG. 4 is a rear elevational view of the wheelchair device and system of FIG. 1, in which the wheels are positioned in an uncambered position.
Figure 5:
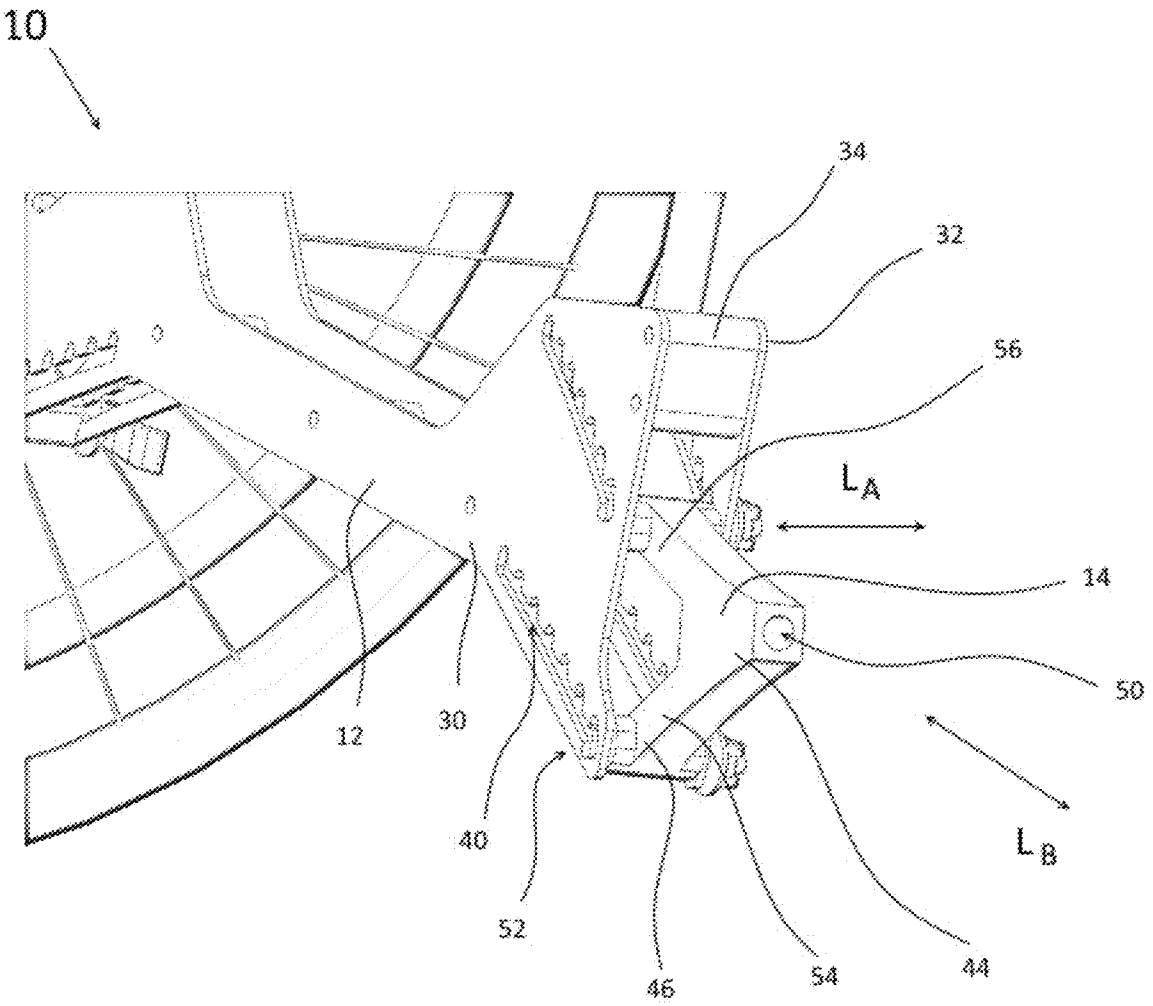
FIG. 5 is a perspective view of the wheelchair device and system of FIG. 1, in a cambered position, in which a wheel is not shown for clarity.
Figure 6:
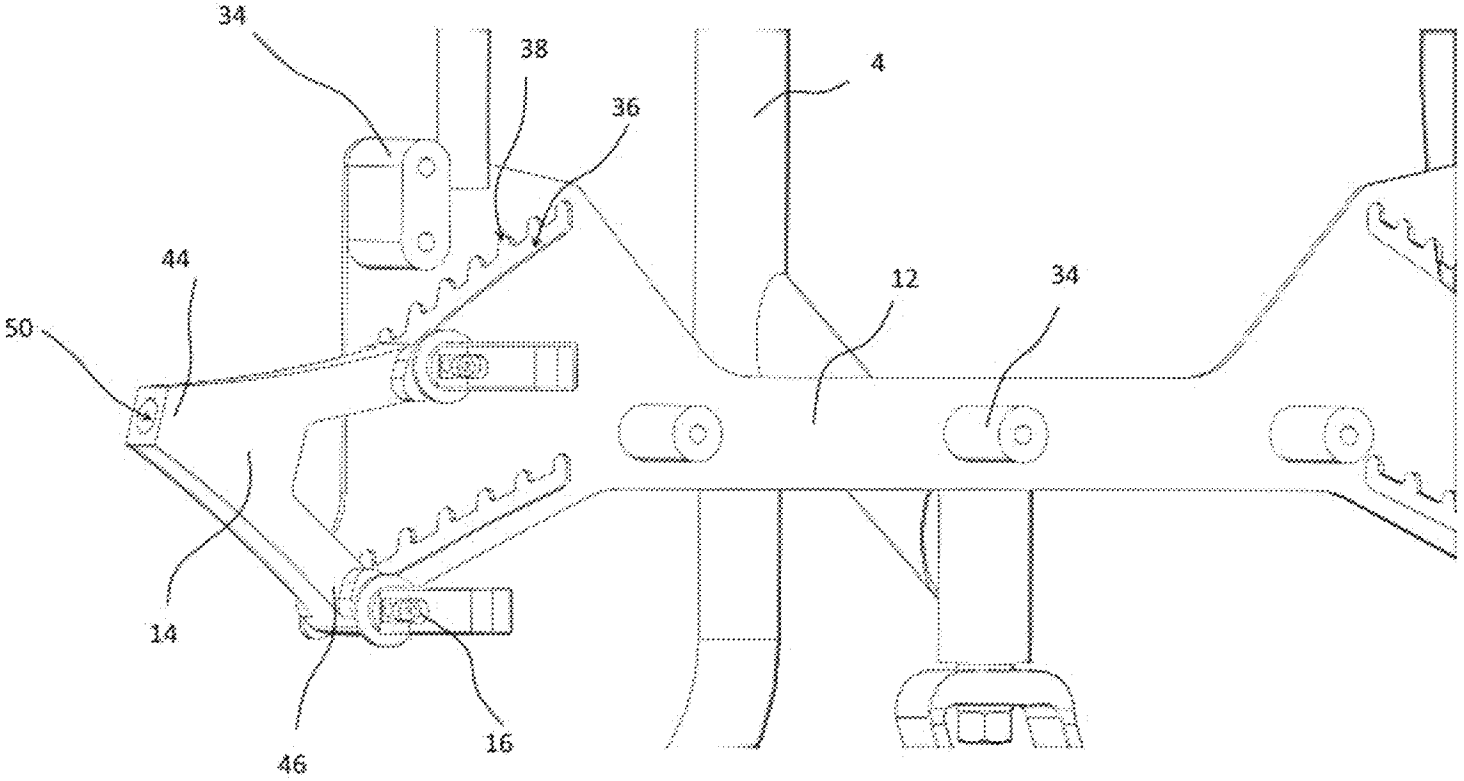
FIG. 6 is a cutaway perspective view of the wheelchair device and system of FIG. 1, in a cambered position, in which a wheel and portions of the device are not shown for clarity.
Figure 7:
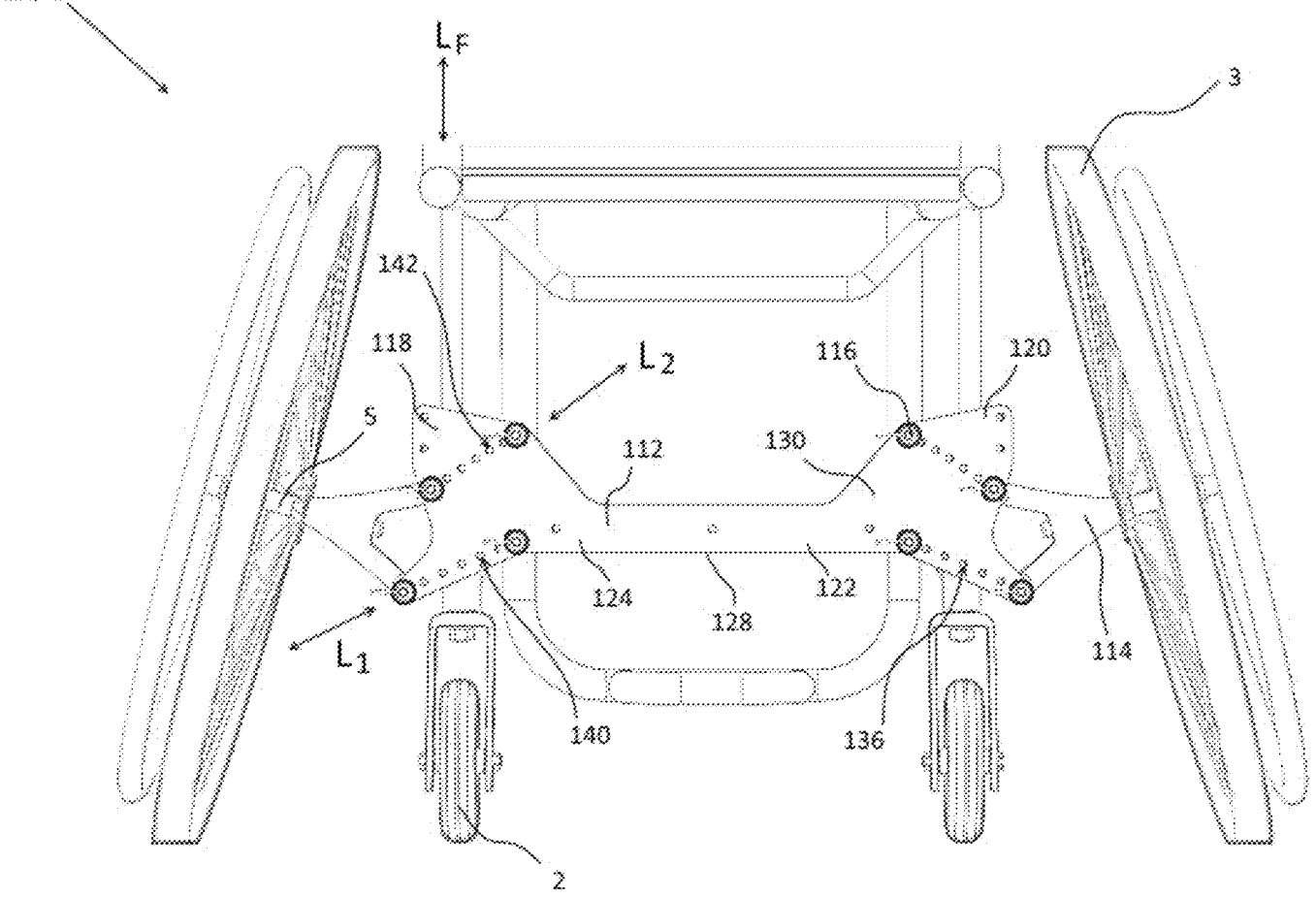
FIG. 7 is a rear elevational view of a wheelchair device and system having an adjustable camber of the present application, according to one aspect, in which the wheels are positioned in a cambered position.

In one aspect, the receiver comprises a distal end 44, an opposed proximal end 46 and a central portion 48 extending therebetween. In use, the receiver can be a rigid element configured to couple the axle 5 of the rear wheel 3 to the bracket 12. In another aspect, at least one elongate bore 50 having a bore axis $L_B$ can be defined in the distal end of the receiver, the bore configured to rotatingly engage the axle. As illustrated in FIG. 4, for example, the bore can extend through the distal end 44 and at least a portion of the central portion 48 of the receiver so that an end of the axle 5 can be securedly, rotatably attached to the receiver. That is, a first end 6 of the axle can be secured to the rear wheel and a second end 7 of the axle 5 can be positioned in the bore.

Optionally, in one aspect, the at least one elongate bore 50 can be a plurality of elongate bores. For example, a second bore can be defined in the receiver 14 that is spaced from the first bore a predetermined distance. In another aspect, the position of the second bore can be selected to change the center of gravity of the chair 1. For example, the second bore could be positioned behind the first bore relative to the front of the chair (as viewed when assembled), to change the center of gravity of the chair to be more stable climbing hills. In another example, the second bore could be positioned below the first bore relative to the front of the chair 1 (as viewed when assembled), to change the center of gravity of the chair.

The proximal end 46 of the receiver 14 can be sized and configured to be selectively, releasably coupled to an end of the bracket 12. In one aspect, at least one pin aperture 52 having an aperture axis $L_A$ can extend through the proximal end of the receiver. In another aspect, the aperture axis $L_A$ can be substantially normal to the bore axis $L_B$. In still a further aspect, there can be at least one pin aperture for each slot 36 defined in an end of the bracket 12. Thus, if there are two slots in an end of the bracket, there can be at least two pin apertures 52 defined in the proximal end 46 of the receiver. In one aspect, the proximal end of the receiver 14 can have a width sized so that each pin aperture can be positioned adjacent to a slot 36 in an end of the bracket. For example, if the first slot 40 is spaced two inches from the second slot 42, the proximal end 46 of the receiver can have a width that is greater than two inches. Optionally, in another aspect, a portion of the proximal end can be substantially "U" or "V" shaped. In this aspect, the proximal end 46 end can comprise a first rib 54 and a second rib 56 spaced from the first rib a predetermined distance so that, when assembled, the first rib 54 can be positioned adjacent the first slot 40 of the bracket 12, and the second rib can be positioned adjacent the second slot 42 of the bracket.

The at least one locking pin 16 can be a conventional locking pin. In one aspect, the locking pin can have a pin length sized and configured to extend through the at least one slot 36 of the bracket 12 and the at least one pin aperture 52 of the receiver. For example, the pin length can be sized to extend through the first slot 40 in the first plate 30 of the bracket, through the pin aperture defined in the first rib 54 of the receiver, and through the first slot of the second plate 32 of the bracket. In another aspect, the at least one locking pin can be a non-removable or a removable locking pin. In use, the pin can be sized and configured to releasably secure the receiver 14 to the bracket 12 without being removed from the slot.

To assemble the wheelchair 1 of the present application, the bracket 12 can be securedly attached to the wheelchair frame 4 with screws, bolts, pins and the like. In one aspect, the wheelchair can be a new wheelchair 1 assembled with the bracket attached. In another aspect, however, a conventional wheelchair can be retrofit with the bracket 12 to convert the conventional wheelchair 1 to a wheelchair with an adjustable camber. For example, a conventional wheelchair 1 has a frame element that can be detached and replaced with the bracket 12. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

The axle 5 of the wheel 3 can be positioned in the bore 50 of the distal end 44 of the receiver 14 and securedly, rotatably coupled to the receiver. For example, the axle can be a push pin axle with release balls positioned in the second end 7 of the axle to rotatingly couple the axle to the receiver.

The proximal end 46 of the receiver can be positioned so that the at least one pin aperture 52 of the receiver 14 is adjacent to and/or co-axially aligned with a notch 38 of a slot 36 defined in an end of the bracket 12. In one aspect, if there are a plurality of slots, the proximal end of the receiver can be positioned so that a pin aperture is adjacent a notch of each slot 36. For example, if there are two slots, the proximal end 46 can be positioned so that a pin aperture is aligned with a notch 38 in both of the slots. With the at least one pin aperture 52 and the notch of the at least one slot 36 co-axially aligned, a locking pin 16 can be inserted through each pin aperture and the aligned notch to securedly, releasably couple the receiver 14 to the bracket 12 in the desired position.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could release or unlock each locking pin 16 from the notches 38 on one end of the bracket 12. The proximal end 46 of the receiver can then be moved so that the at least one pin aperture 52 of the receiver 14 is adjacent to and/or co-axially aligned with a different notch 38. In another aspect, the notch pattern of the at least one slot 36 can be predetermined to correspond to a wheel camber of 0 degrees to 15 degrees with 2.5 degree increments. Of course, it is contemplated that the wheel camber could be greater than 15 degrees or less than 0 degrees (a negative camber) if desired by adding more notches 38 to the slots. It is also contemplated that the incremental change could be more or less than 2.5 degrees if desired so that a wider range of wheel camber is possible by adding more notches 38 to the slots 36 and/or changing the staggering of the notches.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

In one embodiment and as illustrated in FIGS. 7-12, the system 100 comprises a bracket 112 coupled to the wheelchair 1, a plurality of receivers 114 coupled to the bracket and at least one locking pin 116 for each receiver. In use, an end of the receiver can slidingly engage a portion of the bracket 112 and another end of the receiver 114 can be configured to rotatably couple the axle 5 of the rear wheel 3 to the receiver. The at least one locking pin can releasably secure the receiver 114 to the bracket 112 in the desired position.

Figure 8:
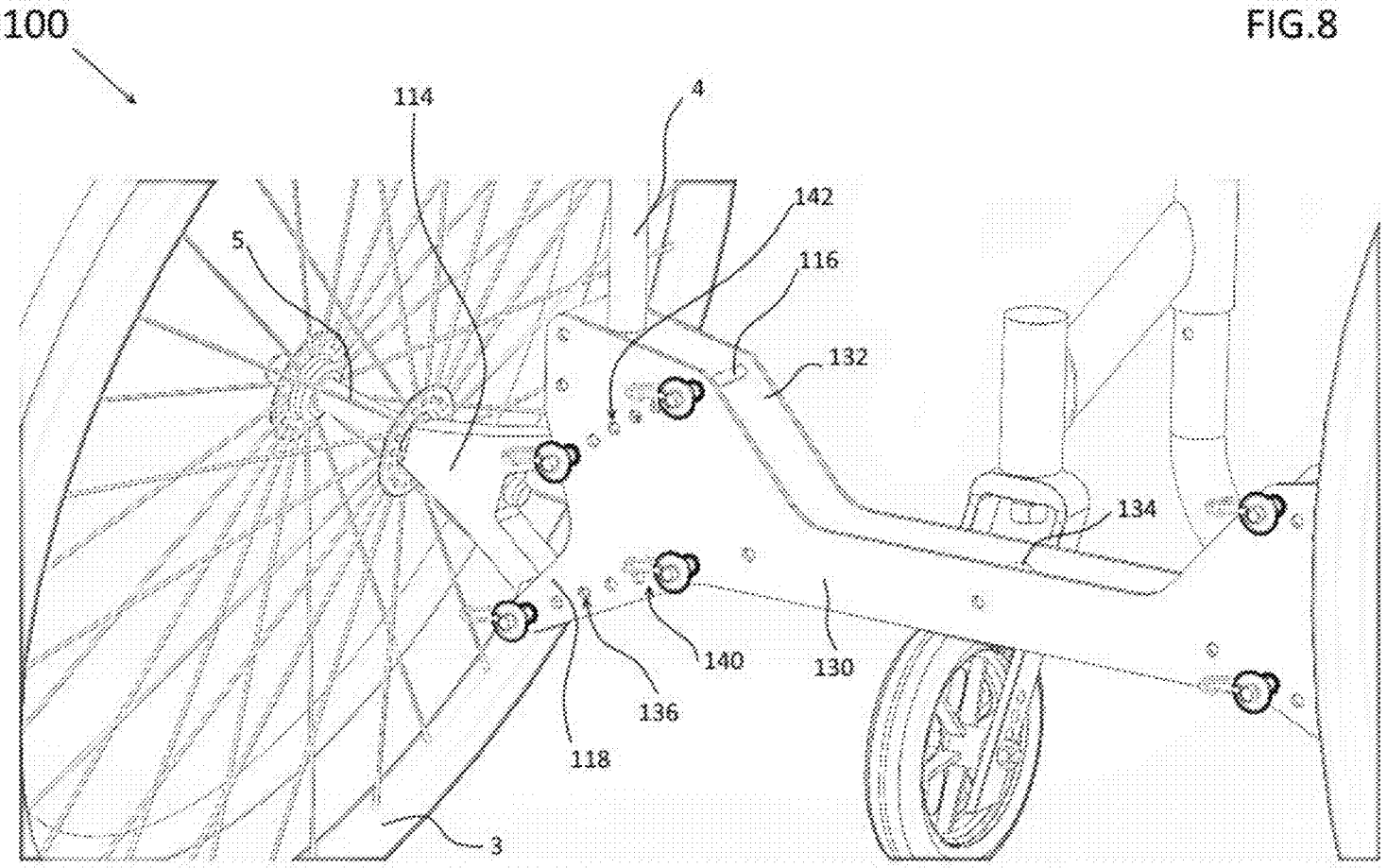
FIG. 8 is a perspective view of the wheelchair device and system of FIG. 7.
Figure 9:
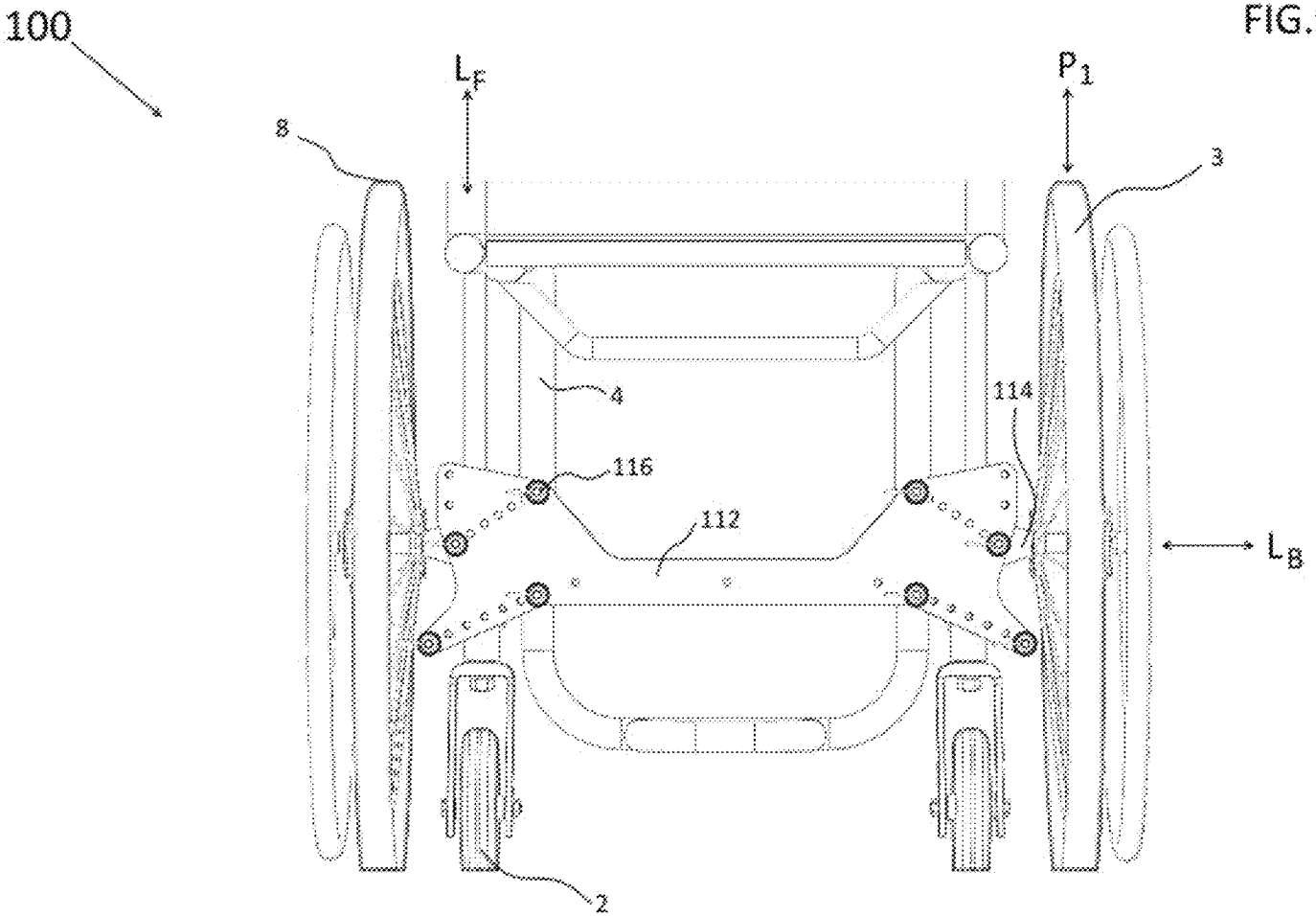
FIG. 9 is a rear elevational view of the wheelchair device and system of FIG. 7, in which the wheels are positioned in an uncambered position.

The bracket 112 can be a rigid element having a first end 118, an opposed second end 120 and a central portion 122 extending therebetween. In one aspect, the bracket can be substantially planar having a first face 124, an opposed second face 126 and a sidewall 128 extending therebetween. In another aspect, the bracket can comprise a first plate 130 and a second plate 132 spaced from the first plate a predetermined distance that cooperate to form the bracket 112. As seen in FIG. 8, for example, the first plate can be positioned on a first side of the wheelchair frame 4 and the second plate can be positioned on a second side of the wheelchair frame such that the plate are spaced the predetermined distance. Spacers 134 can be used to maintain the plates 130, 132 the predetermined distance apart. In another aspect, the bracket 112 can be a plate formed from a rigid material such as steel, stainless steel, titanium, aluminum, carbon fiber and the like.

At least one row of holes 136 can be defined in each of the first end 118 and the second end 120 of the bracket 112. In one aspect, each hole of the row of holes 136 can be sized and configured to receive a portion of the locking pin 116 therein. In another aspect, the row of holes 136 can be a substantially linear row having a longitudinal axis $L_1$ at an acute angle relative to the longitudinal axis $L_F$ of the frame 4. For example, the acute angle between the longitudinal axis $L_1$ of the first row and the longitudinal axis $L_F$ of the frame can be less than 30 degrees, about 30 degrees, about 45 degrees, about 60 degrees or greater than 60 degrees. Optionally, at least a portion of the row 136 can be arcuate in shape. In another aspect, the position and shape of the row can be selected so that in use, described more fully below, a top portion 8 of the wheel 3 can remain in a vertical plane $P_1$ of travel regardless of the camber of the wheel and/or so the frame 4 of the chair stays in the same relative position to the ground regardless of what camber option is chosen.

In another aspect, the at least one row of holes 136 defined in each of the first end 118 and the second end 120 of the bracket 112 can comprise a plurality of rows. For example, the at least one row can comprise a first row 140 and a second row 142 defined in each end. In this aspect, the first row can have a longitudinal axis $L_1$ and the second row can have a longitudinal axis $L_2$. In another aspect, the longitudinal axis $L_2$ of the second row 142 can be at an acute angle relative to the longitudinal axis $L_1$ of the first row. Alternatively, the first row 140 can be substantially parallel to the second row. In yet another aspect, the at least one row 136 defined in the first end 118 of the bracket can be a substantial mirror image of the at least one row defined in the second end 120 relative to a vertical plane positioned through the back of the wheelchair 1. Thus, the longitudinal axis of the first row 140 and/or the second row 142 of the first end 118 can be at substantially the same acute angle relative to the longitudinal axis $L_F$ of the frame 4 as the respective first row 140 and/or the second row 142 of the second end 120.

Figure 10:
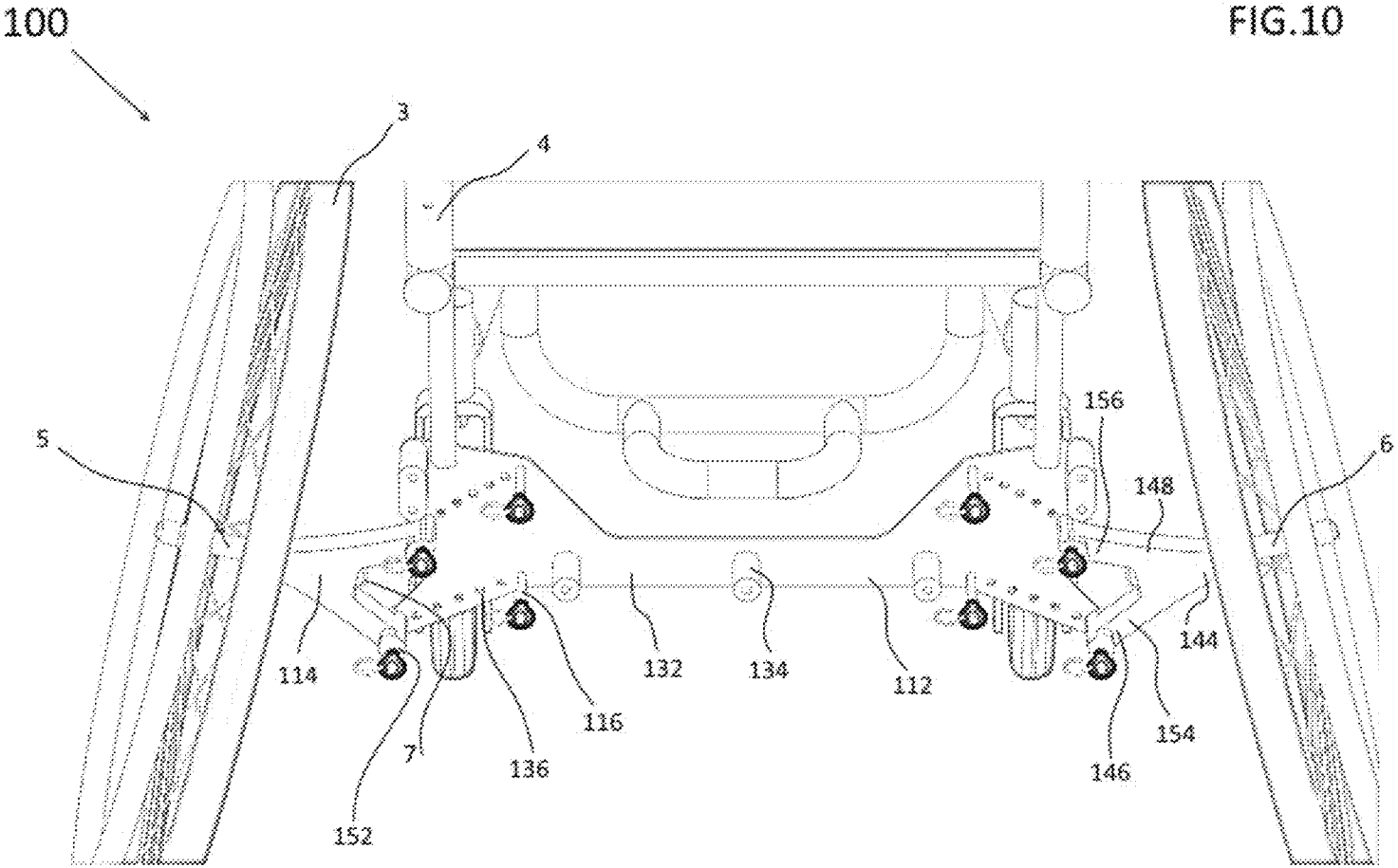
FIG. 10 is a cutaway perspective view of the wheelchair device and system of FIG. 7, in which portions of the device are not shown for clarity.
Figure 11:
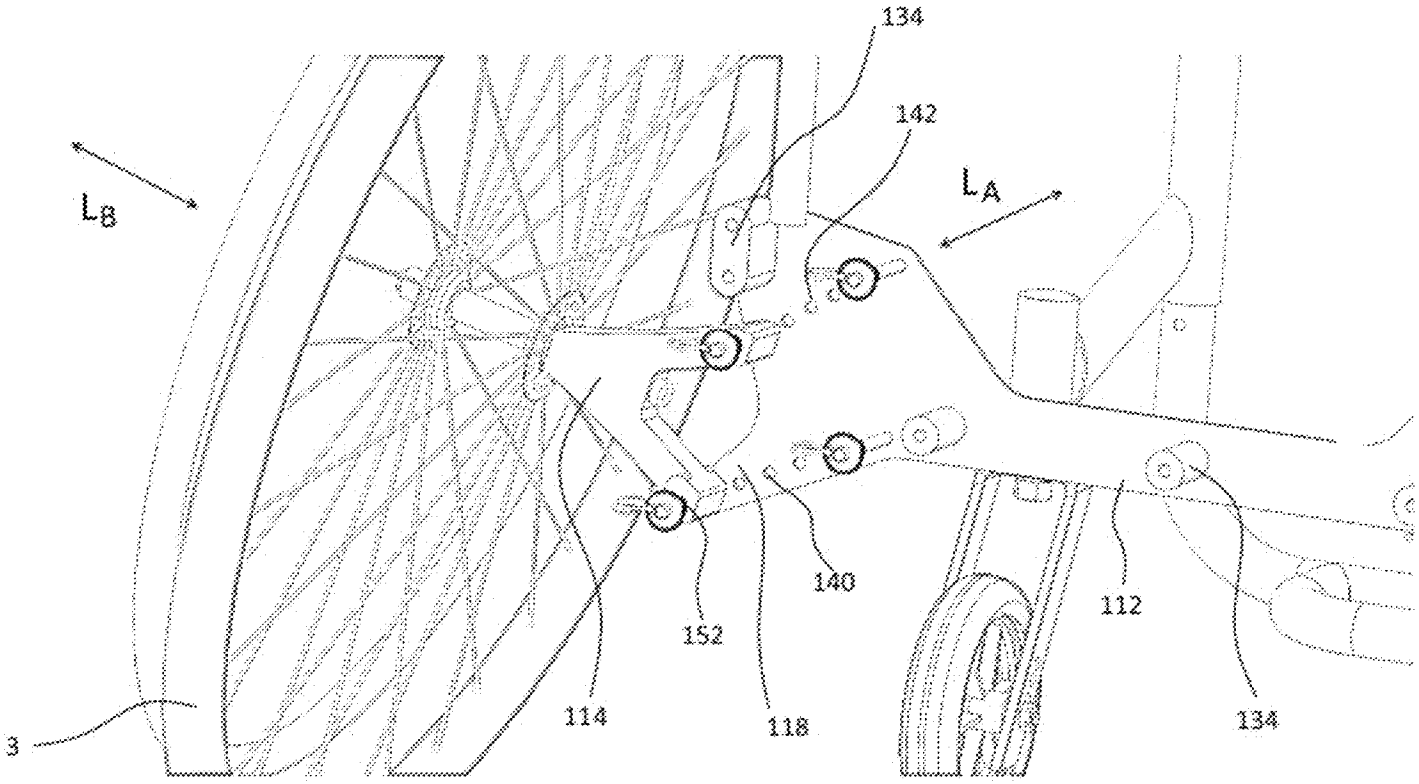
FIG. 11 is a cutaway perspective view of the wheelchair device and system of FIG. 7, in which portions of the device are not shown for clarity.
Figure 12:
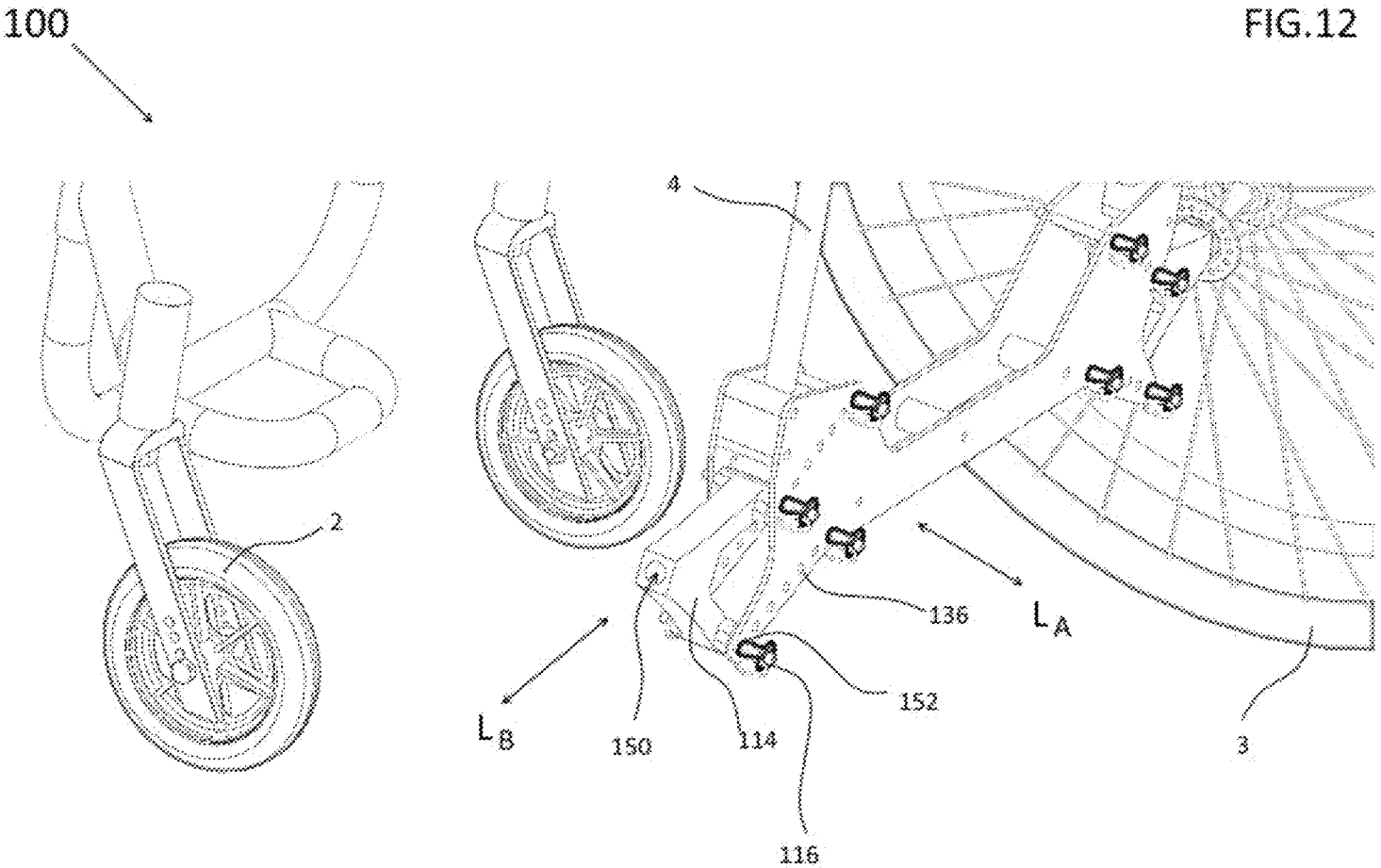
FIG. 12 is a perspective view of the wheelchair device and system of FIG. 7, in which a wheel is not shown for clarity.
Figure 13:
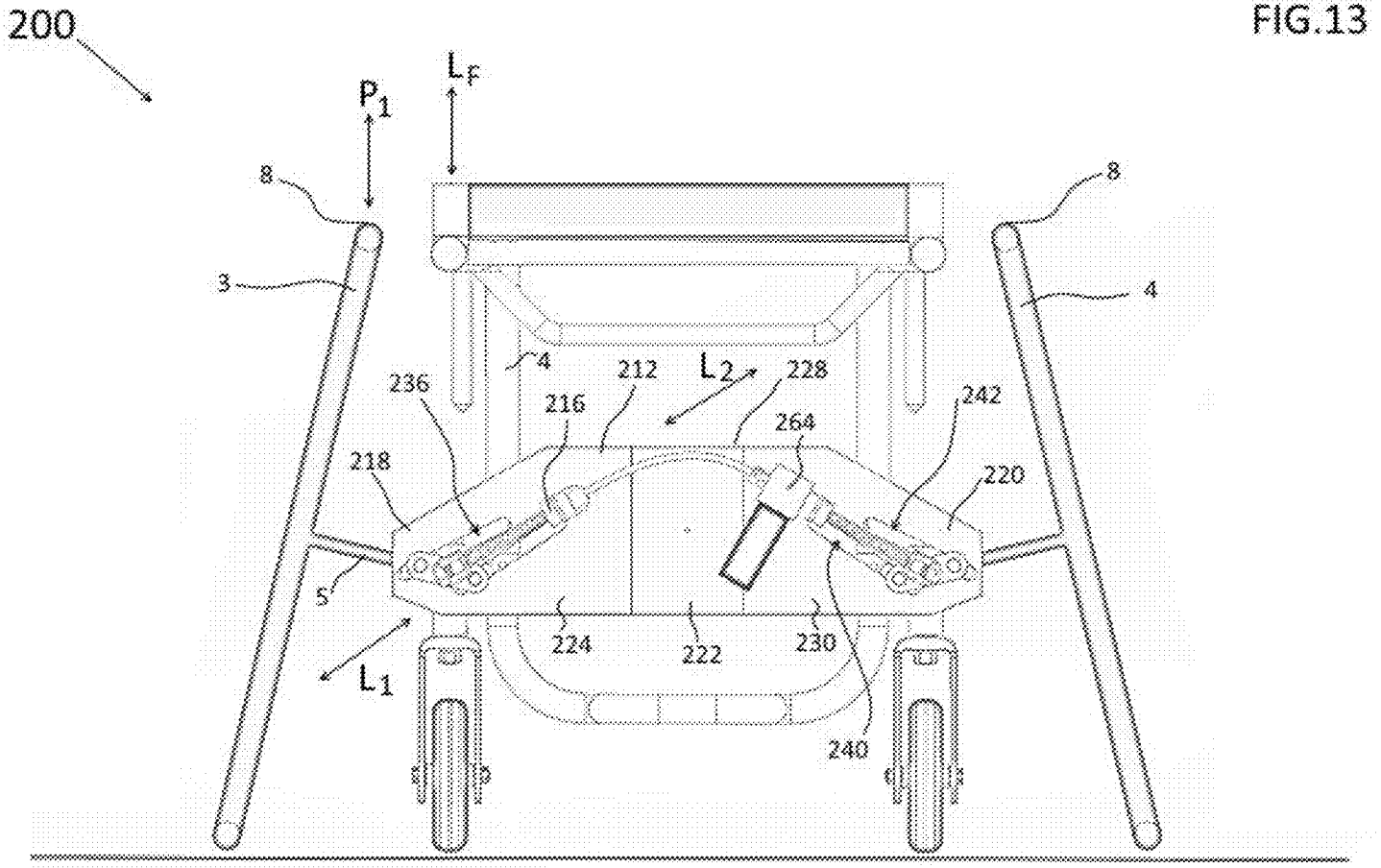
FIG. 13 is a rear elevational view of a wheelchair device and system having an adjustable camber of the present application, according to one aspect, in which the wheels are positioned in a cambered position.
Figure 14:
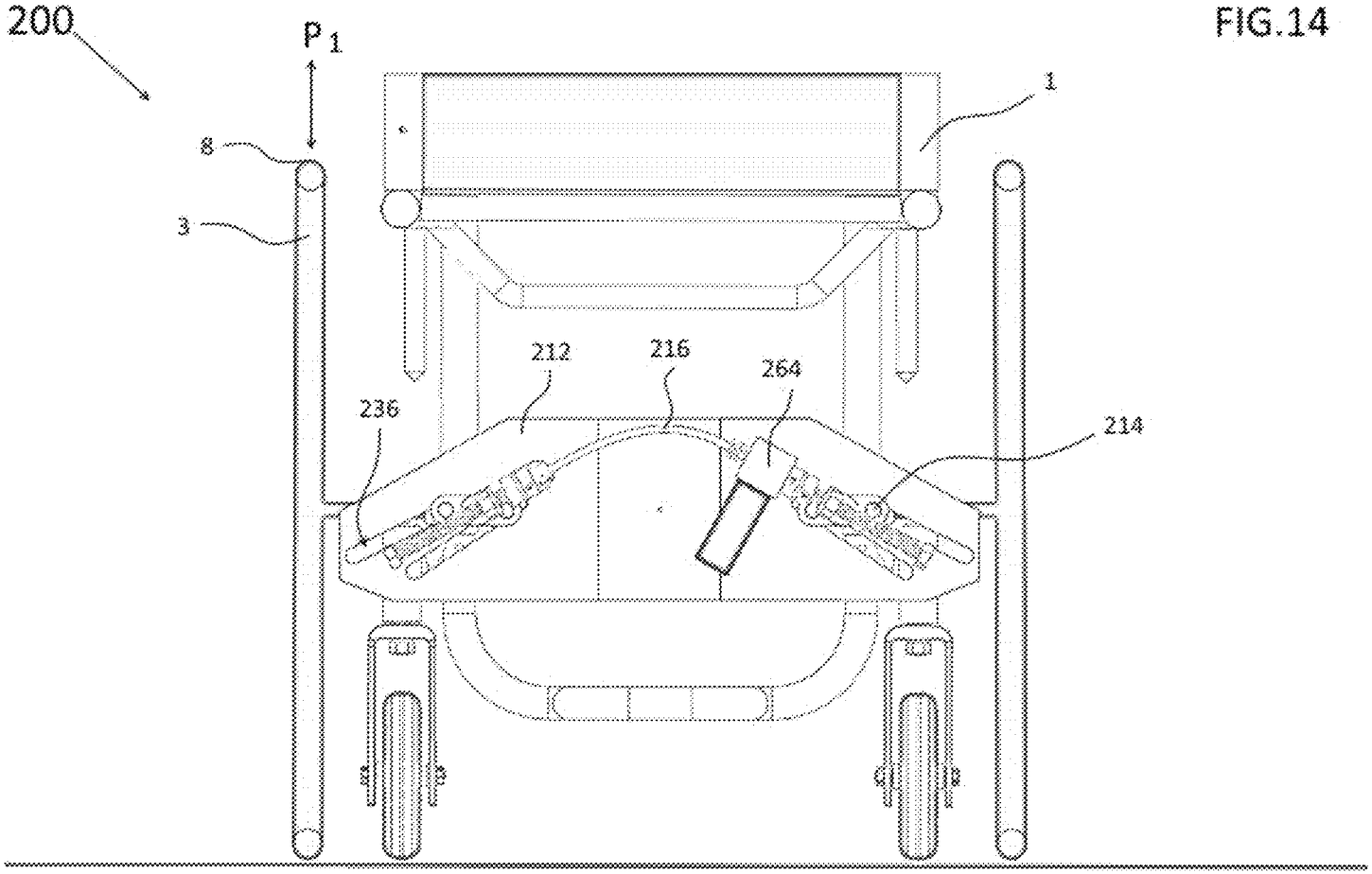
FIG. 14 is a rear elevational view of the wheelchair device and system of FIG. 13, in which the wheels are positioned in an uncambered position.
Figure 15:
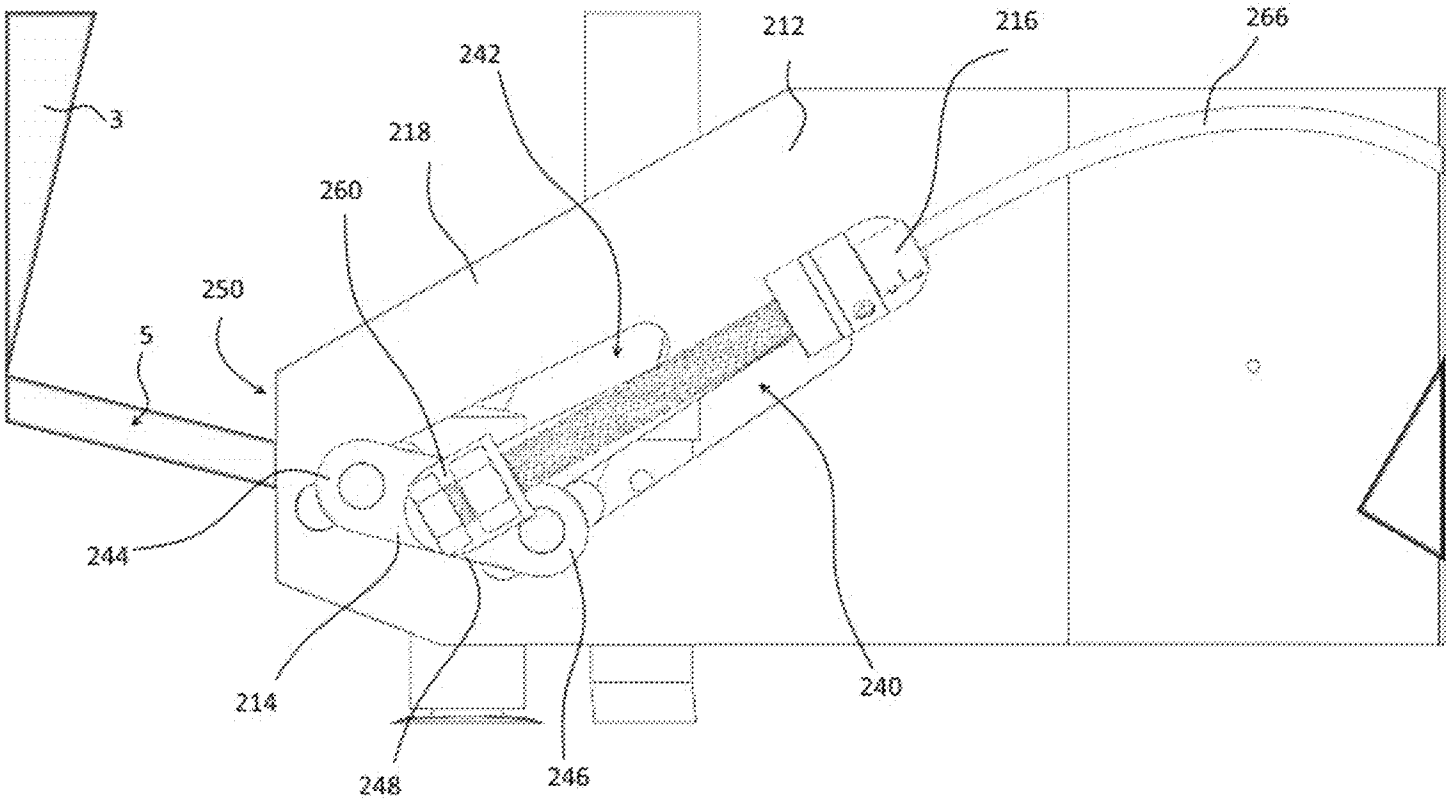
FIG. 15 is a magnified rear elevational view of the wheelchair device and system of FIG. 13.
Figure 16:
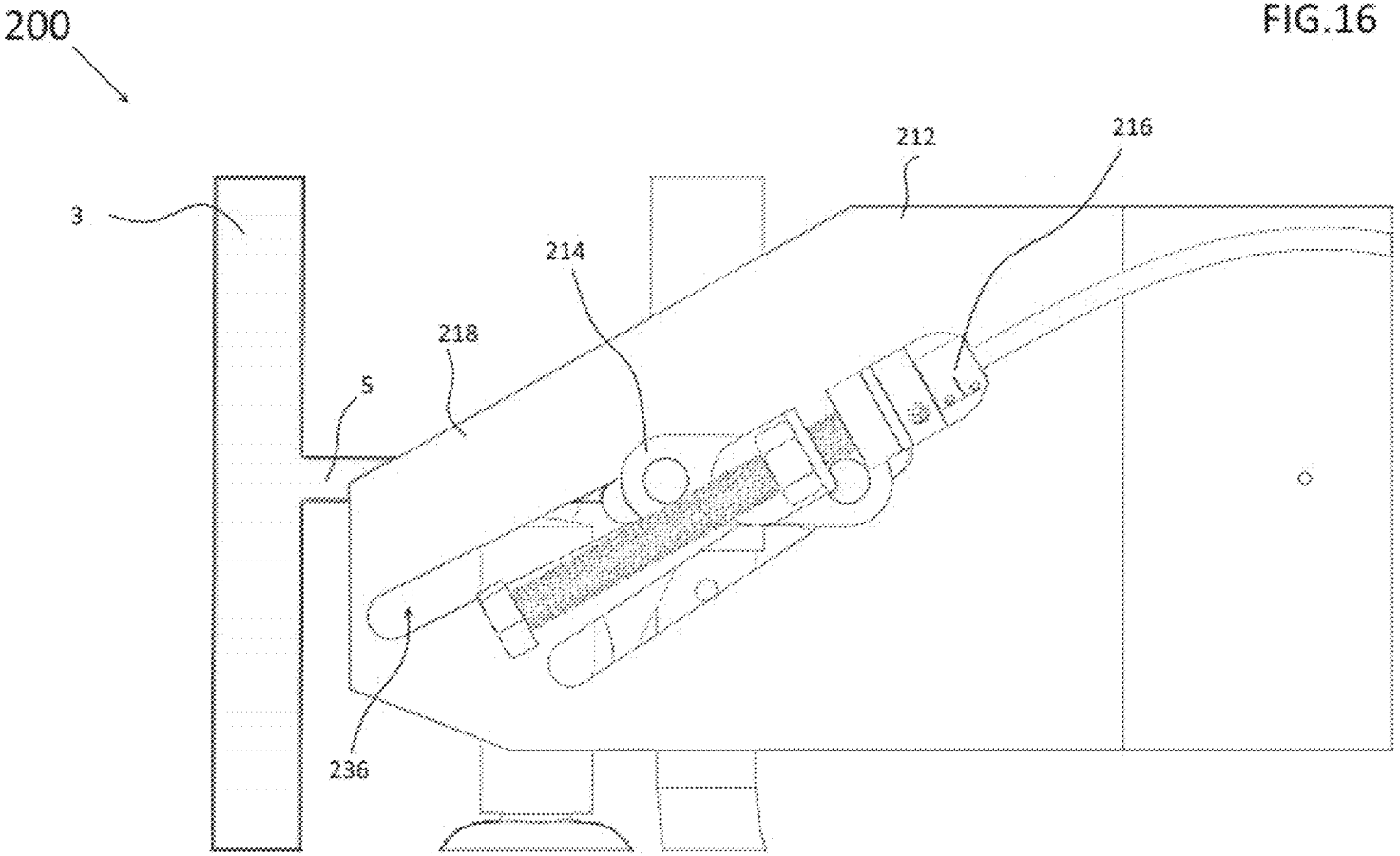
FIG. 16 is a magnified rear elevational view of the wheelchair device and system of FIG. 13, in which the wheels are positioned in an uncambered position.
Figure 17:
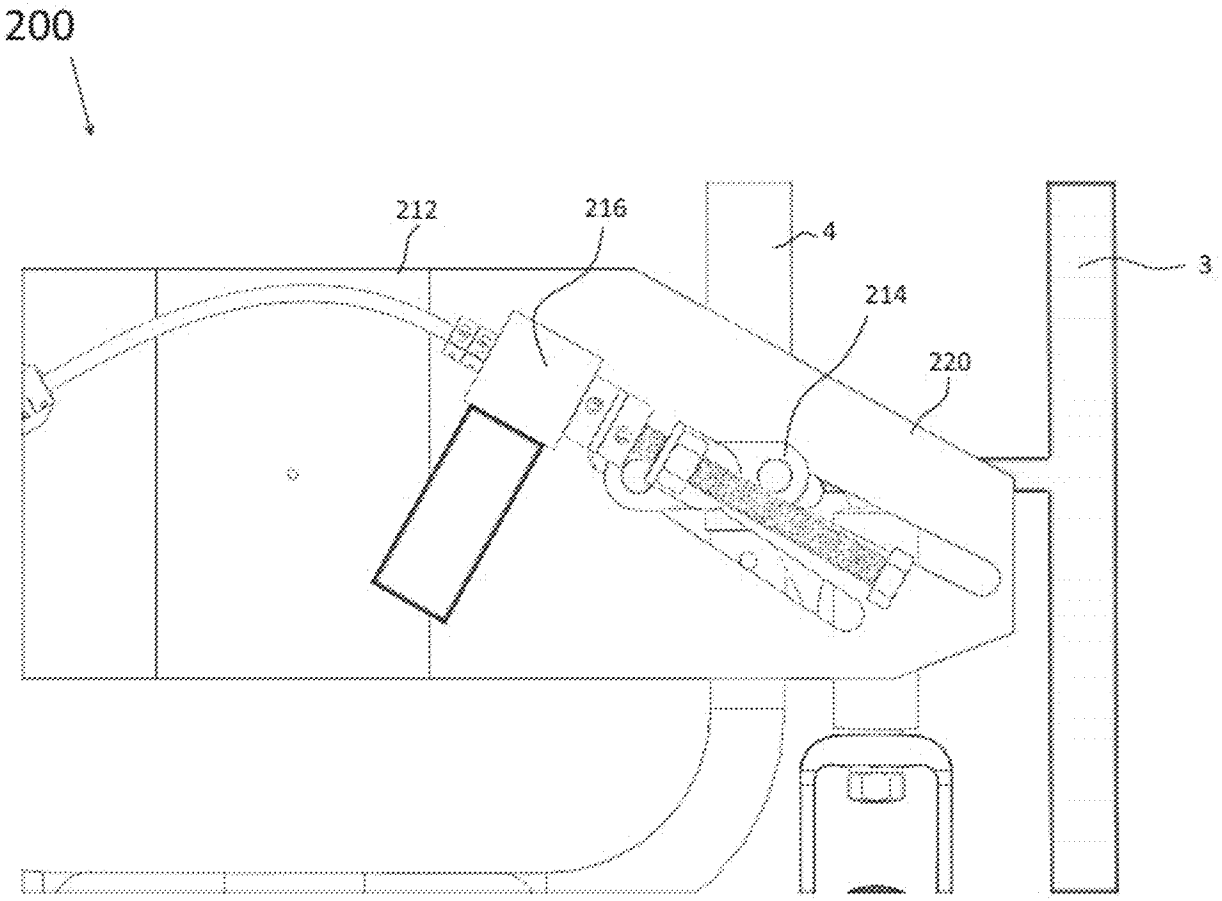
FIG. 17 is a magnified rear elevational view of the wheelchair device and system of FIG. 13, in which the wheels are positioned in an uncambered position.
Figure 18:
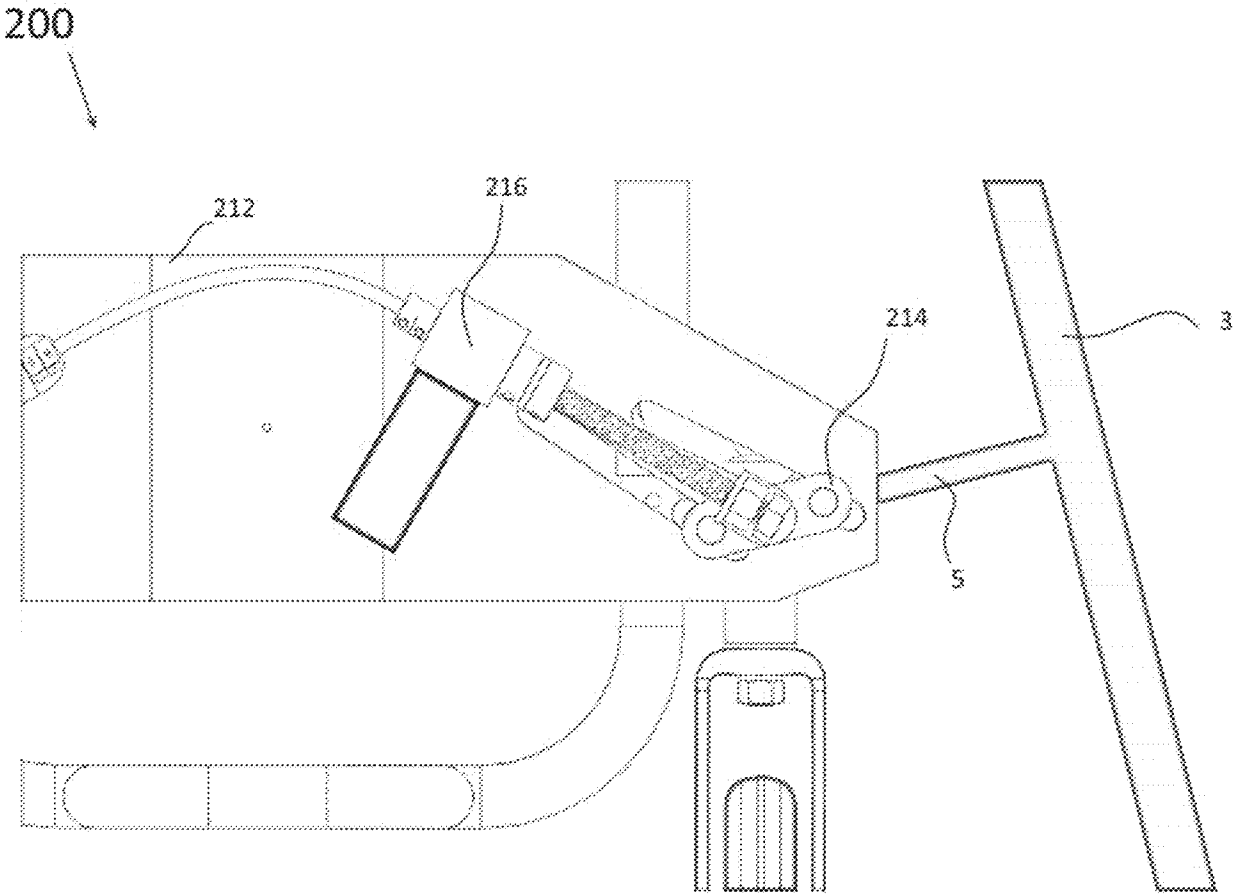
FIG. 18 is a magnified rear elevational view of the wheelchair device and system of FIG. 13.
Figure 19:
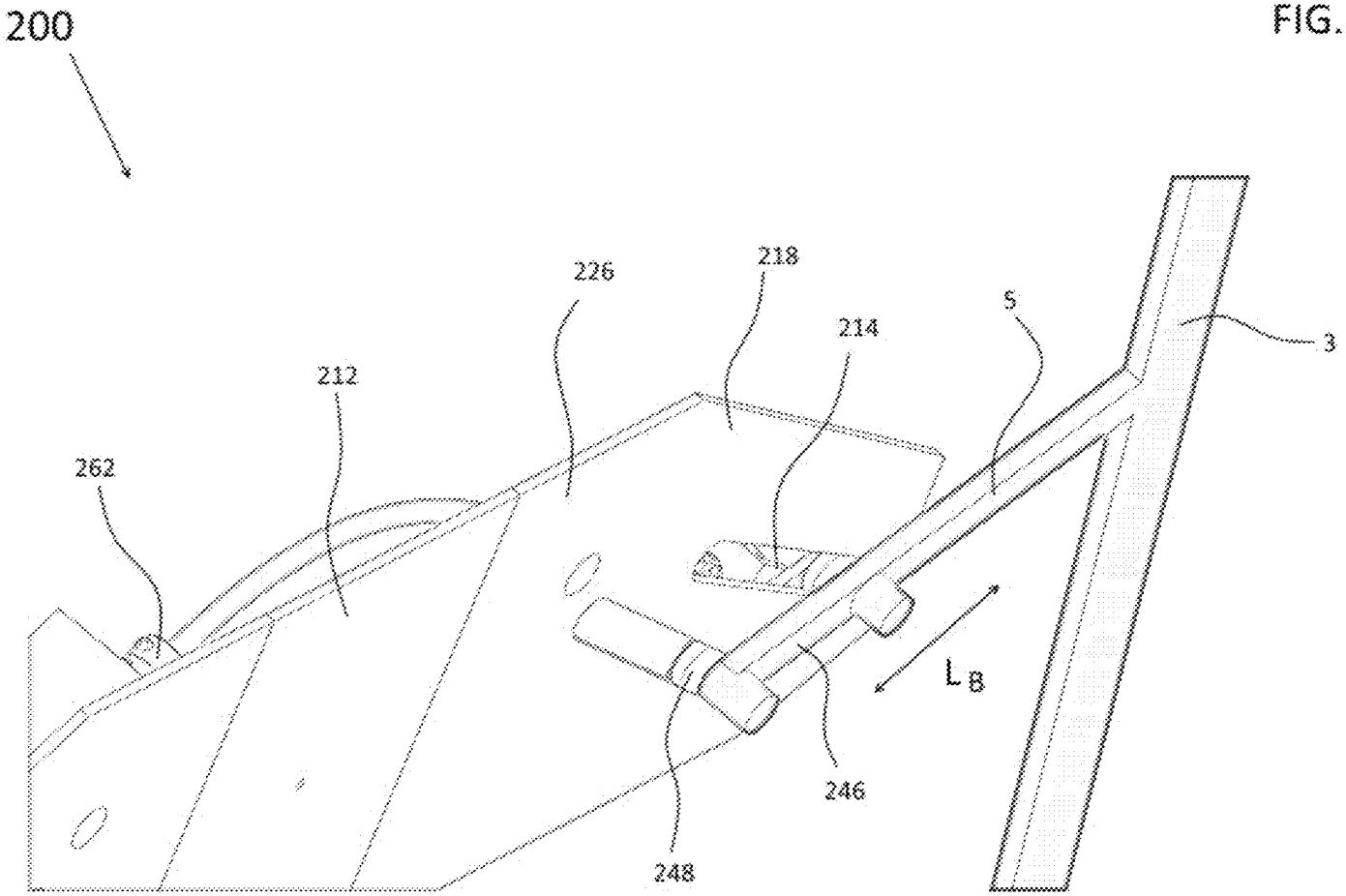
FIG. 19 is a cutaway perspective view of the wheelchair device and system of FIG. 13, in a cambered position, in which portions of the device are not shown for clarity.
Figure 20:
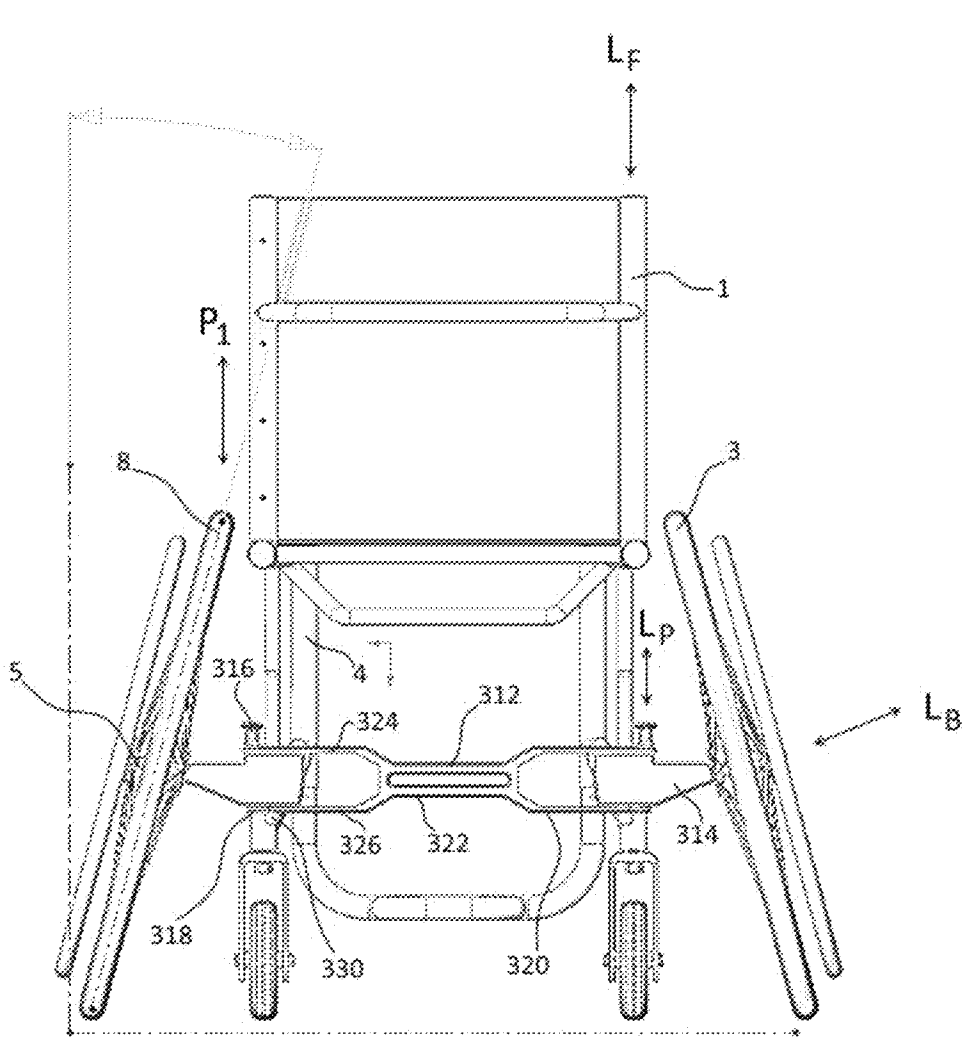
FIG. 20 is a rear elevational view of a wheelchair device and system having an adjustable camber of the present application, according to one aspect, in which the wheels are positioned in a cambered position.
Figure 21:
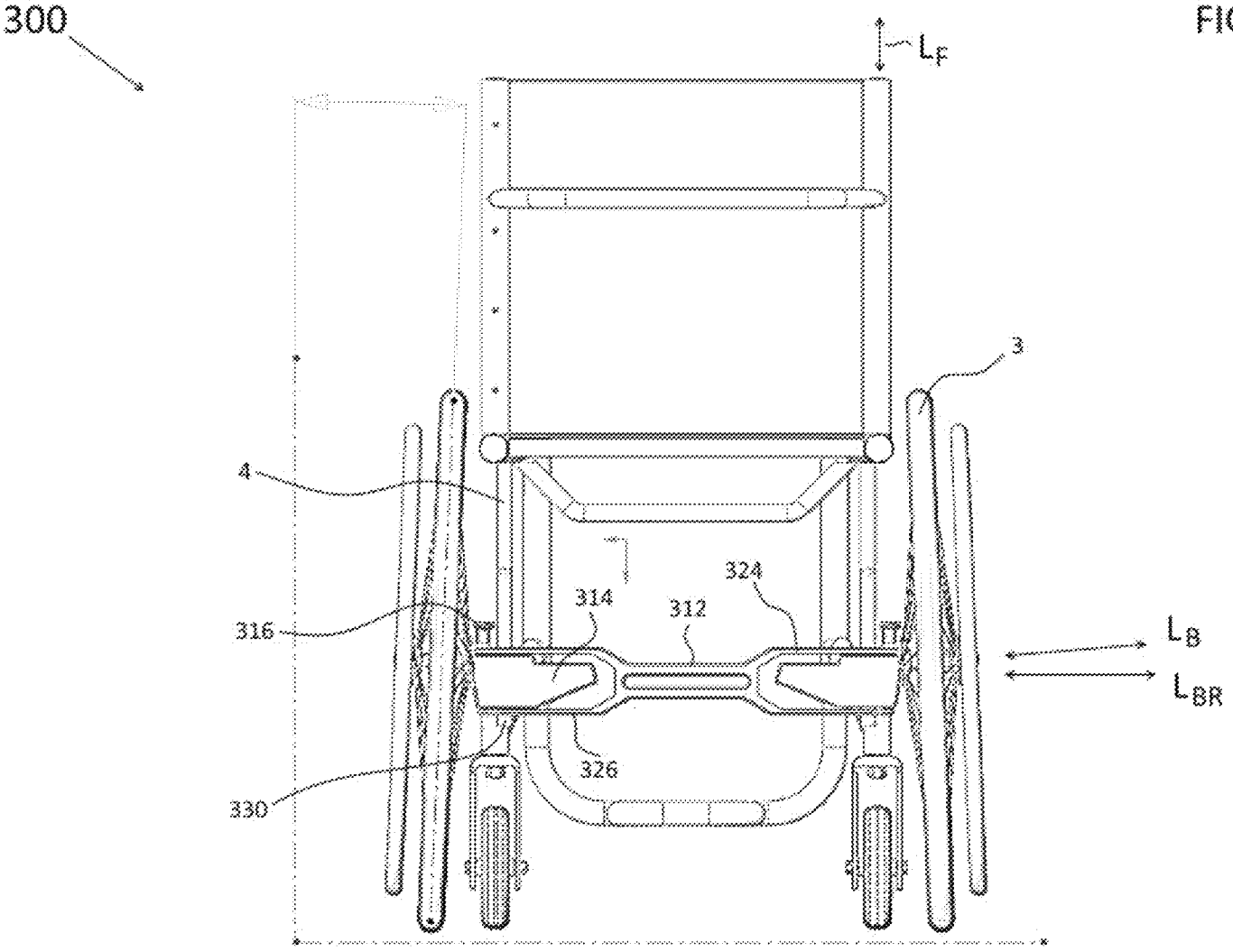
FIG. 21 is a rear elevational view of the wheelchair device and system of FIG. 20, in which the wheels are positioned in an uncambered position.
Figure 22:
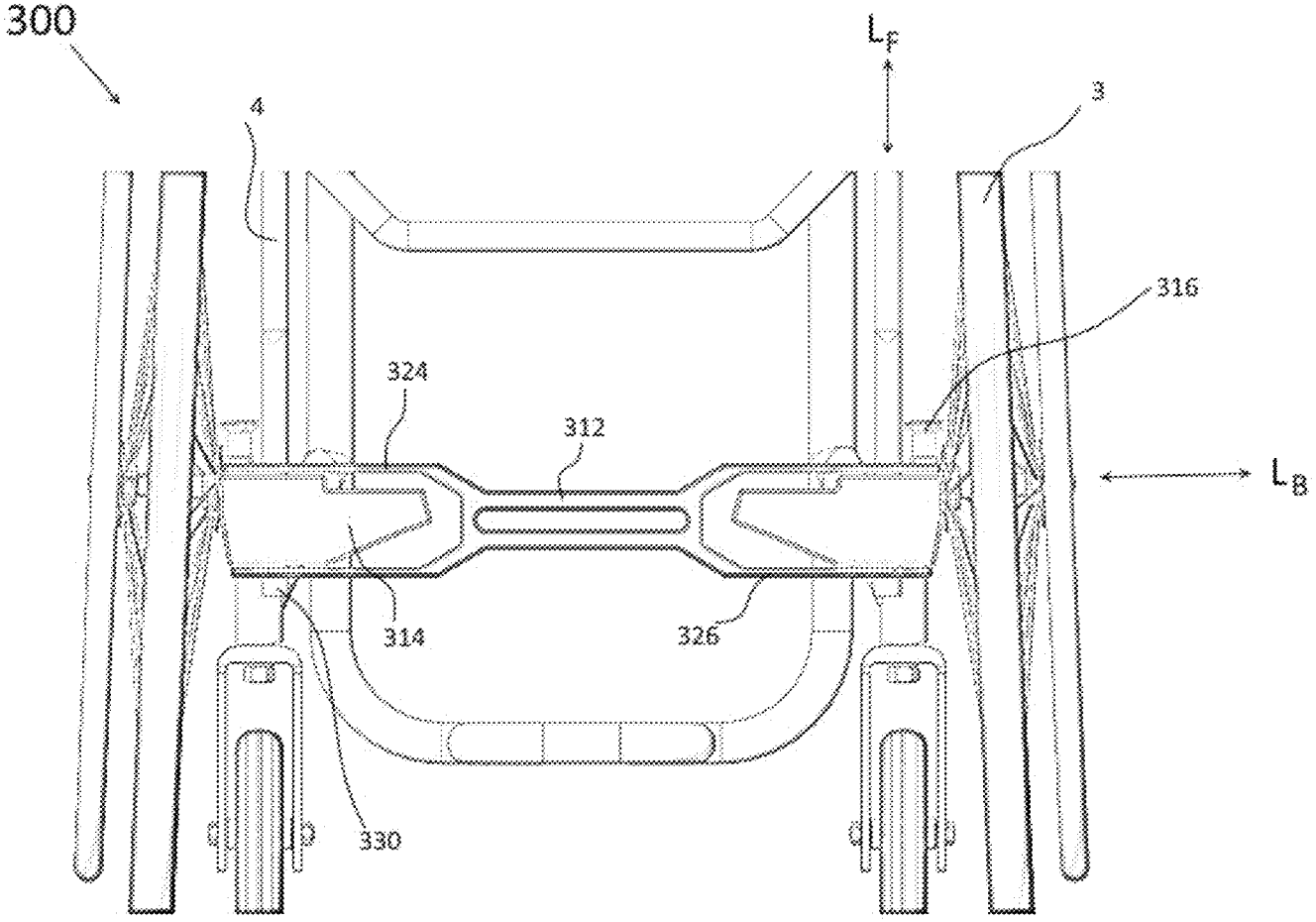
FIG. 22 is a magnified view of the wheelchair device and system of FIG. 20, in which the wheels are positioned in an uncambered position.
Figure 23:
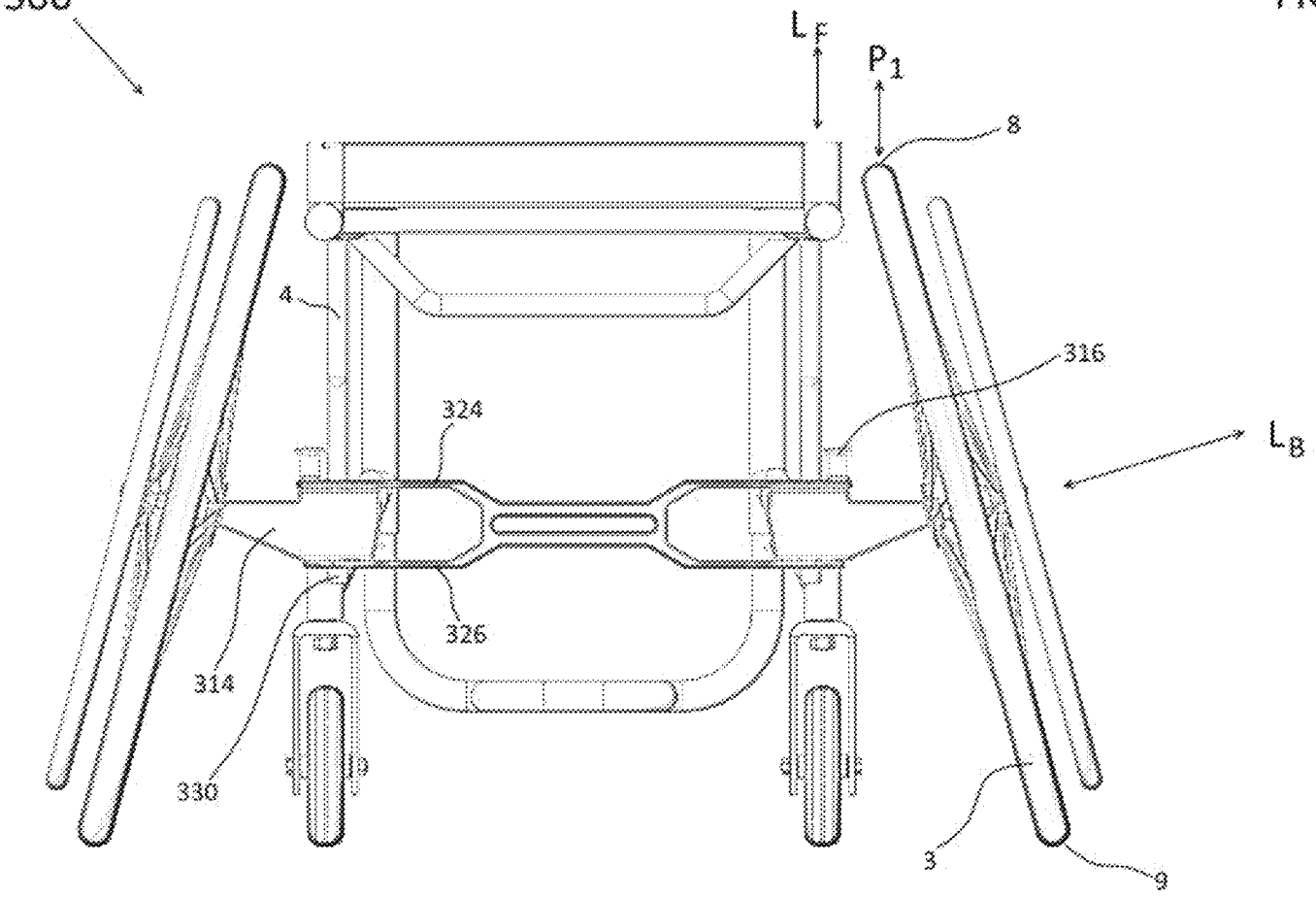
FIG. 23 is a magnified view of the wheelchair device and system of FIG. 22.

Referring now to FIGS. 10-12, the receiver 114 is illustrated more closely. In one aspect, the receiver comprises a distal end 144, an opposed proximal end 146 and a central portion 148 extending therebetween. In use, the receiver can be a rigid element configured to couple the axle 5 of the rear wheel 3 to the bracket 112. In another aspect, at least one elongate bore 150 having a bore axis $L_B$ can be defined in the distal end of the receiver, the bore configured to rotatingly engage the axle. As illustrated in FIG. 10, for example, the bore 150 can extend through the distal end 144 and at least a portion of the central portion 148 of the receiver so that an end of the axle 5 can be securedly, rotatably attached to the receiver. That is, a first end 6 of the axle can be secured to the rear wheel and a second end 7 of the axle 5 can be positioned in the bore 150.

Optionally, in one aspect, the at least one elongate bore 150 can comprise a plurality of elongate bores. For example, a second bore can be defined in the receiver 114 that is spaced from the first bore a predetermined distance. In another aspect, the position of the second bore can be selected to change the center of gravity of the chair 1. For example, the second bore could be positioned behind the first bore relative to the front of the chair (as viewed when assembled), to change the center of gravity of the chair 1 to be more stable climbing hills. In another example, the second bore could be positioned below the first bore relative to the front of the chair (as viewed when assembled), to change the center of gravity of the chair.

The proximal end 146 of the receiver 114 can be sized and configured to be selectively, releasably coupled to an end of the bracket 112. In one aspect, at least one pin aperture 152 having an aperture axis $L_A$ can extend through the proximal end of the receiver. In another aspect, the aperture axis $L_A$ can be substantially normal to the bore axis $L_B$. In still a further aspect, there can be at least one pin aperture for each row of holes 136 defined in an end of the bracket 112. Thus, if there are two rows in an end of the bracket, there can be at least two pin apertures 152 defined in the proximal end 146 of the receiver. In one aspect, the proximal end of the receiver 114 can have a width sized so that each pin aperture can be positioned adjacent to a row 136 in an end of the bracket. For example, if the first row 140 is spaced two inches from the second row 142, the proximal end 146 of the receiver can have a width that is greater than two inches. Optionally, in another aspect, a portion of the proximal end can be substantially "U" or "V" shaped. In this aspect, the proximal end 146 end can comprise a first rib 154 and a second rib 156 spaced from the first rib a predetermined distance so that, when assembled, the first rib 154 can be positioned adjacent the first row 140 of the bracket 112, and the second rib can be positioned adjacent the second row 142 of the bracket.

The at least one locking pin 116 can be a conventional locking pin. In one aspect, the locking pin can have a pin length sized and configured to extend through the at least one row of holes 136 of the bracket 112 and the at least one pin aperture 152 of the receiver. For example, the pin length can be sized to extend through the first row of holes 140 in the first plate 130 of the bracket, through the pin aperture defined in the first rib 154 of the receiver, and through the first row of holes of the second plate 132 of the bracket. In another aspect, the at least one locking pin can be a removable locking pin. In use, the pin can be sized and configured to releasably secure the receiver 114 to the bracket when inserted through the row of holes and the bracket.

To assemble the wheelchair 1 of the present application, the bracket 112 can be securedly attached to the wheelchair frame 4 with screws, bolts, pins and the like. In one aspect, the wheelchair can be a new wheelchair 1 assembled with the bracket attached. In another aspect, however, a conventional wheelchair can be retrofit with the bracket 112 to convert the conventional wheelchair 1 to a wheelchair with an adjustable camber. For example, a conventional wheelchair has a frame element that can be detached and replaced with the bracket 112. In this aspect, the bracket can be provided in different lengths and widths to fit different sized chairs 1. Further, the bracket can be configured to couple to the wheelchair frame 4 having a tube diameter of less than about 1 inch, 1 inch, 1⅛ inches, 1¼ inches, 1½ inches, or greater than 1½ inches.

The axle 5 of the wheel 3 can be positioned in the bore 150 of the distal end 144 of the receiver 114 and securedly, rotatably coupled to the receiver. For example, the axle can be a push pin axle with release balls positioned in the second end 7 of the axle to rotatingly couple the axle to the receiver.

The proximal end 146 of the receiver can be positioned so that the at least one pin aperture 152 of the receiver 114 is adjacent to and/or co-axially aligned with a hole in the row of holes 136 defined in an end of the bracket 112. In one aspect, if there are a plurality of rows, the proximal end of the receiver can be positioned so that a pin aperture is adjacent a hole of each row 136. For example, if there are two rows of holes, the proximal end 146 can be positioned so that a pin aperture is aligned with a hole defined in both rows. With the at least one pin aperture 152 and the hole of a row co-axially aligned, a locking pin 116 can be inserted through each pin aperture and the aligned hole to securedly, releasably couple the receiver 114 to the bracket 112 in the desired position.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could remove each locking pin 116 from the holes 136 on one end of the bracket 112. The proximal end 146 of the receiver can then be moved so that the at least one pin aperture 152 of the receiver 114 is adjacent to and/or co-axially aligned with a different hole. In another aspect, the hole pattern of the row of holes 136 can be predetermined to correspond to a wheel camber of 0 degrees to 15 degrees with 2.5 degree increments. Of course, it is contemplated that the wheel camber could be greater than 15 degrees or less than 0 degrees (a negative camber) if desired by adding more holes 136 to the rows. It is also contemplated that the incremental change could be more or less than 2.5 degrees if desired so that a wider range of wheel camber is possible by adding more notches holes to the rows 136 and/or changing the staggering of the holes.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

In one embodiment and as illustrated in FIGS. 13-19, the system 200 comprises a bracket 212 coupled to the wheelchair 1, a plurality of receivers 214 coupled to the bracket and at least one actuator 216 for moving the receivers relative to the bracket 212. In use, an end of the receiver 214 can be configured to rotatably couple the axle 5 of the rear wheel 3 to the receiver and an actuator can selectively cause a portion of the receiver 214 to slidingly engage the bracket 212 to change the wheel camber to a desired position.

The bracket 212 can be a rigid element having a first end 218, an opposed second end 220 and a central portion 222 extending therebetween. In one aspect, the bracket can be substantially planar having a first face 224, an opposed second face 226 and a sidewall 228 extending therebetween. In another aspect, the bracket can comprise a first plate 230 and a second plate spaced from the first plate a predetermined distance that cooperate to form the bracket 212. For example, the first plate can be positioned on a first side of the wheelchair frame 4 and the second plate can be positioned on a second side of the wheelchair frame such that the plates are spaced the predetermined distance. Spacers can be used to maintain the plates the predetermined distance apart. In another aspect, the bracket 212 can be a plate formed from a rigid material such as steel, stainless steel, titanium, aluminum, carbon fiber and the like.

At least one slot 236 can be defined in each of the first end 218 and the second end 220 of the bracket 212. In one aspect, the slot can be sized and configured to receive a portion of the receiver 214 therein. In another aspect, the slot 236 can be a substantially linear slot having a longitudinal axis $L_1$ at an acute angle relative to the longitudinal axis $L_F$ of the frame 4. For example, the acute angle between the longitudinal axis $L_1$ of the first slot and the longitudinal axis $L_F$ of the frame can be less than 30 degrees, about 30 degrees, about 45 degrees, about 60 degrees or greater than 60 degrees. Optionally, at least a portion of the slot 36 can be arcuate in shape. In another aspect, the position and shape of the slot can be selected so that in use, described more fully below, a top portion 8 of the wheel 4 can remain in a vertical plane $P_1$ of travel regardless of the camber of the wheel and/or so the frame 4 of the chair stays in the same relative position to the ground regardless of what camber option is chosen.

In another aspect, the at least one slot 236 defined in each of the first end 218 and the second end 220 of the bracket 212 can comprise a plurality of slots. For example, the at least one slot can comprise a first slot 240 and a second slot 242 defined in each end. In this aspect, the first slot can have the longitudinal axis $L_1$ and the second slot can have a longitudinal axis $L_2$. In another aspect, the longitudinal axis $L_2$ of the second slot 242 can be at an acute angle relative to the longitudinal axis $L_1$ of the first slot. Alternatively, the first slot 240 can be substantially parallel to the second slot. In yet another aspect, the at least one slot 236 defined in the first end 218 of the bracket can be a substantial mirror image of the at least one slot defined in the second end 220 relative to a vertical plane positioned through the back of the wheelchair 1. Thus, the longitudinal axis of the first slot 240 and/or the second slot 242 of the first end 218 can be at substantially the same acute angle relative to the longitudinal axis $L_F$ of the frame 4 as the respective first slot 240 and/or the second slot 242 of the second end 220.

Referring now to FIGS. 15-19, the receiver 214 is illustrated more closely. In one aspect, the receiver comprises a first side element 244, an opposed second side element 246 and a central element 248 extending therebetween. In use, the receiver can be a rigid element configured to couple the axle 5 of the rear wheel 3 to the bracket 212. In another aspect, at least one elongate bore 250 having a bore axis $L_B$ can be defined in the receiver, the bore configured to rotatingly engage the axle.

Optionally, in one aspect, the at least one elongate bore 250 can comprise a plurality of elongate bores. For example, a second bore can be defined in the receiver 214 that is spaced from the first bore a predetermined distance. In another aspect, the position of the second bore can be selected to change the center of gravity of the chair 1. For example, the second bore could be positioned behind the first bore relative to the front of the chair (as viewed when assembled), to change the center of gravity of the chair 1 to be more stable climbing hills. In another example, the second bore could be positioned below the first bore relative to the front of the chair (as viewed when assembled), to change the center of gravity of the chair.

The first side element 244 of the receiver 214 can be sized and configured to be positioned on the first face 224 of the bracket adjacent the slot 230. The second side element 246 of the receiver can be sized and configured to be positioned on the second face 226 or the second plate of the bracket 212 adjacent the at least one slot 236. In one aspect, at least a portion of the central element 248 of the receiver can be sized and configured to extend through the slot. In this aspect, the central element of the receiver 214 can slidingly engage the wall 228 of the bracket 212 to adjustably couple the receiver to an end of the bracket 212. The central element can be prevented from sliding out of the slot by the first side element 24 and the second side element 246.

In one aspect, the at least one actuator 216 is sized and configured for moving each receiver 214 relative to the bracket 212. In another aspect, a first end 260 of the actuator can be coupled to a portion of the receiver 214, such as the first side element 244 or the second side element 246. A second end 262 of the actuator 216 can be coupled to a stationary portion of the wheelchair, such as the frame 4, the bracket 212 and the like. In use, described more fully below, the user can actuate the actuator, either manually, or automatically, which can cause the first end 260 of the actuator to move relative to the second end 262, thereby moving the receiver 214 relative to the bracket 216.

For example, the actuator 216 can comprise a push and/or pull cable with a handle that a user can adjust to select a receiver 214 position and thus a camber option. In another example, the actuator can comprise a cable and a knob that the user can rotate to select a receiver 214 position. Optionally, in another example the actuator can comprise an electric motor 264 with a controller that the user can operate. In this example, the motor can be coupled to at least one shaft 266, such as a flex shaft, so that rotation of the motor 264 causes rotation of the shaft and corresponding movement of the receiver 214 relative to the bracket 212. In still another aspect, the shaft 266 can be coupled to the wheels 3 of the chair, so that rotation of the wheels can cause selective rotation of the shaft. Thus, the user could engage the shaft with the wheels and then rotate the wheels, thereby causing rotation of the shaft and corresponding movement of the receiver relative to the bracket.

To assemble the wheelchair 1 of the present application, the bracket 212 can be securedly attached to the wheelchair frame 4 with screws, nuts, bolts, pins and the like. In one aspect, the wheelchair can be a new wheelchair 1 assembled with the bracket attached. In another aspect, however, a conventional wheelchair can be retrofit with the bracket 212 to convert the conventional wheelchair 1 to a wheelchair with an adjustable camber. For example, a conventional wheelchair 1 has a frame element that can be detached and replaced with the bracket 212. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

In one aspect, the central element 248 of the receiver 214 can be positioned in the at least one slot 230 so that at least a portion of the central element extends through the slot. The first side element 244 of the receiver can be positioned on the first face 224 of the bracket 212 and coupled to a portion of the central element. The second side element 246 of the receiver 214 can be positioned on the second face 226 or second plate of the bracket and coupled to a portion of the central element 248. Fasteners such as nuts, bolts, pins and the like can securedly attach the first side element, the central element and the second side element together. The axle 5 of the wheel 3 can be positioned in the bore 250 of the receiver 214 and securedly, rotatably coupled to the receiver.

In use, the rider could select a desired wheel camber. To change the wheel camber, the rider could make the change while moving in the wheelchair 1. In one aspect, to change the camber of a wheel, the rider can actuate the actuator 216. For example, the rider can turn a knob, push a handle, activate the motor 264 and the like. The actuator can cause the receiver 214 to slide relative to the bracket 212, thereby adjusting the wheel camber as the receiver moves along the at least one slot 230.

In one aspect, because the receiver 214 can be positioned at any position along the length of the slot 230, the wheel camber can be adjusted to any camber between about 0 degrees to 15 degrees with any degree increment. Of course, it is contemplated that the wheel camber could be greater than 15 degrees or less than 0 degrees (a negative camber) if desired by adding more length to the slot and/or changing the angle of the longitudinal axis $L_1$, $L_2$ of the slot 230 relative to the bracket 212.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

In one embodiment and as illustrated in FIGS. 20-25, the system 300 comprises a bracket 312 coupled to the wheelchair 1, a pair of receivers 314 coupled to the bracket and at least one locking pin 316 for each receiver. In use, the receiver can rotatingly engage a portion of the bracket 312 and an end of the receiver 314 can be configured to rotatably couple the axle 5 of the rear wheel 3 to the receiver. The at least one locking pin can releasably secure the receiver 314 to the bracket 312 in a desired position.

The bracket 312 can be a rigid element having a first end 318, an opposed second end 320 and a central portion 322 extending therebetween. In one aspect, the first end and/or the second end of the bracket can be substantially "U-shaped". The central portion of the bracket can connect the first end 318 to the second end 320 a predetermined distance apart. In another aspect, the bracket 312 can be formed from a rigid material such as steel, stainless steel, titanium, aluminum, carbon fiber and the like.

Each of the first end 318 and the second end 320 of the bracket 312 have an upper bracket element 324 and an opposed lower bracket element 326 that is spaced from the upper bracket element a predetermined distance. In one aspect, the predetermined distance can be sized so that at least a portion of the receiver 314 can be positioned between the upper bracket element 324 and the opposed lower bracket element 326. In another aspect, at least one passage 328 can be defined through at least one on the upper bracket element and the lower bracket element. In this aspect, the passage can be sized and configured so that at least a portion of the frame 4 of the wheelchair 1 can be positioned in the passage. For example, when assembled, a distal end 330 of the frame can extend through the passage 328 defined in the upper bracket element 324 and the opposed lower bracket element 326. In another aspect, the passage 328 can have a passage longitudinal axis $L_{P1}$ that is substantially normal to the longitudinal axis of the bracket $L_{BR}$.

In another aspect, at least one locking hole 332 can be defined in at least one of the upper bracket element 324 and the lower bracket element 326. In this aspect, the locking hole can be sized and configured to engage a portion of the locking pin 316 to releasably secure the receiver 314 to the bracket 312.

Figure 24:
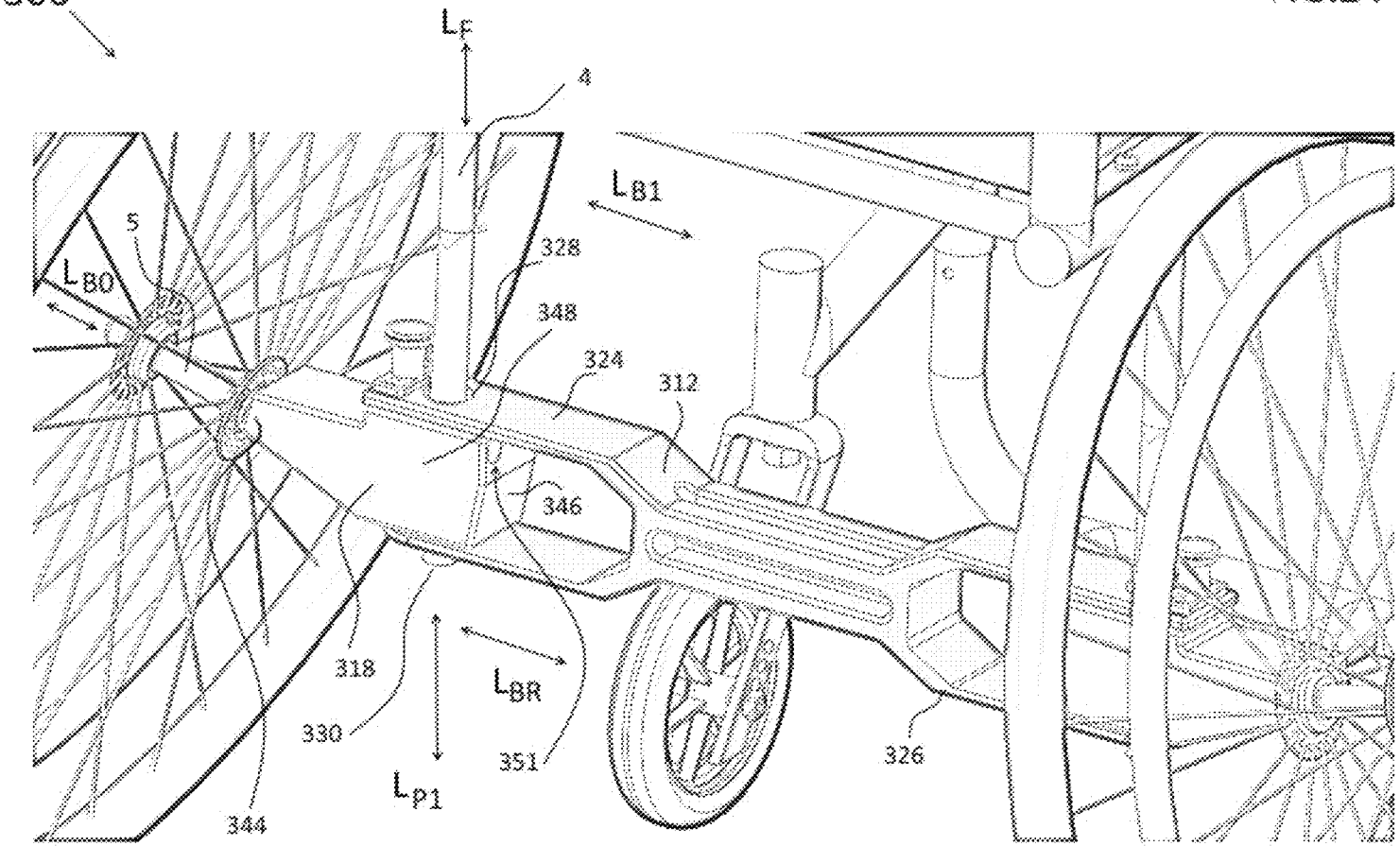
FIG. 24 is a perspective view of the wheelchair device and system of FIG. 20.
Figure 25:
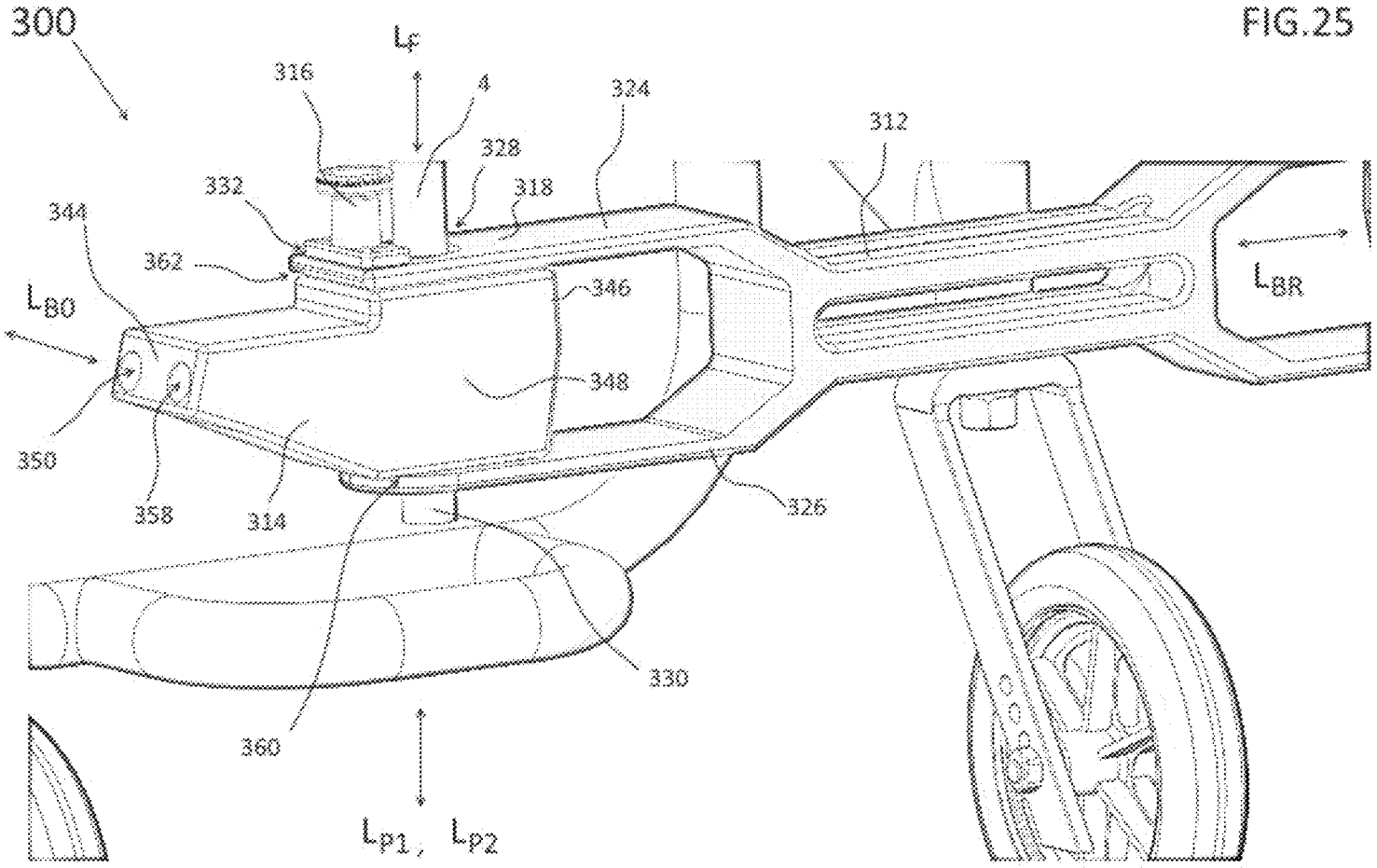
FIG. 25 is a cutaway perspective view of the wheelchair device and system of FIG. 20, in which a wheel is not shown for clarity.

Referring now to FIGS. 24-25, the receiver 314 is illustrated in more detail. In one aspect, the receiver comprises a distal end 344, an opposed proximal end 346 and a central portion 348 extending therebetween. In use, the receiver can be a rigid element configured to couple the axle 5 of the rear wheel 3 to the bracket 312. In another aspect, at least one elongate bore 350 having a bore axis $L_{B0}$ can be defined in the distal end of the receiver, and at least one elongate bore 351 having a bore axis $L_{B1}$ can be defined in the proximal end of the receiver 314. In this aspect, each elongate bore can be configured to engage the axle so that the axle can rotate relative to the receiver 314. In another aspect, each elongate bore 350, 351 can be sized and configured so that the axle can extend through the bore and be securely held in place so that the axle 5 can rotate relative to the receiver without allowing the axle to inadvertently slide out of the bore 350, 351.

In one aspect, the bore axis $L_{B0}$ of the elongate bore 350 defined in the distal end 344 of the receiver 314 can be substantially parallel to the longitudinal axis $L_{BR}$ of the bracket 312 when assembled. Alternatively, the bore axis $L_{B0}$ of the elongate bore 350 defined in the distal end 344 can be at an acute bore angle relative to the longitudinal axis of the bracket. For example, the bore angle between the bore axis $L_{B0}$ of the elongate bore 350 defined in the distal end 344 and the longitudinal axis $L_{BR}$ of the bracket 312 can be predetermined to correspond to a wheel camber of about 0 degrees to 15 degrees with 2.5 degree increments. Of course, it is contemplated that the wheel camber could be greater than 15 degrees or less than 0 degrees (a negative camber) if desired by adding more bores to the receiver 314 and/or altering the bore angle of an elongate bore. It is also contemplated that the incremental change could be more or less than 2.5 degrees.

In another aspect, the bore axis $L_{B1}$ of the elongate bore 351 defined in the proximal end 346 of the receiver 314 can be at a different bore angle relative to the bore axis $L_{BR}$ of the bracket 312 when assembled than the bore axis $L_{B0}$ of the elongate bore 350 defined in the distal end 344 of the receiver. That is, the bore axis $L_{B0}$ of the elongate bore 350 defined in the distal end 344 of the receiver 314 can be out of parallel with the bore axis $L_{B1}$ of the elongate bore 351 defined in the proximal end 346 of the receiver 314. In a further aspect, the bore axis $L_{B1}$ can be at an acute bore angle relative to the bore axis $L_{B2}$. For example, the bore angle between the bore axis $L_{B0}$ of the elongate bore 350 defined in the distal end 344 and the bore axis $L_{B1}$ of the elongate bore 351 defined in the proximal end 346 can be predetermined to correspond to a wheel camber of about 0 degrees to 15 degrees with 2.5 degree increments. Of course, it is contemplated that the wheel camber could be greater than 15 degrees or less than 0 degrees (a negative camber) if desired by adding more bores to the receiver 314 and/or altering the bore angle of an elongate bore. It is also contemplated that the incremental change could be more or less than 2.5 degrees.

Optionally, in one aspect, the at least one elongate bore 350 defined in the distal end 344 of the receiver 314 can comprise a plurality of elongate bores in the distal end of the receiver, and the at least one elongate bore 351 defined in the proximal end 346 of the receiver 314 can comprise a plurality of elongate bores. For example, a second bore 358 can be defined in the distal end 344 of the receiver 314 that is spaced from a first bore 350 in the distal end a predetermined distance. Similarly, a second bore can be defined in the proximal end 346 of the receiver 314 that is spaced from a first bore 351 in the proximal end a predetermined distance. In another aspect, the bore angle of the second bore of each end can be different than the bore angle of the first bore of each end in order to provide more wheel camber options. Optionally, a third, fourth, fifth or even more elongate bore can be defined in the receiver 314. For example, the third, fourth, fifth or even more elongate bore can be defined in the distal end 344, the proximal end 346 and/or the central 348 portion of the bore between the distal end and the proximal end of the receiver.

In another aspect, a plurality of elongate bores can be defined, with each bore having a different bore angle predetermined to correspond to a wheel camber of 0 degrees to 15 degrees with 2.5 degree increments. Of course, it is contemplated that the wheel camber could be greater than 15 degrees or less than 0 degrees (a negative camber) if desired by providing a receiver 314 with different bore angles. It is also contemplated that the incremental change could be more or less than 2.5 degrees if desired so that a wider range of wheel camber is possible by providing a receiver with corresponding bore angles.

In still another aspect, the position of at least one bore 350 in each end of the receiver 314 can be selected to change the center of gravity of the chair 1. For example, the second bore could be positioned behind the first bore relative to the front of the chair (as viewed when assembled), to change the center of gravity of the chair 1 to be more stable climbing hills. In another example, the second bore could be positioned below the first bore relative to the front of the chair (as viewed when assembled), to change the center of gravity of the chair.

The central portion 348 of the receiver 314 can be sized and configured to be selectively rotatably coupled to an end of the bracket 312. In one aspect, at least one passage 360 can be defined through the central portion of the receiver, the passage sized and configured so that at least a portion of the frame 4 of the wheelchair 1 can extend through the passage 360. In this aspect then, when assembled, a portion of the frame can extend through the passage 360 in the receiver 314 so that the receiver can rotate relative to the frame 4. In another aspect, when assembled, the passage 360 can have a passage longitudinal axis $L_{P2}$ that is substantially parallel to the longitudinal axis $L_F$ of the frame. In a further aspect, the receiver 314 can be rotatable about and between a first receiver position, in which the distal end 344 of the receiver faces away from the bracket 312 and the longitudinal axis $L_{B0}$ of the bore 350 of the distal end is substantially parallel with the longitudinal axis $L_{BR}$ of the bracket, and a second receiver position, in which the proximal end 346 of the receiver 314 faces away from the bracket 312 and the longitudinal axis $L_{B1}$ of the bore 351 of the proximal end is substantially parallel with the longitudinal axis $L_{BR}$ of the bracket.

In another aspect, at least one locking hole 362 can be defined in a portion of the receiver 314. In this aspect, the locking hole can be sized and configured to engage a portion of the locking pin 316 to releasably secure the receiver to the bracket 312 in the desired position. For example, a first locking hole 362 can be defined in the receiver to releasably secure the receiver 314 in the first receiver position and a second locking hole can be defined in the receiver to releasably secure the receiver 314 in the second receiver position.

The at least one locking pin 316 can be a conventional locking pin. In one aspect, the locking pin can have a pin length sized and configured to extend through the at least one locking hole 332 defined in at least one of the upper bracket element 324 and the lower bracket element 326 and into the at least one locking hole 362 defined in a portion of the receiver 314. In another aspect, the at least one locking pin can be a removable locking pin or a permanently attached locking pin 316.

To assemble the wheelchair 1 of the present application, the central portion 348 of the receiver 314 can be positioned between the upper bracket element 324 and the lower bracket element 326 of the bracket 312 so that the at least one passage 328 defined through at least one on the upper bracket element and the lower bracket element is coaxially aligned with the at least one passage 360 defined through the central portion of the receiver. The distal end 330 of the frame 4 can extend through the passage 328 defined in the bracket elements and through the passage defined in the receiver 314. The frame can then be securedly attached to the bracket 312 with screws, nuts, bolts, pins and the like. In one aspect, the wheelchair 1 can be a new wheelchair assembled with the bracket attached. In another aspect, however, a conventional wheelchair 1 can be retrofit with the bracket 312 to convert the conventional wheelchair to a wheelchair with an adjustable camber. For example, a conventional wheelchair 1 has a frame element that can be detached and replaced with the bracket 312. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

The receiver 314 can then be rotated about and between the first receiver position and the second receiver position as desired so that an elongate bore having the desired bore angle is facing away from the bracket 312. For example, the receiver can be rotated to the first receiver position, the second receiver position and any position between the first receiver position and the second receiver position so that the desired elongate bore 350 is facing away from the bracket. The locking pin 316 can then engage a portion of the receiver to secure the receiver in the desired position. The axle 5 of the wheel 3 can be positioned in the selected bore 350 of the receiver 314 and securedly, rotatably coupled to the receiver.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could remove the axle 5 of the wheel from the current bore 350, 351 of the receiver 314 and then insert a portion of the axle into a different bore having a different bore angle. If the different bore is on the opposed end of the receiver, the rider or user can disengage each locking pin 316 from the receiver 314. The receiver 314 can then be rotated between the first and second receiver positions until the desired bore is facing away from the bracket 312.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

Figure 26:
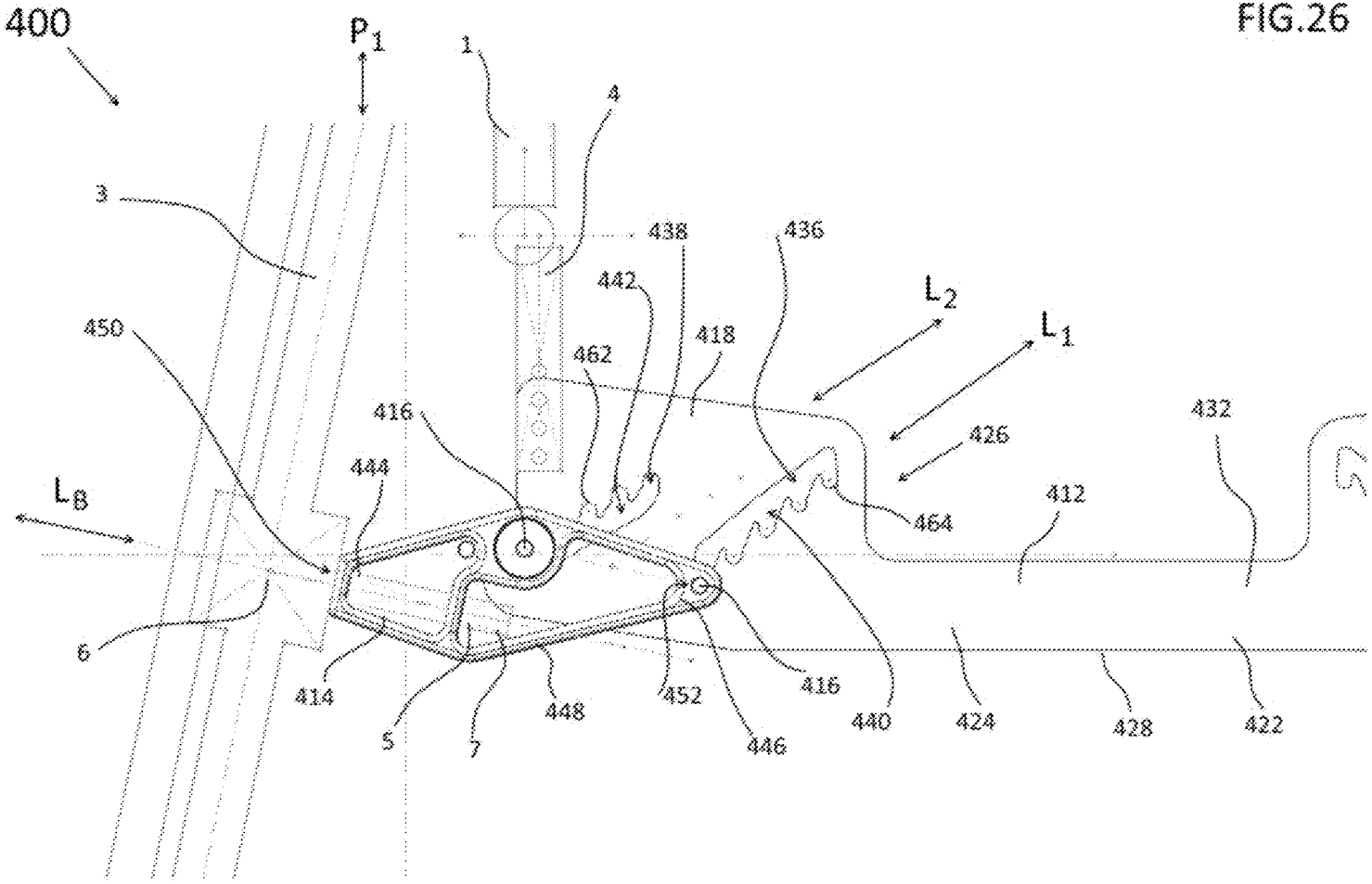
FIG. 26 is a rear elevational view of a wheelchair device and system having an adjustable camber of the present application, according to one aspect, in which the wheels are positioned in a cambered position and in which portions of the device are not shown for clarity.
Figure 27:
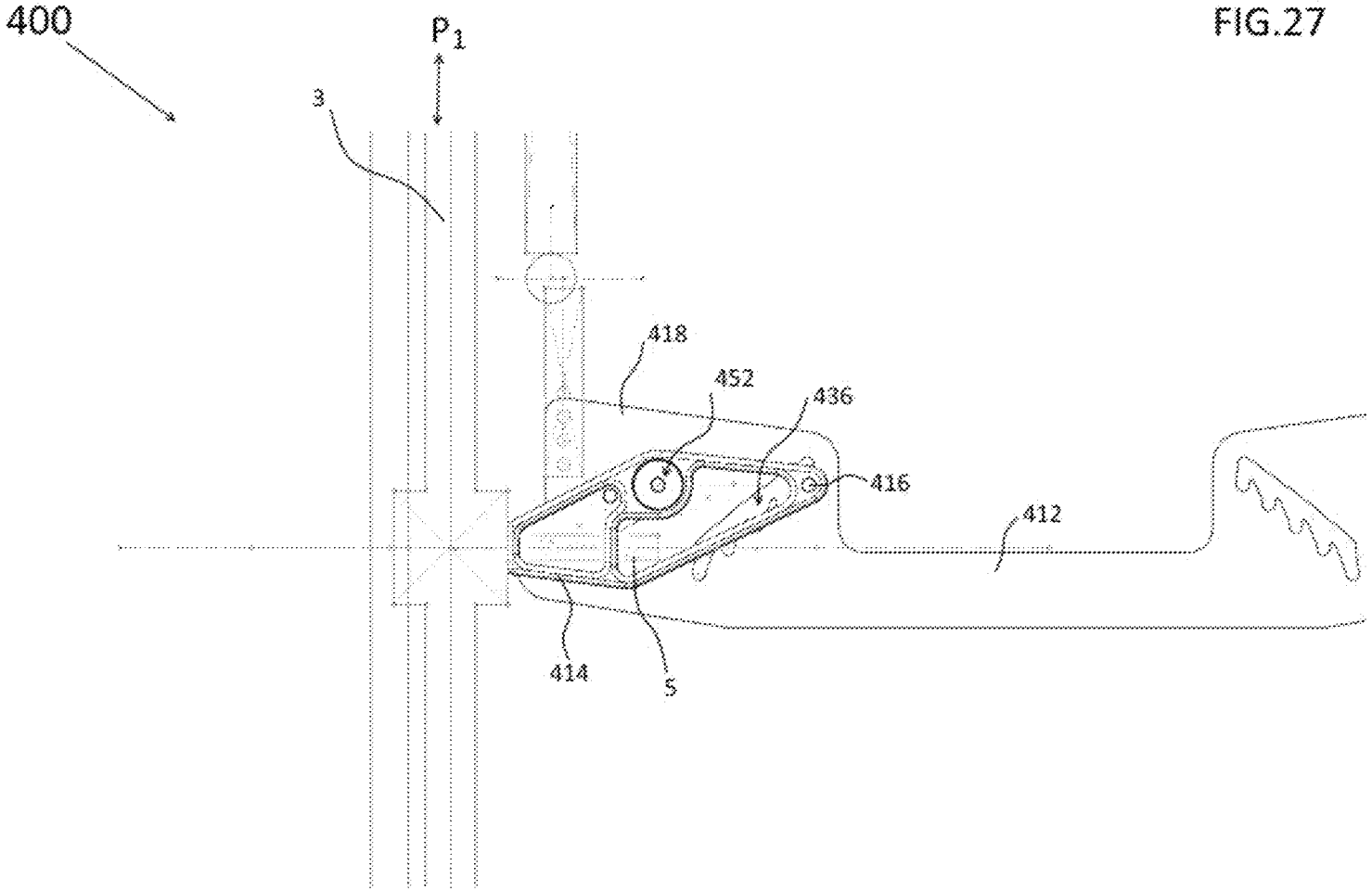
FIG. 27 is a rear elevational view of the wheelchair device and system of FIG. 26, in which the wheels are positioned in an uncambered position.
Figure 28:
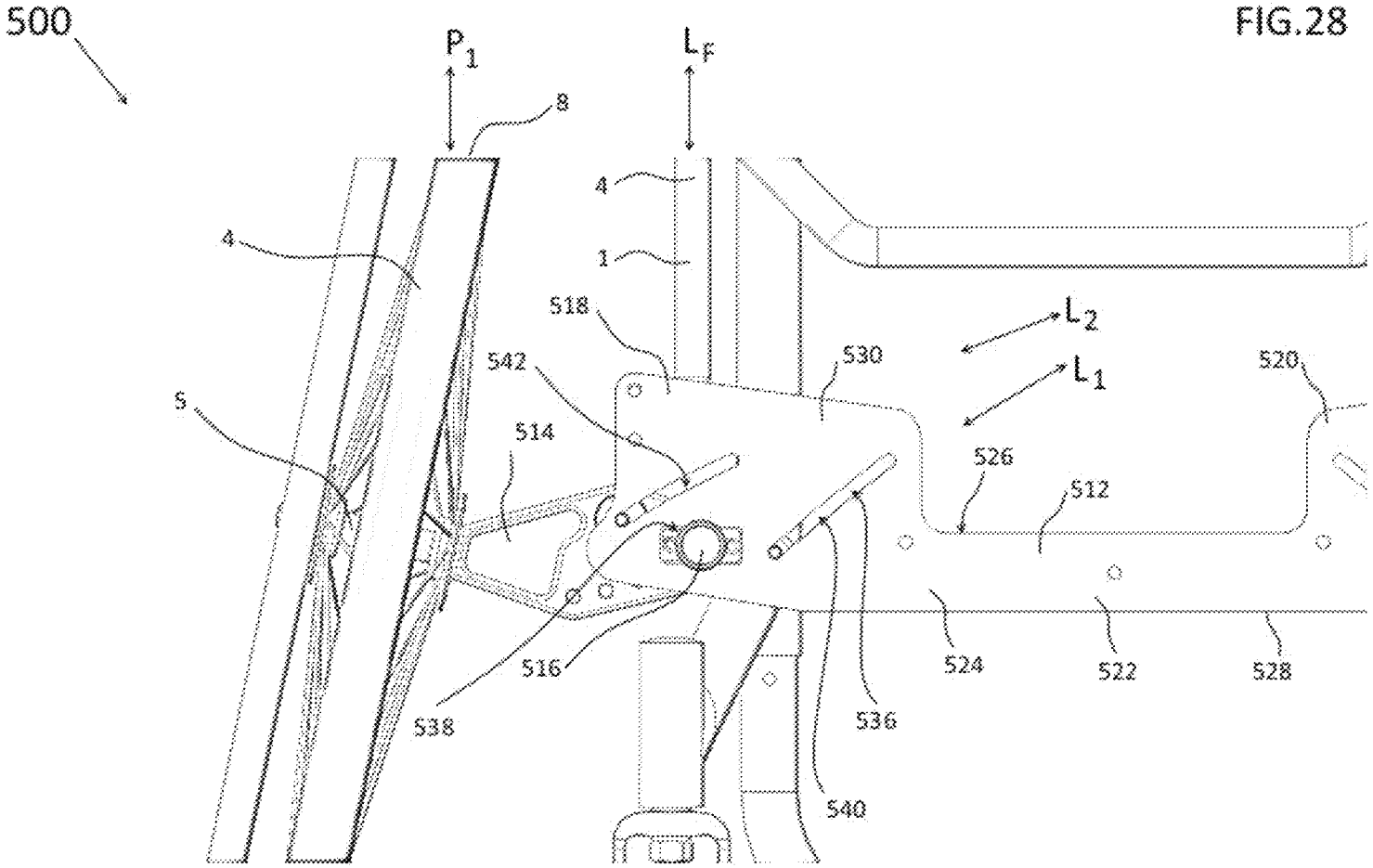
FIG. 28 is a rear elevational view of a wheelchair device and system having an adjustable camber of the present application, according to one aspect, in which the wheels are positioned in a cambered position.

In one embodiment and as illustrated in FIGS. 26 and 27, the system 400 comprises a bracket 412 coupled to the wheelchair 1, a plurality of receivers 414 coupled to the bracket and at least one pin 416 for each receiver. In use, an end of the receiver can slidingly engage a portion of the bracket 412 and another end of the receiver 414 can be configured to rotatably couple the axle 5 of the rear wheel 3 to the receiver. The at least one pin can releasably secure the receiver 414 to the bracket 412 in the desired position.

The bracket 412 can be a rigid element having a first end 418, an opposed second end 420 and a central portion 422 extending therebetween. In one aspect, the bracket can be substantially planar having a first face 424, an opposed second face 426 and a sidewall 428 extending therebetween. In another aspect, the bracket can comprise a first plate (not shown) and a second plate 432 spaced from the first plate a predetermined distance that cooperate to form the bracket 412. For example, the first plate can be positioned on a first side of the wheelchair frame 4 and the second plate 432 can be positioned on a second side of the wheelchair frame such that the plates are spaced the predetermined distance. Spacers 434 can be used to maintain the plates the predetermined distance apart. In another aspect, the bracket 412 can be a plate formed from a rigid material such as steel, stainless steel, titanium, aluminum, carbon fiber and the like.

At least one slot 436 can be defined in each of the first end 418 and the second end 420 of the bracket 412. In one aspect, the slot can be sized and configured to receive a portion of the pin 416 therein. In another aspect, the slot 436 can be a substantially linear slot having a longitudinal axis $L_1$ at an acute angle relative to the longitudinal axis $L_F$ of the frame 4. For example, the acute angle between the longitudinal axis $L_1$ of the first slot and the longitudinal axis $L_F$ of the frame can be less than 30 degrees, about 30 degrees, about 45 degrees, about 60 degrees or greater than 60 degrees. Optionally, at least a portion of the slot 436 can be arcuate in shape. In another aspect, the position and shape of the slot can be selected so that in use, described more fully below, a top portion 8 of the wheel 4 can remain in a vertical plane $P_1$ of travel regardless of the camber of the wheel and/or so the frame 4 of the chair stays in the same relative position to the ground regardless of what camber option is chosen.

In another aspect, the at least one slot 436 defined in each of the first end 4418 and the second end 420 of the bracket 12 can comprise a plurality of slots. For example, the at least one slot can comprise a first slot 440 and a second slot 442 defined in each end. In this aspect, the first slot can have the longitudinal axis $L_1$ and the second slot can have a longitudinal axis $L_2$. In another aspect, the longitudinal axis $L_2$ of the second slot 442 can be at an acute angle relative to the longitudinal axis $L_1$ of the first slot. Alternatively, the first slot 440 can be substantially parallel to the second slot. In yet another aspect, the at least one slot 436 defined in the first end 418 of the bracket can be a substantial mirror image of the at least one slot defined in the second end 420 relative to a vertical plane positioned through the back of the wheelchair 1. Thus, the longitudinal axis of the first slot 440 and/or the second slot 442 of the first end 418 can be at substantially the same acute angle relative to the longitudinal axis $L_F$ of the frame 4 as the respective first slot 440 and/or the second slot 442 of the second end 420.

In a further aspect, a plurality of notches 438 can be defined in at least one wall of each slot 436. For example, the notches can be defined in an upper wall 462 and a lower wall 464 of the slot. In another example, if the slot comprises a plurality of slots, the notches can be defined in an upper wall of the first slot and a lower wall of the second slot. In this aspect, the notches can be sized and configured to receive a portion of the pin 416 therein. In yet another aspect, the notches can be positioned so that the pin and the receiver 414 are coupled to the bracket 412 in a predetermined position corresponding to each notch 438.

In one aspect, the receiver 414 comprises a distal end 444, an opposed proximal end 446 and a central portion 448 extending therebetween. In use, the receiver can be a rigid element configured to couple the axle 5 of the rear wheel 3 to the bracket 412. In another aspect, at least one elongate bore 450 having a bore axis $L_B$ can be defined in the distal end of the receiver, the bore configured to rotatingly engage the axle. For example, the bore can extend through the distal end 444 and at least a portion of the central portion 448 of the receiver so that an end of the axle 5 can be securedly, rotatably attached to the receiver. That is, a first end 6 of the axle can be secured to the rear wheel and a second end 7 of the axle 5 can be positioned in the bore.

Optionally, in one aspect, the at least one elongate bore 450 can be a plurality of elongate bores. For example, a second bore can be defined in the receiver 414 that is spaced from the first bore a predetermined distance. In another aspect, the position of the second bore can be selected to change the center of gravity of the chair. For example, the second bore could be positioned behind the first bore relative to the front of the chair (as viewed when assembled), to change the center of gravity of the chair 1 to be more stable climbing hills. In another example, the second bore could be positioned below the first bore relative to the front of the chair (as viewed when assembled), to change the center of gravity of the chair.

The proximal end 446 and/or the central portion 448 of the receiver 414 can be sized and configured to be selectively, releasably coupled to an end of the bracket 412. In one aspect, at least one pin aperture 452 having an aperture axis $L_A$ can extend through the proximal end of the receiver. In another aspect, the aperture axis $L_A$ can be substantially normal to the bore axis $L_B$. In still a further aspect, there can be at least one pin aperture for each slot 436 defined in an end of the bracket 412. Thus, if there are two slots in an end of the bracket, there can be at least two pin apertures 452 defined in the receiver. In one aspect, the receiver 414 can have a width sized so that each pin aperture can be positioned adjacent to a slot 436 in an end of the bracket. For example, if the first slot 440 is spaced two inches from the second slot 442, the receiver can have a width that is greater than two inches. In another aspect, the at least one pin aperture 452 can have a diameter greater than the diameter of the pin 416. In this aspect, a cushioning or dampening material such as, for example and without limitation, urethane, can be positioned in the pin aperture with the pin.

The at least one pin 416 can be a conventional pin. In one aspect, the pin can have a pin length sized and configured to extend through the at least one slot 436 of the bracket 412 and the at least one pin aperture 452 of the receiver. For example, the pin length can be sized to extend through the first slot 440 in the first plate 430 of the bracket, through the pin aperture defined in the receiver, and through the first slot of the second plate 432 of the bracket. In another aspect, the at least one pin can be a non-removable pin. For example, the pin can be sized and configured to releasably secure the receiver 414 to the bracket without being removed from the slot.

In one aspect, the system 400 of the present embodiment can further comprise a biasing element 460 sized and configured such that, when assembled, the biasing element can urge at least a portion of each pin 416 into a notch 438 of each slot 436.

To assemble the wheelchair 1 of the present application, the bracket 412 can be securedly attached to the wheelchair frame 4 with screws, bolts, pins and the like. In one aspect, the wheelchair can be a new wheelchair 1 assembled with the bracket attached. In another aspect, however, a conventional wheelchair can be retrofit with the bracket 412 to convert the conventional wheelchair 1 to a wheelchair with an adjustable camber. For example, a conventional wheelchair 1 has a frame element that can be detached and replaced with the bracket 412. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

The axle 5 of the wheel 3 can be positioned in the bore 450 of the distal end 444 of the receiver 414 and securedly, rotatably coupled to the receiver. The proximal end 446 of the receiver can be positioned so that the at least one pin aperture 452 of the receiver 144 is adjacent to and/or co-axially aligned with a notch 438 of a slot 436 defined in an end of the bracket 412. In one aspect, if there are a plurality of slots, the proximal end of the receiver can be positioned so that a pin aperture is adjacent a notch of each slot 436. For example, if there are two slots, the proximal end 446 can be positioned so that a pin aperture is aligned with a notch 438 in both of the slots. With the at least one pin aperture 452 and the notch of the at least one slot 436 co-axially aligned, a pin 416 can be inserted through each pin aperture and the aligned notch to securedly, fixedly couple the receiver 414 to the bracket 412.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could overcome the force exerted on the receiver 414 by the biasing element 460 to release each pin 416 from the notches 438 on one end of the bracket 412. The proximal end 446 of the receiver can then be moved so that the at least one pin aperture 452 of the receiver 414 is adjacent to and/or co-axially aligned with a different notch 438. In another aspect, the notch pattern of the at least one slot 436 can be predetermined to correspond to a wheel camber of 0 degrees to 15 degrees with 2.5 degree increments. Of course, it is contemplated that the wheel camber could be greater than 15 degrees or less than 0 degrees (a negative camber) if desired by adding more notches 438 to the slots. It is also contemplated that the incremental change could be more or less than 2.5 degrees if desired so that a wider range of wheel camber is possible by adding more notches 438 to the slots 436 and/or changing the staggering of the notches.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

In one embodiment and as illustrated in FIGS. 28-34, the system 500 comprises a bracket 512 coupled to the wheelchair 1, a plurality of receivers 514 coupled to the bracket and at least one locking pin 516 for each receiver. In use, an end of the receiver can slidingly engage a portion of the bracket 512 and another end of the receiver 514 can be configured to rotatably couple the axle 5 of the rear wheel 3 to the receiver. The at least one locking pin can releasably secure the receiver 514 to the bracket 512 in the desired position.

Figure 29:
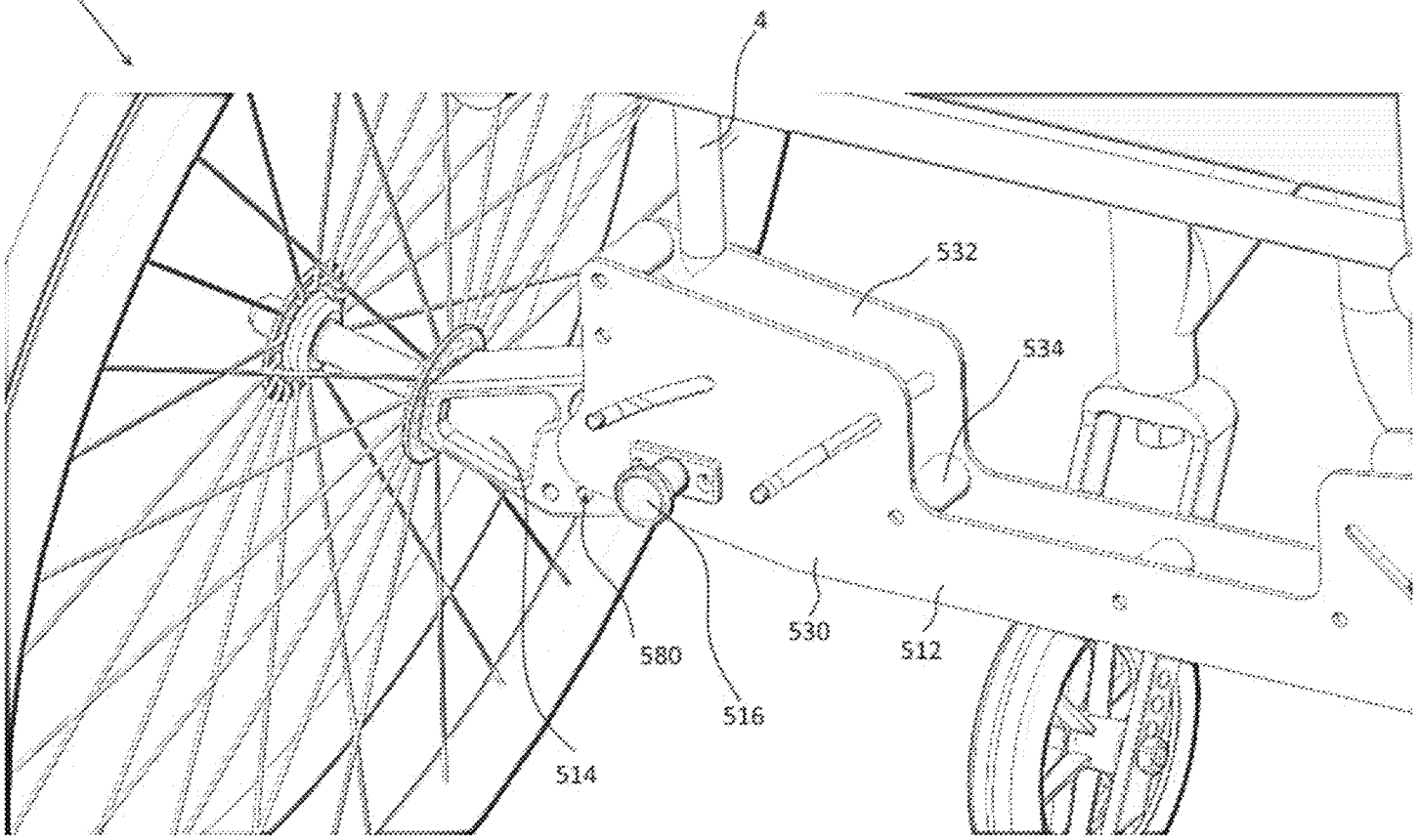
FIG. 29 is a perspective view of the wheelchair device and system of FIG. 28.
Figure 30:
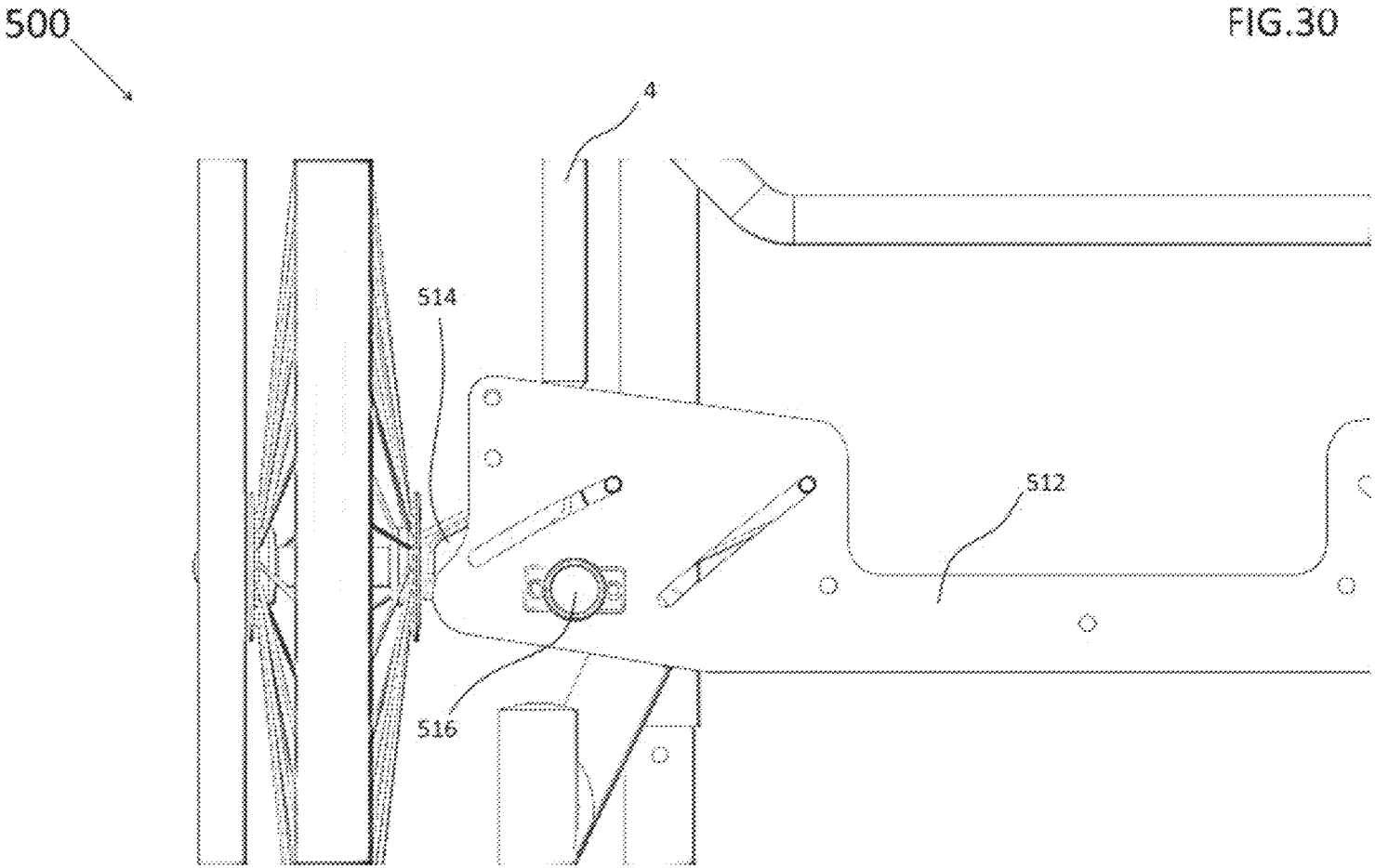
FIG. 30 is a rear elevational view of the wheelchair device and system of FIG. 28 in an uncambered position.
Figure 31:
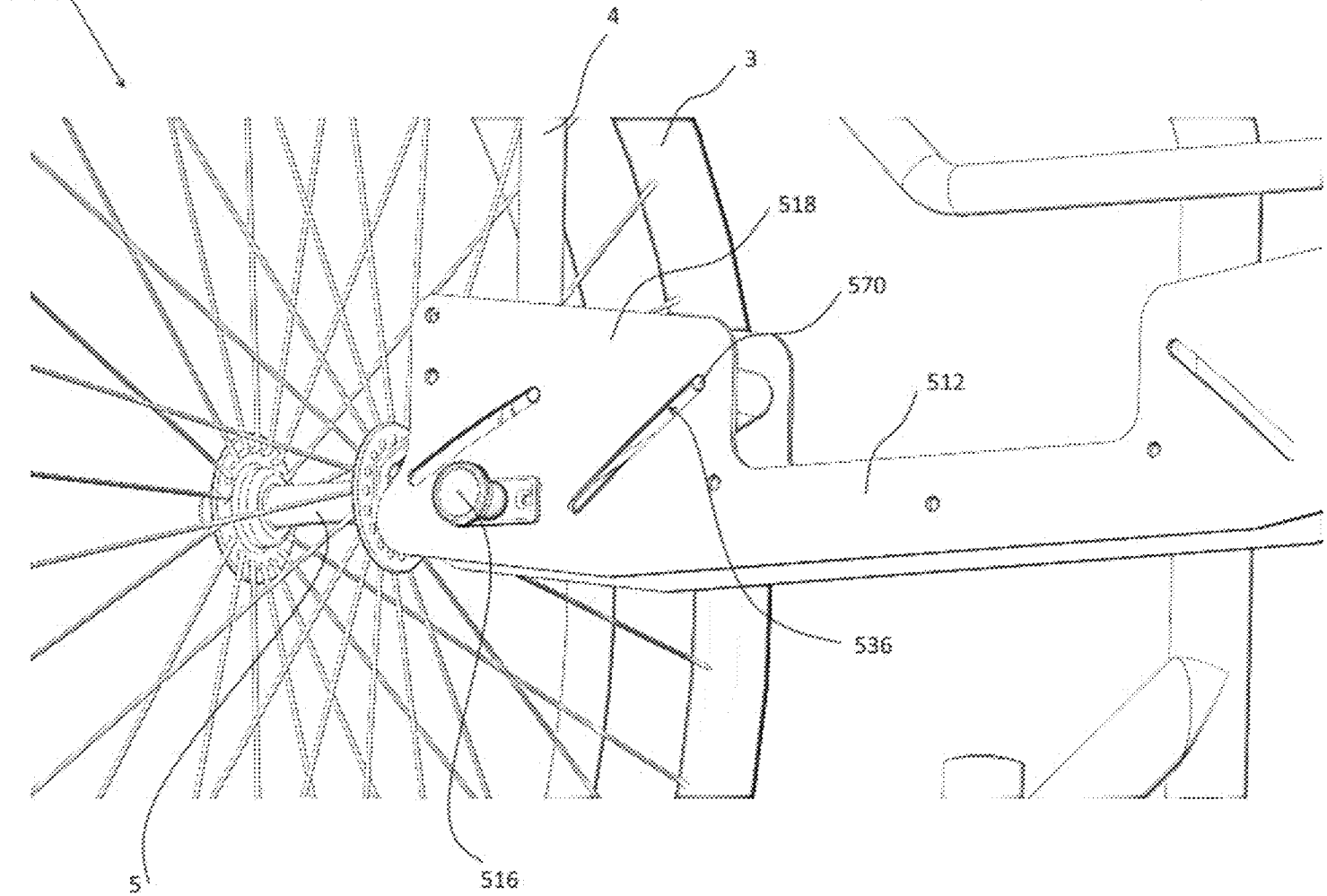
FIG. 31 is a perspective view of the wheelchair device and system of FIG. 28 in an uncambered position.

The bracket 512 can be a rigid element having a first end 518, an opposed second end 520 and a central portion 522 extending therebetween. In one aspect, the bracket can be substantially planar having a first face 524, an opposed second face 526 and a sidewall 528 extending therebetween. In another aspect, the bracket can comprise a first plate 530 and a second plate 532 spaced from the first plate a predetermined distance that cooperate to form the bracket 512. As seen in FIG. 29, for example, the first plate can be positioned on a first side of the wheelchair frame 4 and the second plate can be positioned on a second side of the wheelchair frame such that the plate are spaced the predetermined distance. Spacers 534 can be used to maintain the plates 530, 532 the predetermined distance apart. The bracket 512 can be a plate formed from a rigid material such as for example, steel, stainless steel, titanium, aluminum, carbon fiber and the like.

At least one slot 536 can be defined in each of the first end 518 and the second end 520 of the bracket 12. In one aspect, the slot can be sized and configured to receive a portion of the receiver 514 therein. In another aspect, the slot 536 can be a substantially linear slot having a longitudinal axis $L_1$ at an acute angle relative to the longitudinal axis $L_F$ of the frame 4. For example, the acute angle between the longitudinal axis $L_1$ of the slot and the longitudinal axis $L_F$ of the frame can be less than 30 degrees, about 30 degrees, about 45 degrees, about 60 degrees or greater than 60 degrees. Optionally, at least a portion of the slot 536 can be arcuate in shape. In another aspect, the position and shape of the slot can be selected so that in use, described more fully below, a top portion 8 of the wheel 4 can remain in a vertical plane $P_1$ of travel regardless of the camber of the wheel and/or so the frame 4 of the chair stays in the same relative position to the ground regardless of what camber option is chosen.

In another aspect, the at least one slot 536 defined in each of the first end 518 and the second end 520 of the bracket 512 can comprise a plurality of slots. For example, the at least one slot can comprise a first slot 540 and a second slot 542 defined in each end. In this aspect, the first slot can have the longitudinal axis $L_1$ and the second slot can have a longitudinal axis $L_2$. In another aspect, the longitudinal axis $L_2$ of the second slot 542 can be at an acute angle relative to the longitudinal axis $L_1$ of the first slot. Alternatively, the first slot 540 can be substantially parallel to the second slot. In yet another aspect, the at least one slot 536 defined in the first end 518 of the bracket can be a substantial mirror image of the at least one slot defined in the second end 520 relative to a vertical plane positioned through the back of the wheelchair 1. Thus, the longitudinal axis of the first slot 540 and/or the second slot 542 of the first end 518 can be at substantially the same acute angle relative to the longitudinal axis $L_F$ of the frame 4 as the respective first slot and/or the second slot 42 of the second end 20.

In a further aspect, at least one locking pin aperture 538 can be defined in each of the first end 518 and the second end 520 of the bracket 512. In this aspect, the locking pin aperture can be sized and configured to receive a portion of the locking pin 516 therein. In yet another aspect, the locking pin aperture 538 can be positioned so that the locking pin and the receiver 514 are coupled to the bracket in a predetermined position. As can be appreciated, if the bracket comprises the first plate 530 and the second plate 532 spaced from the first plate a predetermined distance, the locking pin aperture can be defined in both plates.

Figure 32:
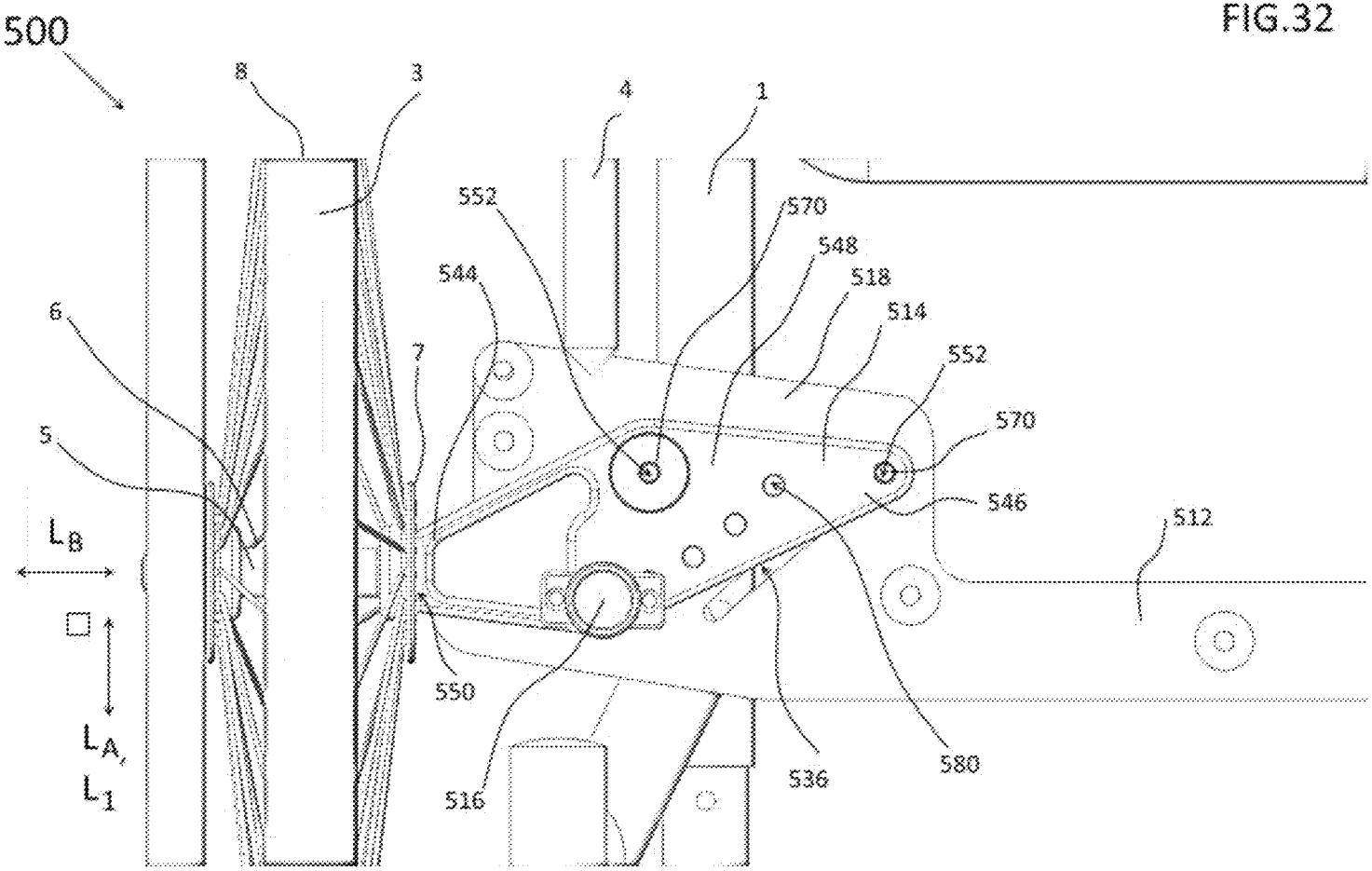
FIG. 32 is a cutaway rear elevational view of the wheelchair device and system of FIG. 28 in an uncambered position, in which portions of the device are not shown for clarity.
Figure 33:
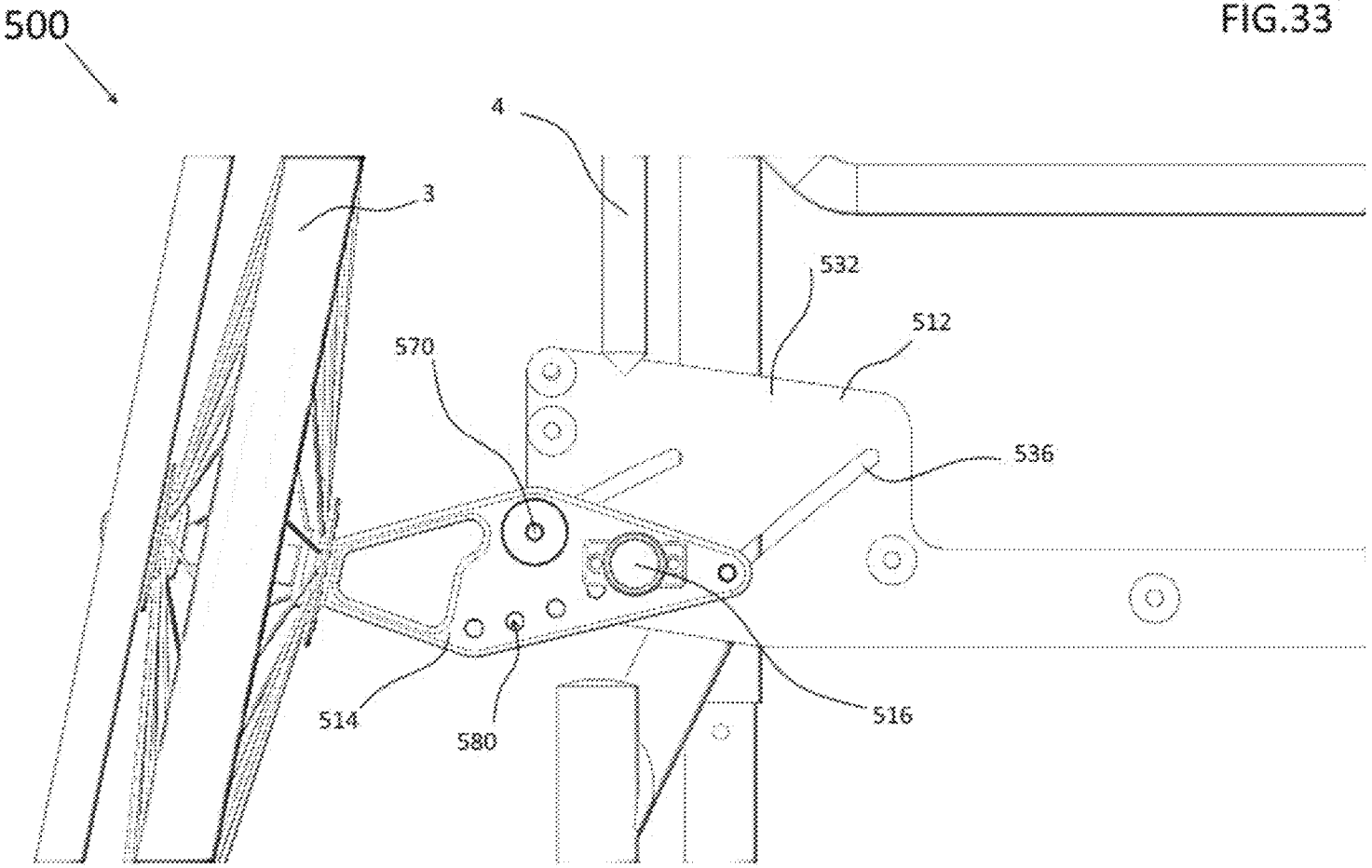
FIG. 33 is a cutaway rear elevational view of the wheelchair device and system of FIG. 28 in a cambered position, in which portions of the device are not shown for clarity.
Figure 34:
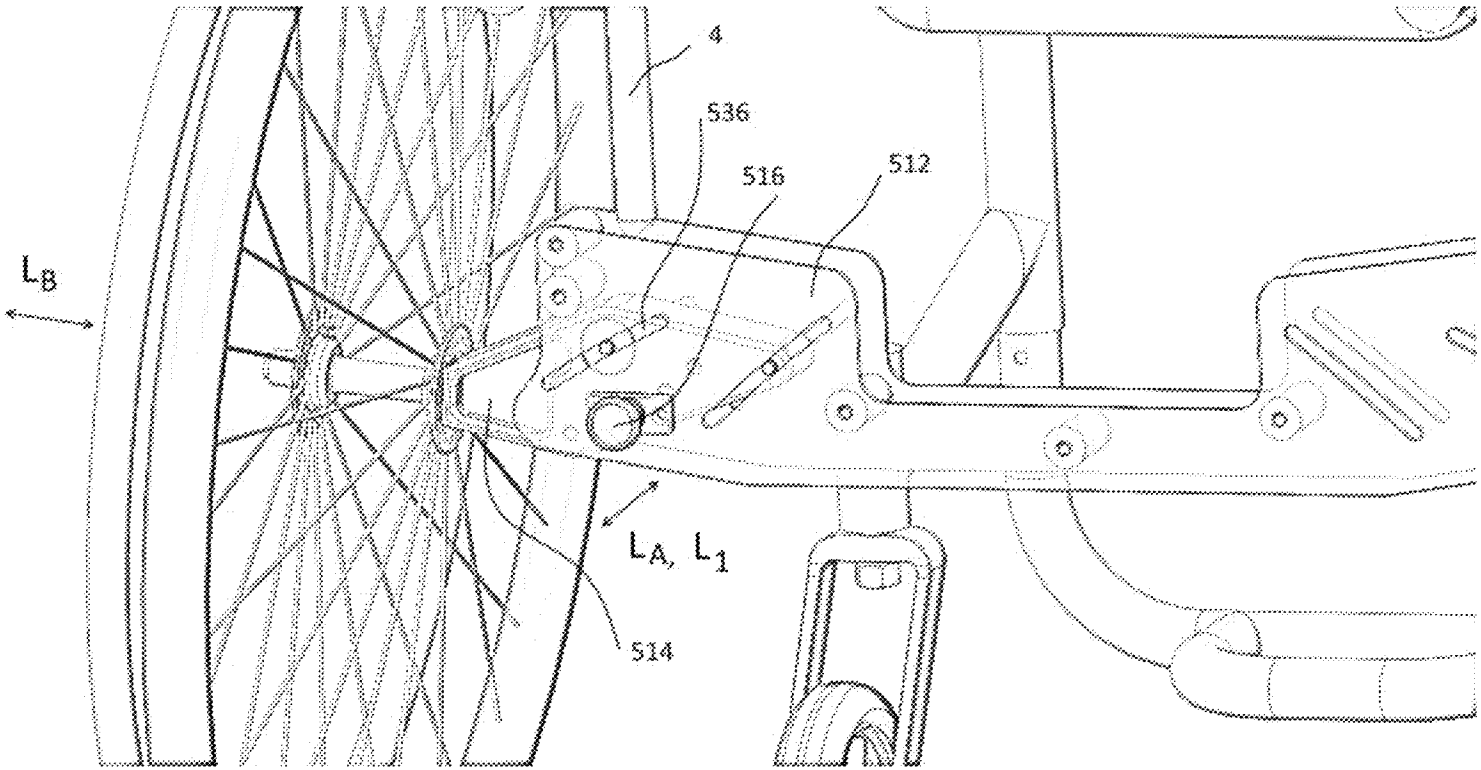
FIG. 34 is a perspective view of the wheelchair device and system of FIG. 28, in which portions of the device are shown transparently for clarity.
Figure 35:
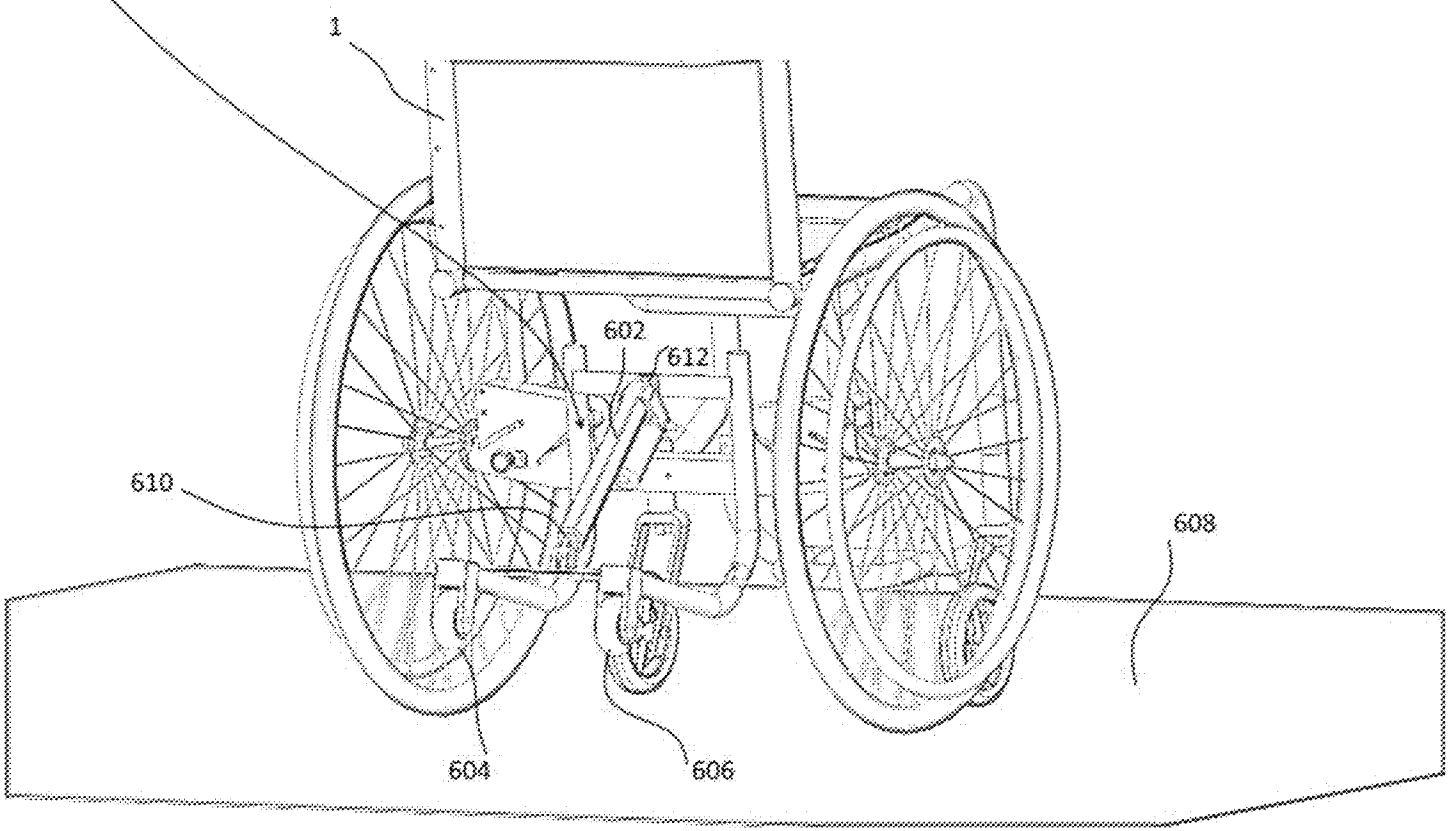
FIGS. 35 and 36 are perspective views of a lifting device of the present application, according to one aspect, in which a contact point of the lifting device is in a raised position.
Figure 36:
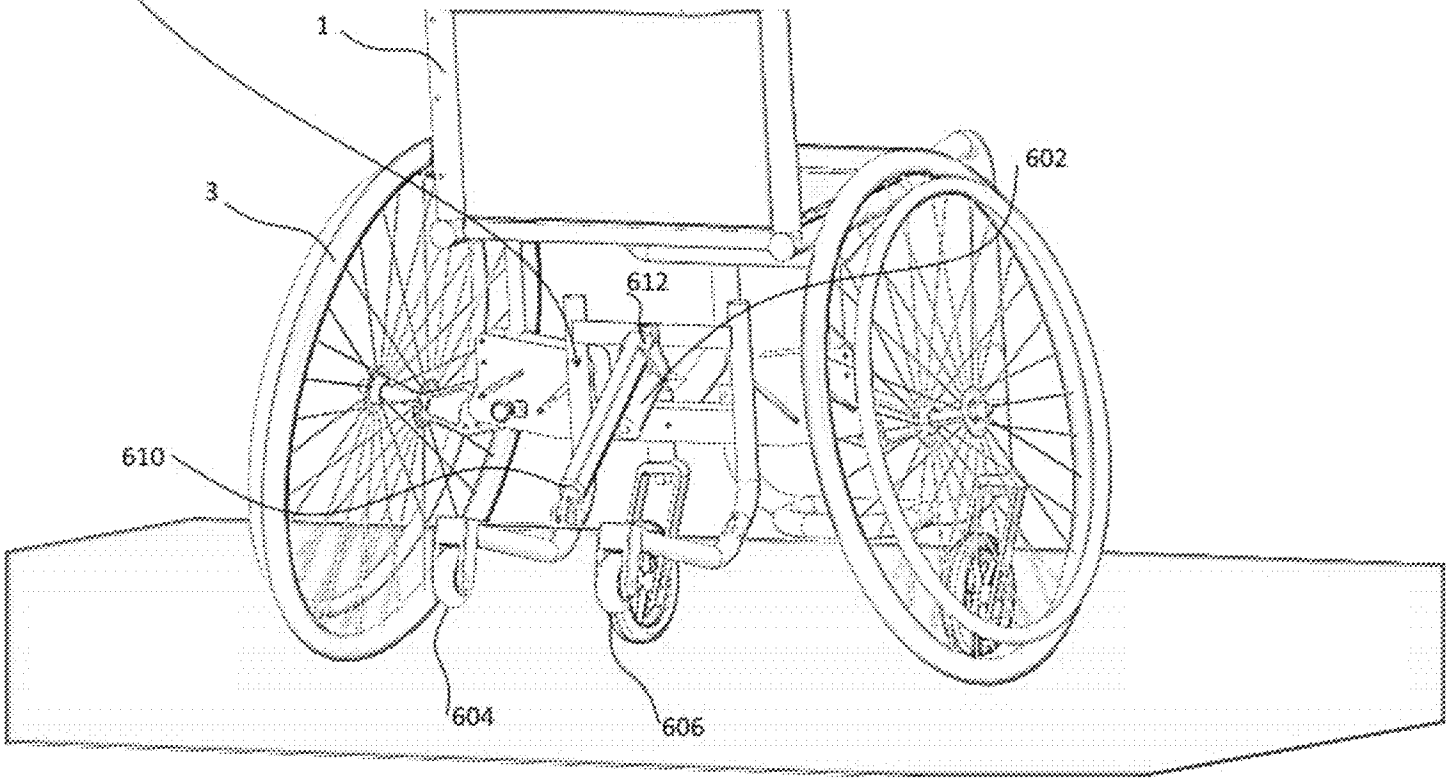
Figure 37:
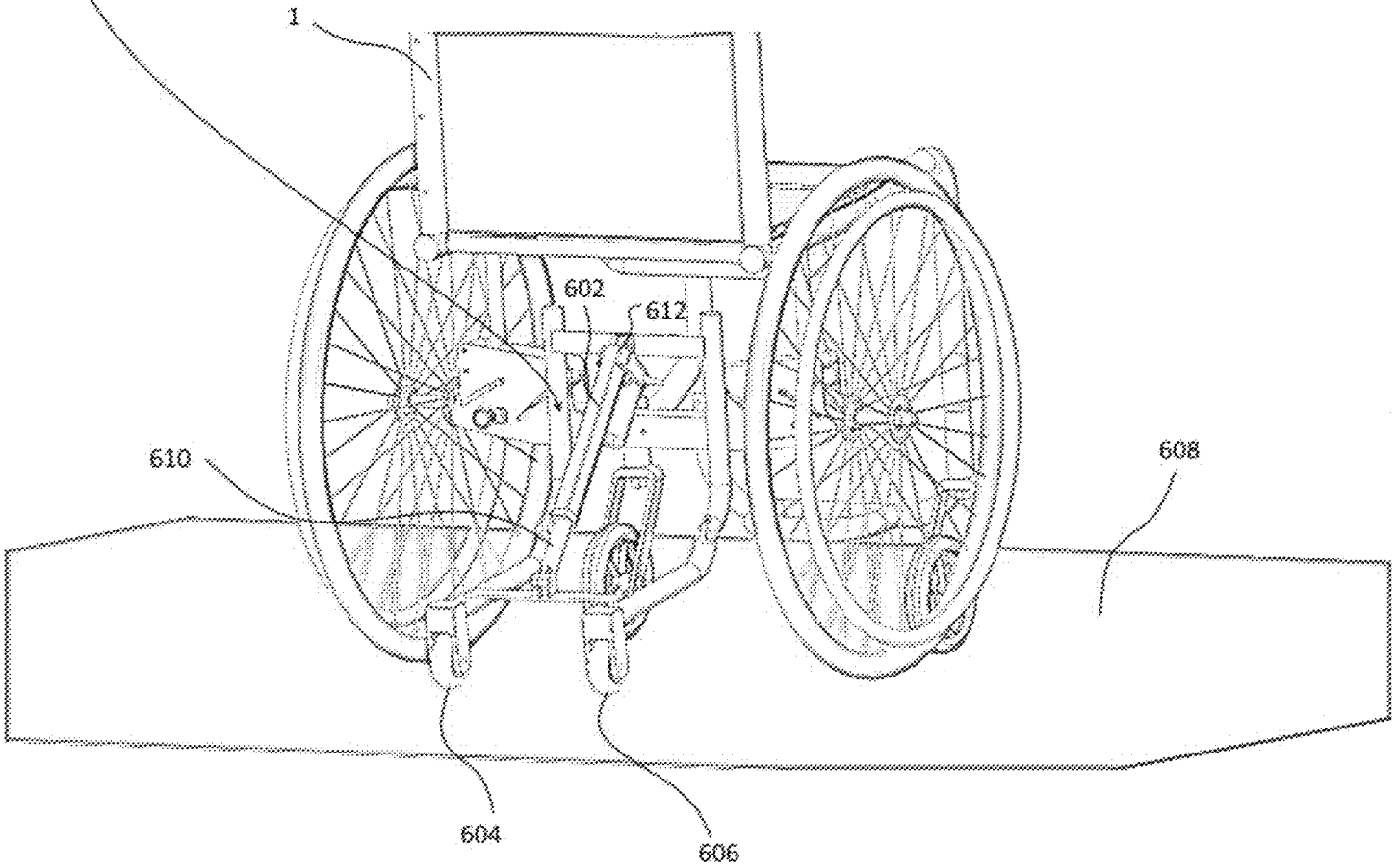
FIGS. 37 and 38 are perspective views of the lifting device of FIG. 35, in which the contact point of the lifting device is in a contacting position.
Figure 38:
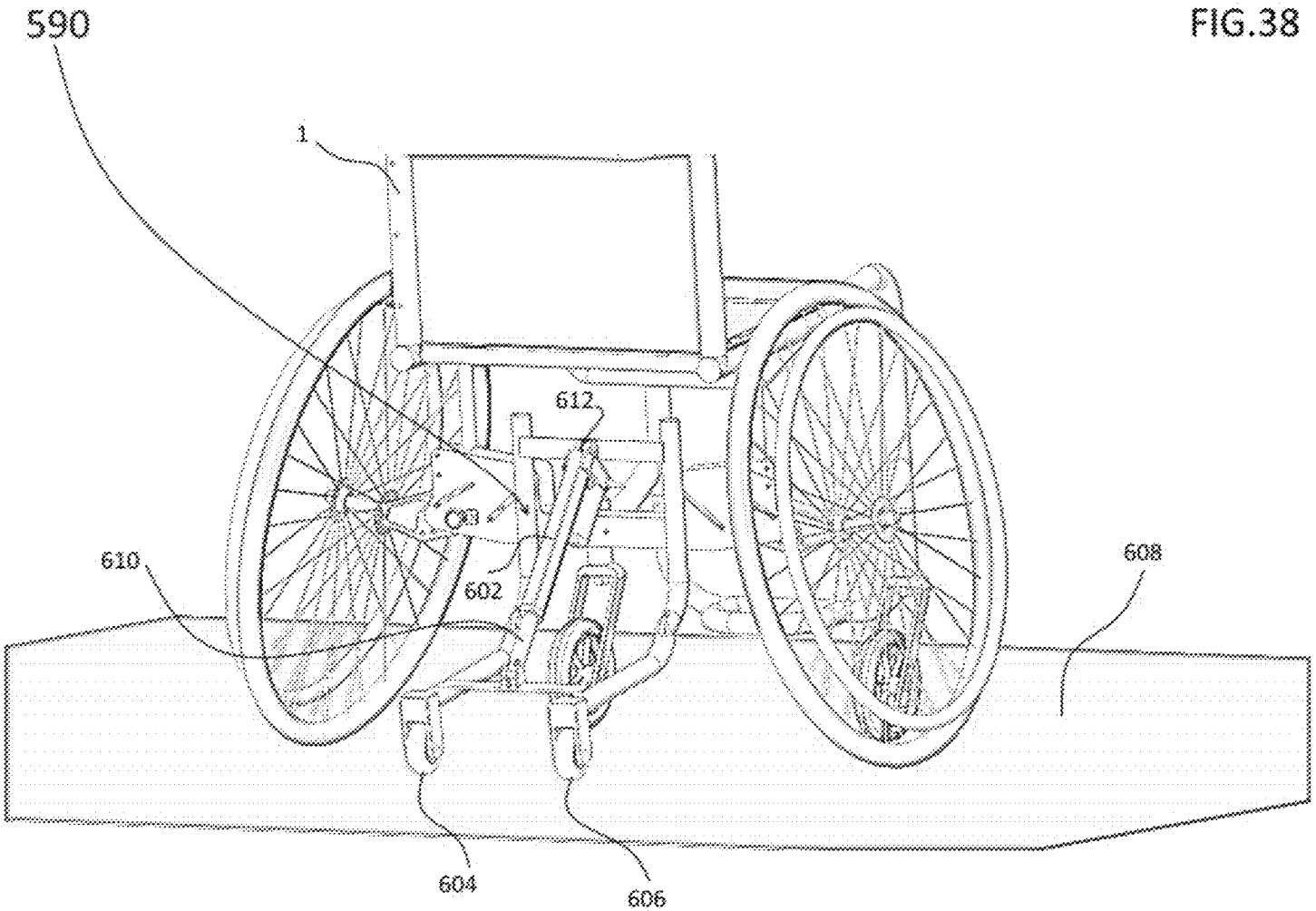
Figure 39:
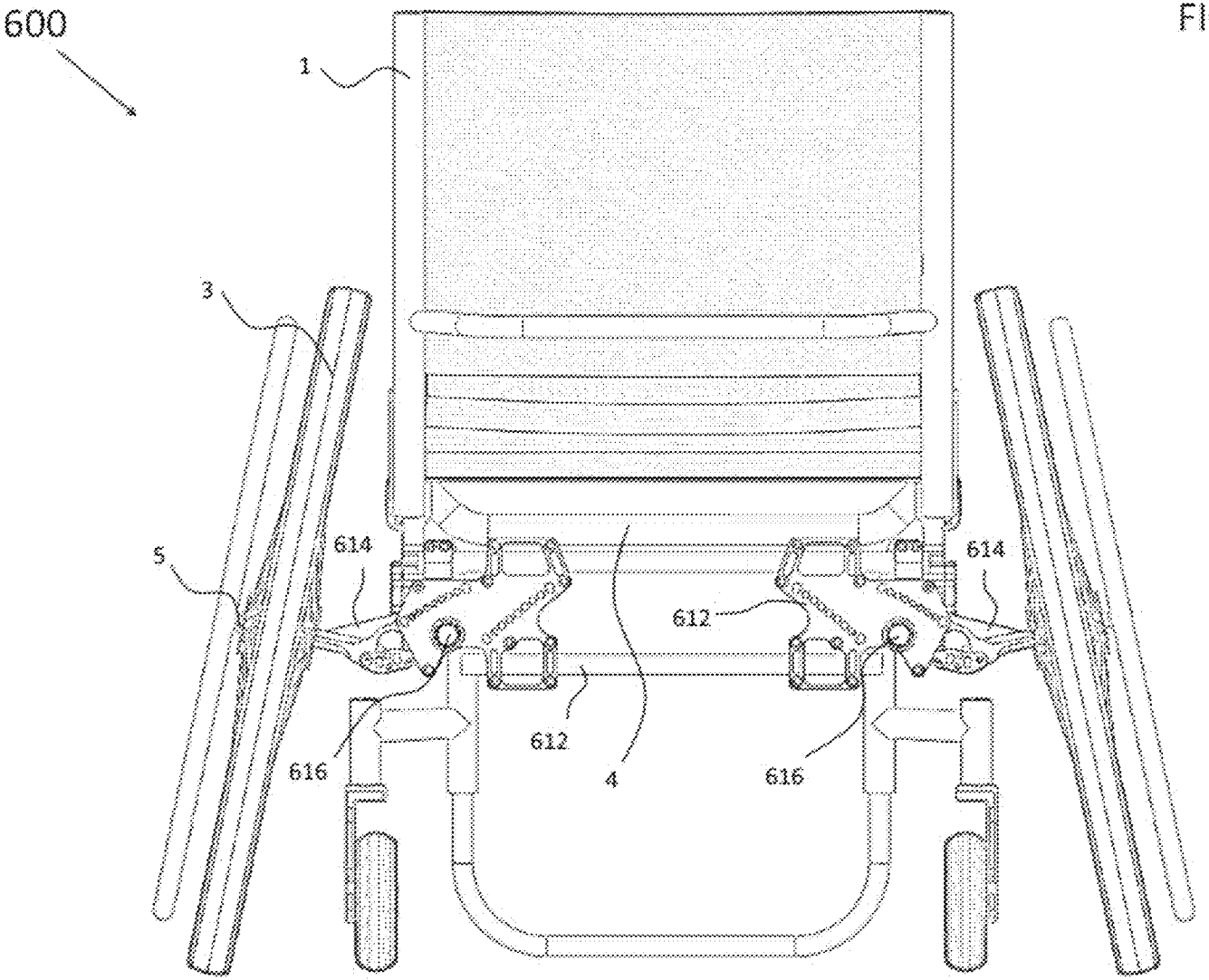
FIG. 39 is a rear elevational view of a wheelchair device and system having an adjustable camber of the present application, according to one aspect, in which the wheels are positioned in a cambered position.
Figure 40:
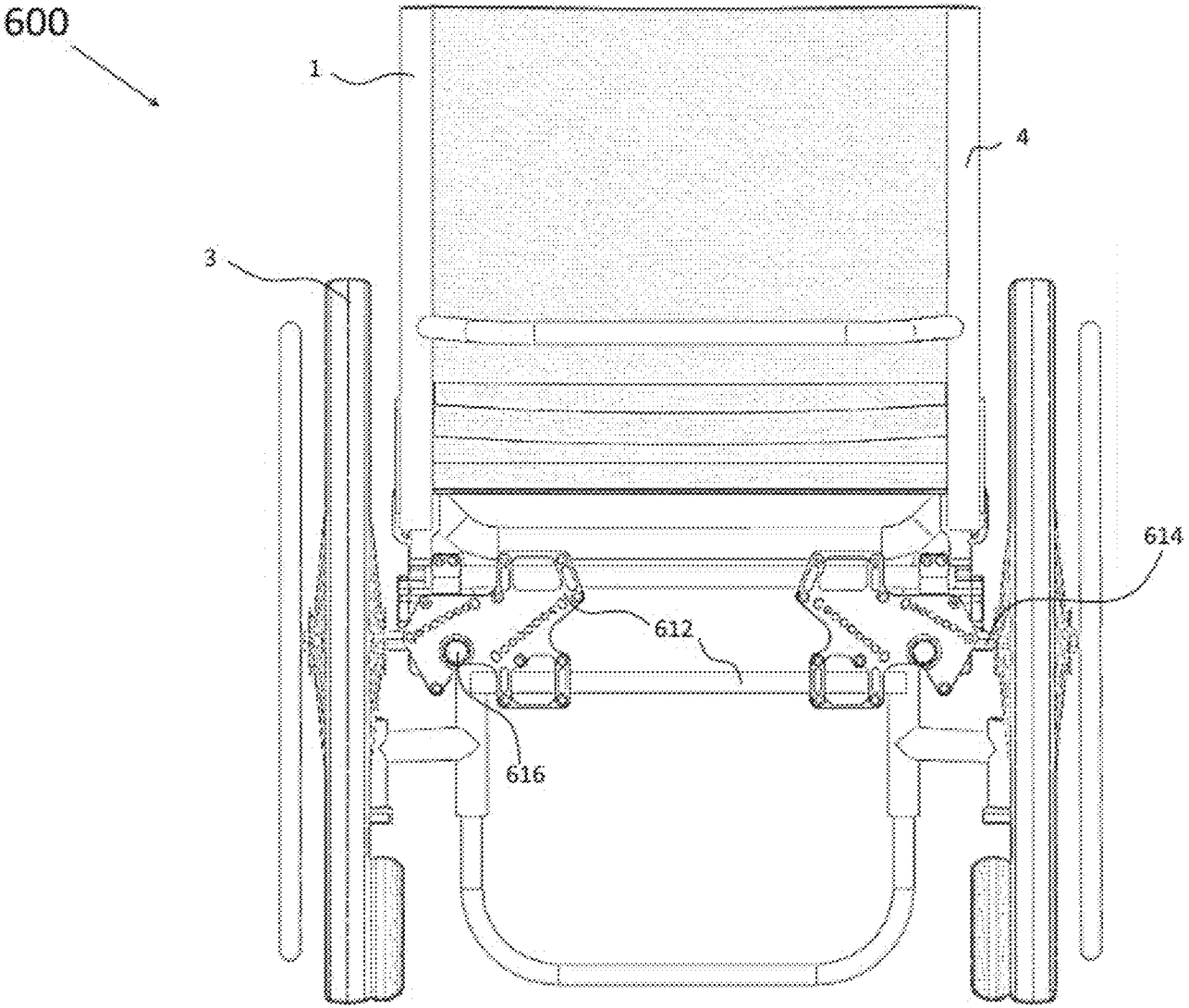
FIG. 40 is a rear elevational view of the wheelchair device and system of FIG. 39 in an uncambered position.
Figure 41:
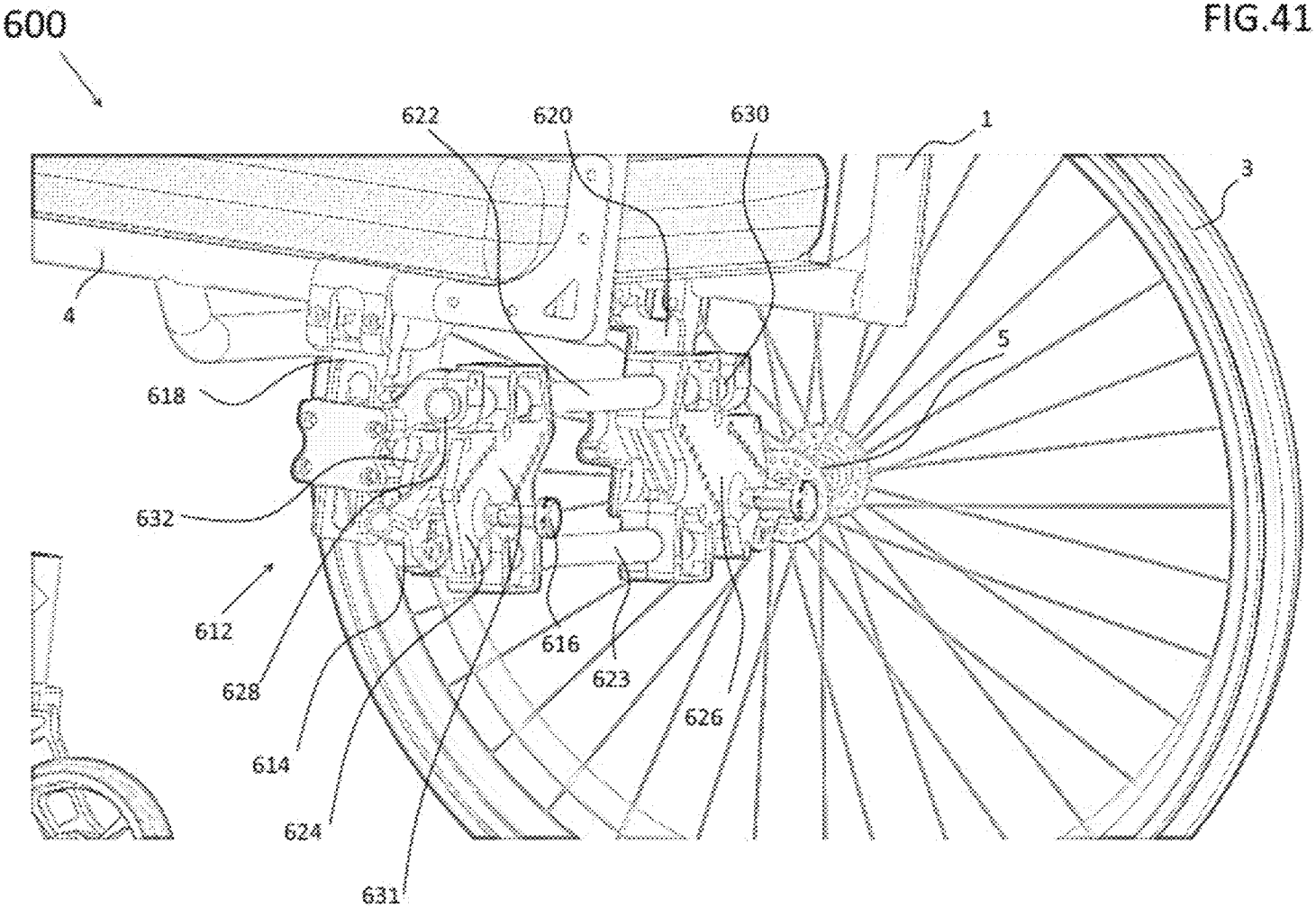
FIG. 41 is a rear elevational view of the wheelchair device and system of FIG. 39 in an cambered position, in which portions of the wheelchair are not shown for clarity.

Referring now to FIGS. 32 and 33, the receiver 514 is illustrated more closely. In one aspect, the receiver comprises a distal end 544, an opposed proximal end 546 and a central portion 548 extending therebetween. In use, the receiver can be a rigid element configured to couple the axle 5 of the rear wheel 3 to the bracket 512. In another aspect, at least one elongate bore 550 having a bore axis $L_B$ can be defined in the distal end of the receiver, the bore configured to rotatingly engage the axle. For example, the bore can extend through the distal end 544 and at least a portion of the central portion 548 of the receiver so that an end of the axle 5 can be positioned in the bore and can be securedly, rotatably attached to the receiver. That is, a first end 6 of the axle can be secured to the rear wheel and a second end 7 of the axle 5 can be positioned in the bore.

Optionally, in one aspect, the at least one elongate bore 550 can comprise a plurality of elongate bores. For example, a second bore can be defined in the receiver 514 that is spaced from the first bore a predetermined distance. In another aspect, the position of the second bore can be selected to change the center of gravity of the chair 1. For example, the second bore could be positioned behind the first bore relative to the front of the chair (as viewed when assembled), to change the center of gravity of the chair to be more stable climbing hills. In another example, the second bore could be positioned below the first bore relative to the front of the chair 1 (as viewed when assembled), to change the center of gravity of the chair.

The proximal end 546 and/or the central portion 548 of the receiver 514 can be sized and configured to be selectively, releasably coupled to an end of the bracket 512. In one aspect, at least one sliding pin aperture 552 having an aperture axis $L_A$ can extend through the proximal end of the receiver. In another aspect, the aperture axis $L_A$ can be substantially normal to the bore axis $L_B$. In still a further aspect, there can be at least one sliding pin aperture 552 for each slot 536 defined in an end of the bracket 512. Thus, if there are two slots in an end of the bracket, there can be at least two sliding pin apertures 552 defined in the receiver. In one aspect, the receiver 514 can have a width sized so that each sliding pin aperture can be positioned adjacent to a slot 536 in an end of the bracket. For example, if the first slot 540 is spaced two inches from the second slot 542, the receiver can have a width that is greater than two inches. In another aspect, the at least one sliding pin aperture 552 can have a diameter greater than the diameter of a sliding pin 570. In this aspect, a cushioning or dampening material such as, for example and without limitation, urethane, can be positioned in the sliding pin aperture with the sliding pin.

A plurality of locking pin holes 580 can be defined in the receiver 514 and extending through at least a portion of the receiver. In a further aspect, each locking pin hole of the plurality of holes 580 can be sized and configured to receive a portion of the locking pin 516 therein. In one aspect, the plurality of locking pin holes can comprise a row of holes. Alternatively, the plurality of locking pin holes 580 do not necessarily need to be arranged in a row. In another aspect, each locking pin hole can have a longitudinal axis $L_1$ substantially normal to the longitudinal axis $L_B$ of the bore 550. In another aspect, the position and arrangement of the plurality of locking pin holes 580 can be selected so that in use, described more fully below, a top portion 8 of the wheel 3 can remain in a vertical plane $P_1$ of travel regardless of the camber of the wheel and/or so the frame 4 of the chair stays in the same relative position to the ground regardless of what camber option is chosen.

The at least one locking pin 516 can be a conventional locking pin. In one aspect, the locking pin can have a pin length sized and configured to extend through the locking pin aperture 538 of the bracket 512 and the at least one locking pin hole 580 of the receiver 514. For example, the locking pin length can be sized to extend through the locking pin aperture 538 in the first plate 530 of the bracket, through a locking pin hole 580 defined in the receiver, and through the locking pin aperture 538 of the second plate 532 of the bracket. In another aspect, the at least one locking pin can be a removable locking pin. In a further aspect, the locking pin can be a non-removable locking pin that can be unlocked by rotating the locking pin. In use, the locking pin can be sized and configured to releasably secure the receiver 514 to the bracket 512.

To assemble the wheelchair 1 of the present application, the bracket 512 can be securedly attached to the wheelchair frame 4 with screws, bolts, pins and the like. In one aspect, the wheelchair can be a new wheelchair 1 assembled with the bracket attached. In another aspect, however, a conventional wheelchair can be retrofit with the bracket 512 to convert the conventional wheelchair 1 to a wheelchair with an adjustable camber. For example, a conventional wheelchair 1 has a frame element that can be detached and replaced with the bracket 12. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

The proximal end 546 of the receiver can be positioned so that the at least one sliding pin aperture 552 of the receiver 514 is adjacent to and/or co-axially aligned with a slot 536 defined in an end of the bracket 512. In one aspect, if there are a plurality of slots, the proximal end of the receiver can be positioned so that a sliding pin aperture is adjacent each slot 536. For example, if there are two slots, the proximal end 546 can be positioned so that a sliding pin aperture is aligned both of the slots. With the at least one sliding pin aperture 552 and the at least one slot 536 co-axially aligned, a sliding pin 570 can be inserted through each sliding pin aperture and the aligned slot to securedly, slidingly couple the receiver 514 to the bracket 512.

The at least one locking pin 516 can be positioned in the locking pin aperture 538 of the bracket 512 and the at least one locking pin hole 580 of the receiver 514 to releasably secure the receiver to the bracket in a desired position. The axle 5 of the wheel 3 can be positioned in the bore 550 of the distal end 544 of the receiver 514 and securedly, rotatably coupled to the receiver.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could release or unlock each locking pin 516 on one end of the bracket 512. The proximal end 546 of the receiver can then be moved so that a different locking pin hole 580 of the receiver 514 is adjacent to and/or co-axially aligned with the locking pin aperture 538 of the bracket. The locking pin 516 can then be inserted into and/or locked to the different locking pin hole of the receiver, thereby changing the camber of the wheel 1.

In another aspect, the pattern of the locking pin holes 580 of the receiver and/or the slot angles of the slot 536 of the bracket can be predetermined to correspond to a wheel camber of 0 degrees to 15 degrees with 2.5 degree increments. Of course, it is contemplated that the wheel camber could be greater than 15 degrees or less than 0 degrees (a negative camber) if desired by changing the position of the locking pin holes 580 and/or the slots 536. It is also contemplated that the incremental change could be more or less than 2.5 degrees if desired so that a wider range of wheel camber is possible by changing the position of the locking pin holes 580 and/or the slots 536.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

During adjustment of the camber of the wheel 3, friction between the tire and the ground or other surface on which the tires rests can restrict or prevent wheel from moving to the desired position. Thus, in one aspect, a lifting device 590 can be used to raise the rear of the chair 1 enough to break the mechanical grip of the tires to the surface 608. The lifting device can be, for example and without limitation, an electric screw jack, a lever operated jack or a jack stand that the rider can operate.

In one aspect, the lifting device 590 can comprise a jack as illustrated in FIGS. 35-38. The lifting device can be coupled to the frame 4 of the wheelchair 1 and/or a portion of the bracket. In another aspect, the lifting device 590 can comprise an actuator 602 and a movable contact point 604, such as wheels 606. A first end 610 of the actuator can be coupled to the contact point, and a second end 612 of the actuator can be coupled to the frame 4 of the wheelchair and/or a portion of the bracket. In use, the user can actuate the actuator, which can cause the first end of the actuator 602 to move relative to the second end of the actuator. Movement of the first end 610 of the actuator 602 can cause the contact point to move about and between a first lifted position, in which the contact point engages the surface 608 (illustrated in FIGS. 37 and 38) and a second unlifted position in which the contact point 604 is spaced from the surface a predetermined distance (illustrated in FIGS. 35 and 36).

In one embodiment and as illustrated in FIGS. 39-50, the system 600 comprises a bracket assembly 612 coupled to the wheelchair 1, a plurality of receivers 614 coupled to the bracket and at least one locking pin 616 for each receiver. In use, an end of the receiver can be positioned in an internal cavity of the bracket and can slidingly engage a portion of the bracket 612. Another end of the receiver 614 can be configured to rotatably couple the axle 5 of the rear wheel 3 to the receiver. In one aspect, the receiver 614 can slide about and between a first position, in which the rear wheels are in a first wheel position relative to the surface upon which the wheelchair 1 is positioned, and a second position in which the wheels are in a second wheel position that is different than the first wheel position. For example, in the first wheel position, the rear wheels 3 can be substantially perpendicular to the ground in a vertical plane (i.e. uncambered or having zero degrees of camber), and in the second wheel position, the rear wheels can be at an acute angle relative to the ground (i.e., cambered or having a camber angle). The at least one locking pin can releasably secure the receiver 614 to the bracket 612 in the desired position.

In one aspect, the bracket assembly 612 can be formed from rigid materials such as for example, steel, stainless steel, titanium, aluminum, carbon fiber and the like. In another aspect, the bracket assembly can comprise at least one of: a first chair attachment assembly 618, a second chair attachment assembly 620, at least one elongate rod 622, a first wheel attachment assembly 624 and a second wheel attachment assembly 626. The first and second chair attachment assemblies are configured to couple to a portion of the frame 4 of the wheelchair. For example, the first chair attachment assembly 618 can be coupled to the frame on a first side of the wheelchair, and the second chair attachment assembly 620 can be coupled to the frame on a second side of the wheelchair 1 that is opposed to the first side.

The at least one elongate rod 622 can be coupled to and positioned between the first chair attachment assembly 618 and the second chair attachment assembly 620. In one aspect, a distal end 628 of the elongate rod can be clamped or otherwise secured to the first chair attachment assembly, and a proximal end 630 of the elongate rod 622 can be clamped or otherwise secured to the second chair attachment assembly. In another aspect, the first and second chair attachment assemblies can be adjustable so that the elongate rod 622 is positioned a predetermined distance from the frame 4 of the wheelchair 1.

In one aspect, the first wheel attachment assembly 624 can be slidingly, rotatably coupled to the distal end 628 of the elongate rod 622, and the second wheel attachment assembly 626 can be slidingly, rotatably coupled to the proximal end 630 of the elongate rod. That is, the first and second wheel attachment assemblies can be positioned on or adjacent to opposed ends of the rod 622 and then each of the first and second wheel attachment assemblies 624, 626 can be slid and/or rotated until the respective wheel assembly is at a desired position and orientation relative to each other and/or the surface on which the wheelchair 1 is positioned. In another aspect, the first and second wheel attachment assemblies 624, 626 can be rotated about and between a first attachment position, in which a first plate 631 of each attachment assembly is substantially perpendicular to the surface on which the wheelchair rests, and a second attachment position, in which the first plate of each attachment assembly is at an angle relative to the surface on which the wheelchair rests.

In the desired position and orientation, each of the first and second wheel attachment assemblies 624, 626 can be securedly fastened to the rod 622 to prevent undesired axial movement or rotation of the wheel attachment assemblies relative to the rod. For example, if the wheelchair is positioned on the ground, the first attachment assembly can be rotated until the first plate 631 of the first attachment assembly 624 is substantially perpendicular to the ground. With the first plate of the first attachment assembly substantially perpendicular to the ground, the first attachment assembly 624 can be clamped or otherwise secured to the rod 622 to prevent undesired rotation out of the substantially perpendicular position. In other examples, the first attachment assembly can be rotated until the first plate 631 of the first attachment assembly 624 is at an acute angle relative to the ground.

Figure 42:
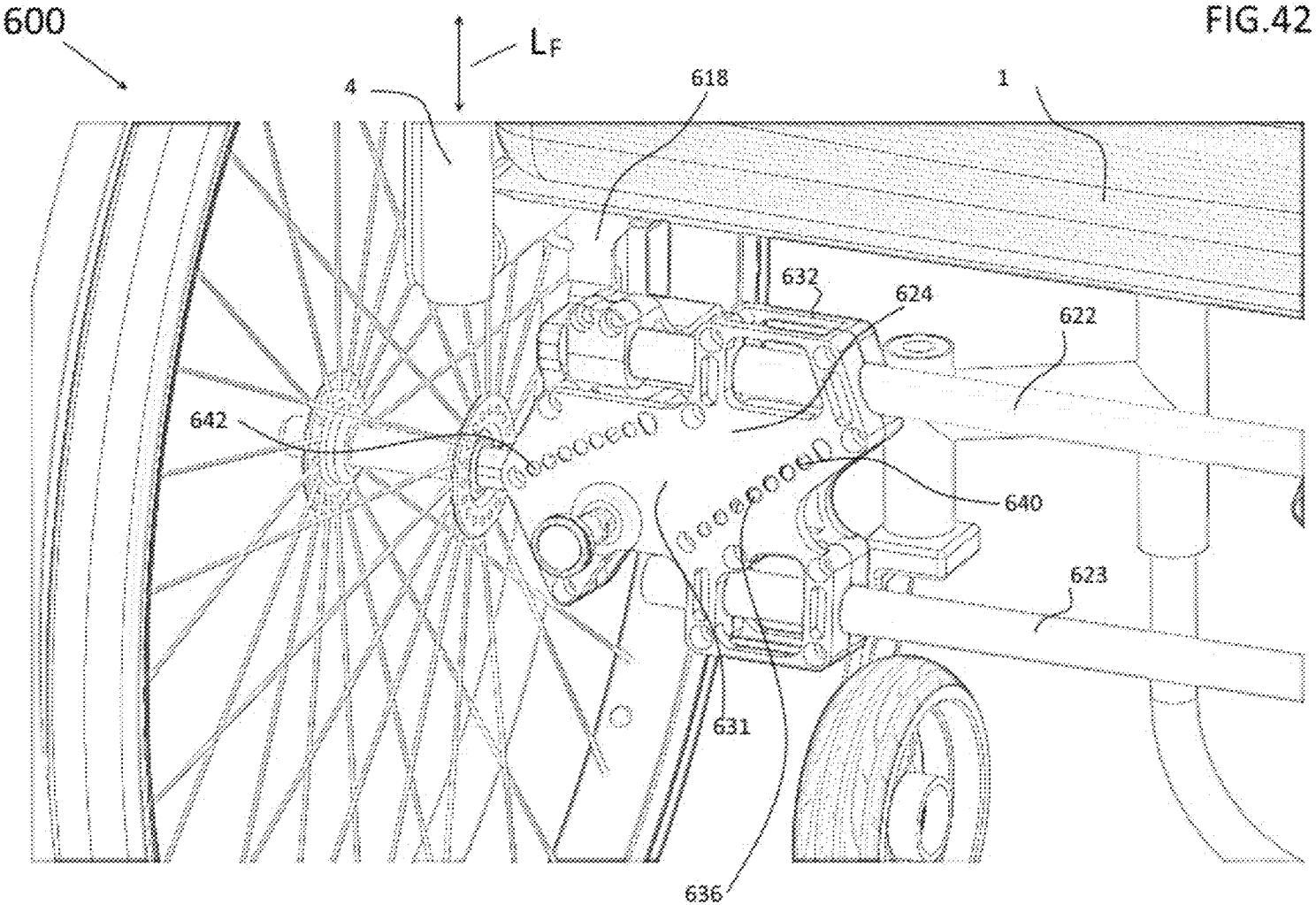
FIG. 42 is a perspective view of the wheelchair device and system of FIG. 39, in an uncambered position.
Figure 43:
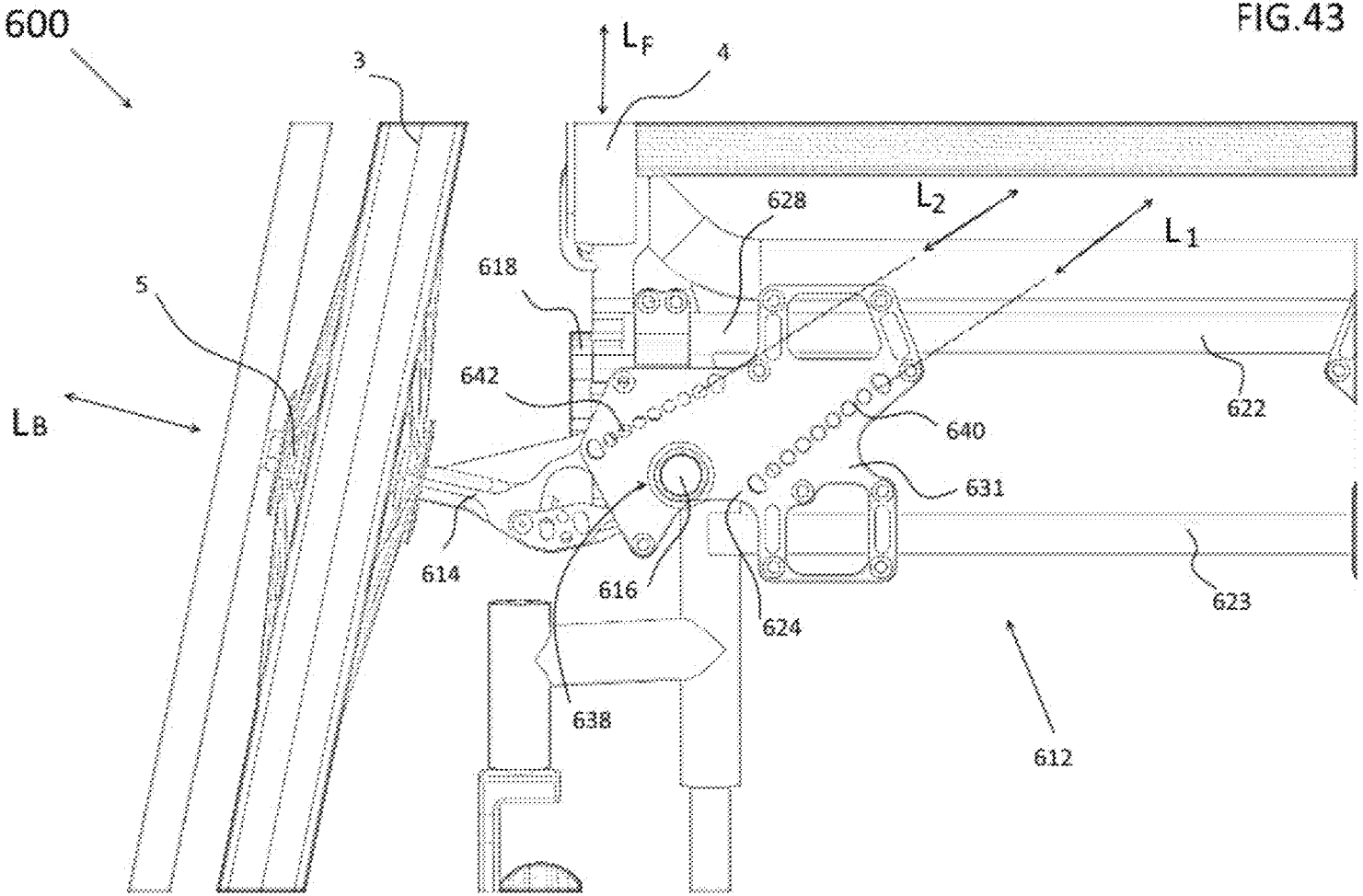
FIG. 43 is a rear elevational view of the wheelchair device and system of FIG. 39 in an cambered position.

In one aspect, the first and second wheel attachment assemblies 624, 626 each comprise the first plate 631 and a second plate 632 spaced from the first plate a predetermined distance that cooperate to form the assemblies. As seen in FIG. 42, for example, the first plate can be positioned on a first side of the elongate rod 622 and the second plate can be positioned on a second side of the elongate rod such that the plates are spaced the predetermined distance. In another aspect, the internal cavity can be defined between the first plate 631 and the second plate 632. In another aspect, the at least one elongate rod 622 can comprise a plurality of elongate rods. In this aspect, a first elongate rod of the plurality of elongate rods can couple the chair attachment assemblies 618, 620 to the wheel attachment assemblies 624, 626. A second elongate rod 623 of the plurality of elongate rods 622 can couple the first wheel attachment assembly 624 to the second wheel attachment assembly to strengthen the bracket 612.

At least one slot 636 can be defined in a portion of each of the first wheel attachment assembly 624 and the second wheel attachment assembly 626. In one aspect, the slot can be sized and configured to receive a portion of the receiver 614 therein. In another aspect, the slot 636 can be a substantially linear slot having a longitudinal axis $L_1$ at an acute angle relative to the longitudinal axis $L_F$ of the frame 4. For example, the acute angle between the longitudinal axis $L_1$ of the slot and the longitudinal axis $L_F$ of the frame can be less than 30 degrees, about 30 degrees, about 45 degrees, about 60 degrees or greater than 60 degrees. Optionally, at least a portion of the slot 636 can be arcuate in shape. In another aspect, the position and shape of the slot can be selected so that in use, described more fully below, a top portion 8 of the wheel 4 can remain in a vertical plane $P_1$ of travel regardless of the camber of the wheel and/or so the frame 4 of the chair stays in the same relative position to the ground regardless of what camber option is chosen.

In one aspect, a portion of the at least one slot 636 can be defined in the first plate 631 and a portion of the slot can be defined in the second plate 632. For example, the slot can be defined in the inner face of the first plate and the second plate so that when assembled as described below, the portion of the slot 636 of the first plate 631 is substantially aligned with the portion of the slot of the second plate 632. Note that the slot 636 need not extend completely through the first plate and the second plate. As illustrated in the figures, the slot 636 extends partially through the plates, and a plurality of holes 637 are provided for cleaning the slot and/or to reduce the weight of the bracket 612.

In another aspect, the at least one slot 636 defined in each of the first wheel attachment assembly 624 and the second wheel attachment assembly 626 can comprise a plurality of slots. For example, the at least one slot can comprise a first slot 640 and a second slot 642 defined in each assembly end. In this aspect, the first slot can have the longitudinal axis $L_1$ and the second slot can have a longitudinal axis $L_2$. In another aspect, the longitudinal axis $L_2$ of the second slot 642 can be at an acute angle relative to the longitudinal axis $L_1$ of the first slot 640. Alternatively, the first slot can be substantially parallel to the second slot. In yet another aspect, the at least one slot 636 defined in the first wheel attachment assembly can be a substantial mirror image of the at least one slot defined in the second wheel attachment assembly 626 relative to a vertical plane positioned through the back of the wheelchair 1. Thus, the longitudinal axis of the first slot 640 and/or the second slot 642 of the first wheel attachment assembly 624 can be at substantially the same acute angle relative to the longitudinal axis $L_F$ of the frame 4 as the respective first slot and/or the second slot 642 of the second wheel attachment assembly 626.

In a further aspect, at least one locking pin aperture 638 can be defined in each of the first wheel attachment assembly 624 and the second wheel attachment assembly 626. In this aspect, the locking pin aperture can be sized and configured to receive a portion of the locking pin 616 therein. In yet another aspect, the locking pin aperture 638 can be positioned so that the locking pin and the receiver 614 are coupled to the bracket 612 in a predetermined position.

Figure 44:
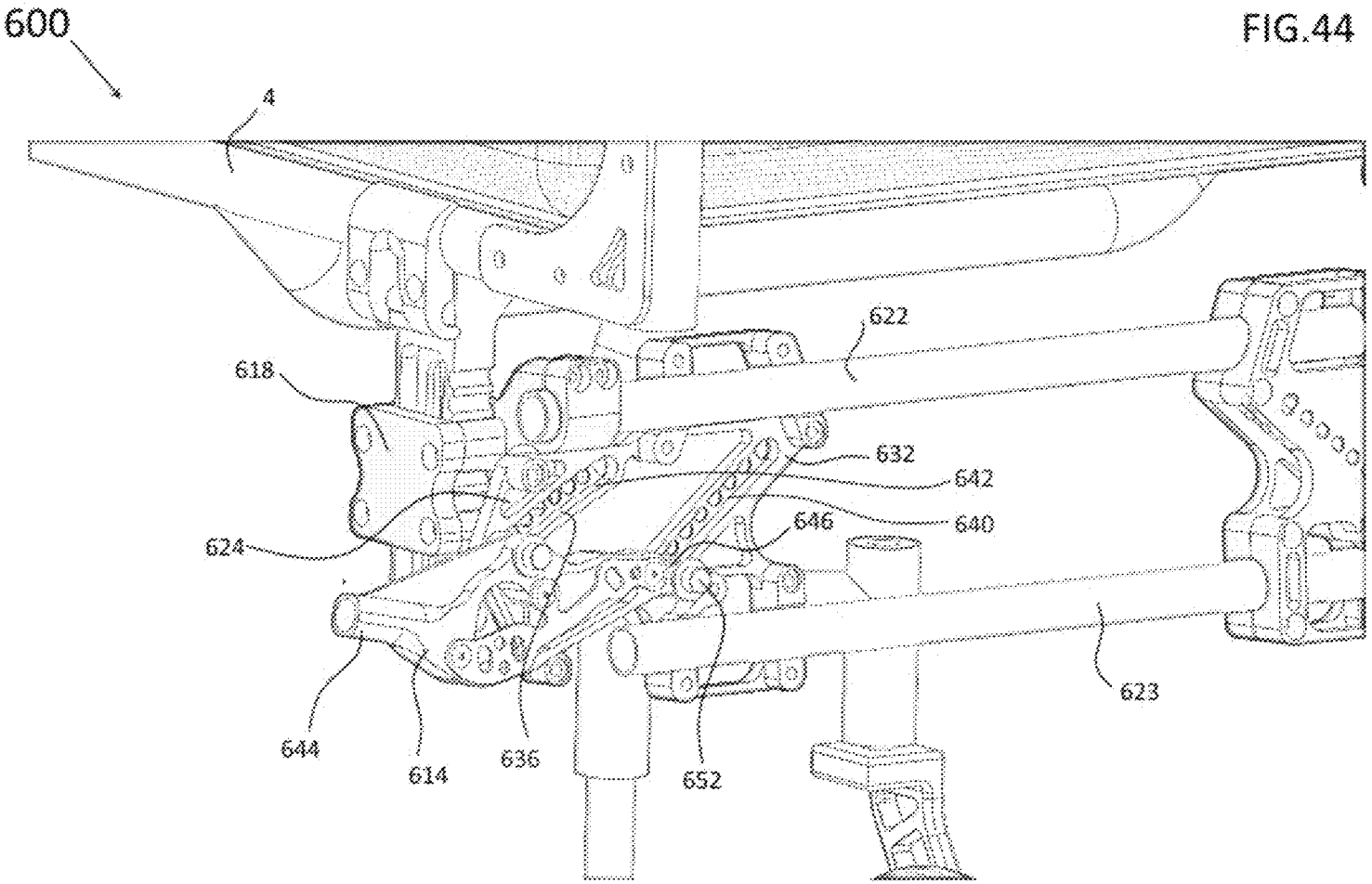
FIG. 44 is a cutaway rear perspective view of the wheelchair device and system of FIG. 39 in a cambered position, in which portions of the device are not shown for clarity.
Figure 45:
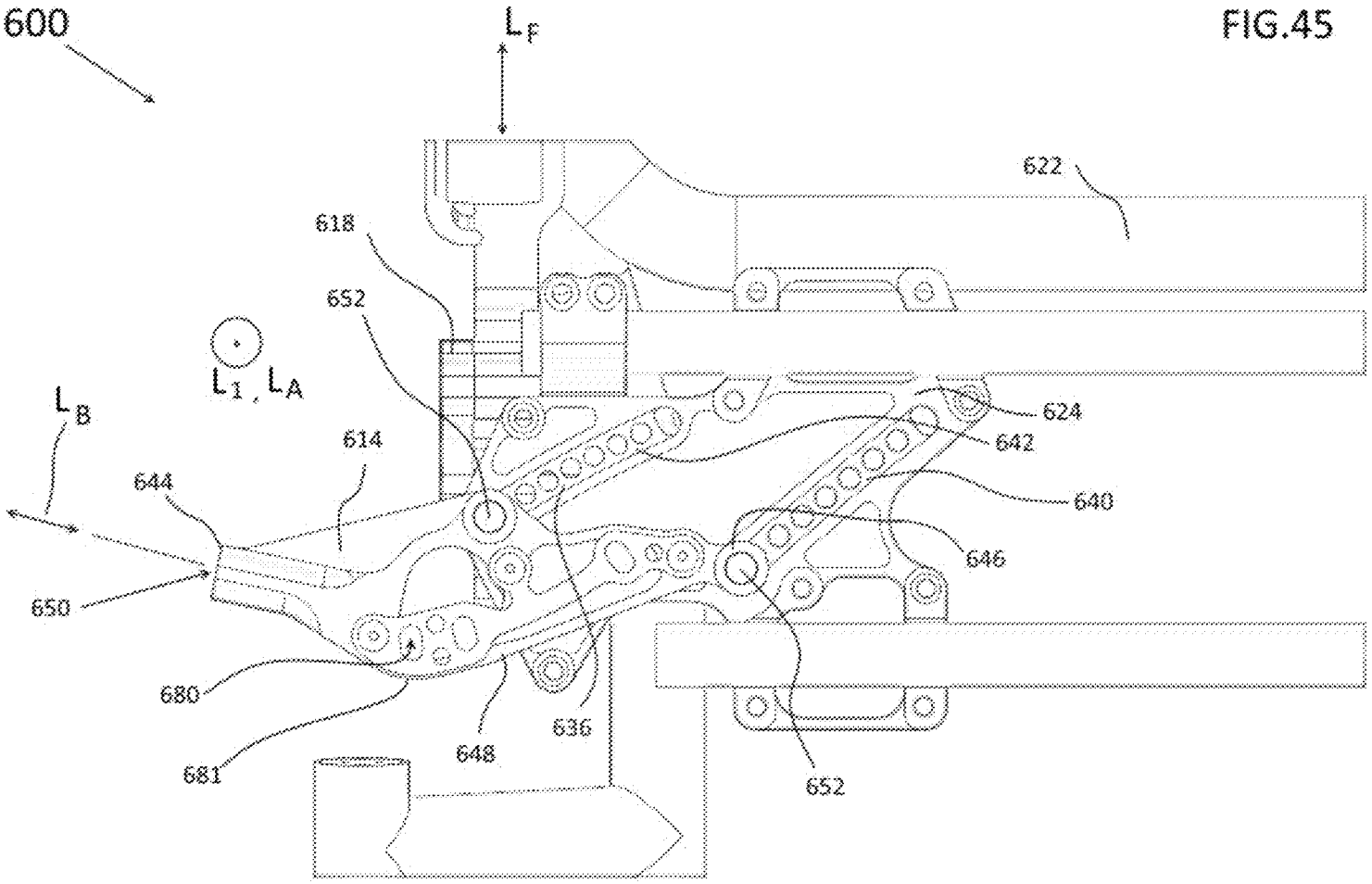
FIG. 45 is a rear elevational view of the wheelchair device and system of FIG. 39 in a cambered position, in which portions of the device are not shown for clarity.
Figure 46:
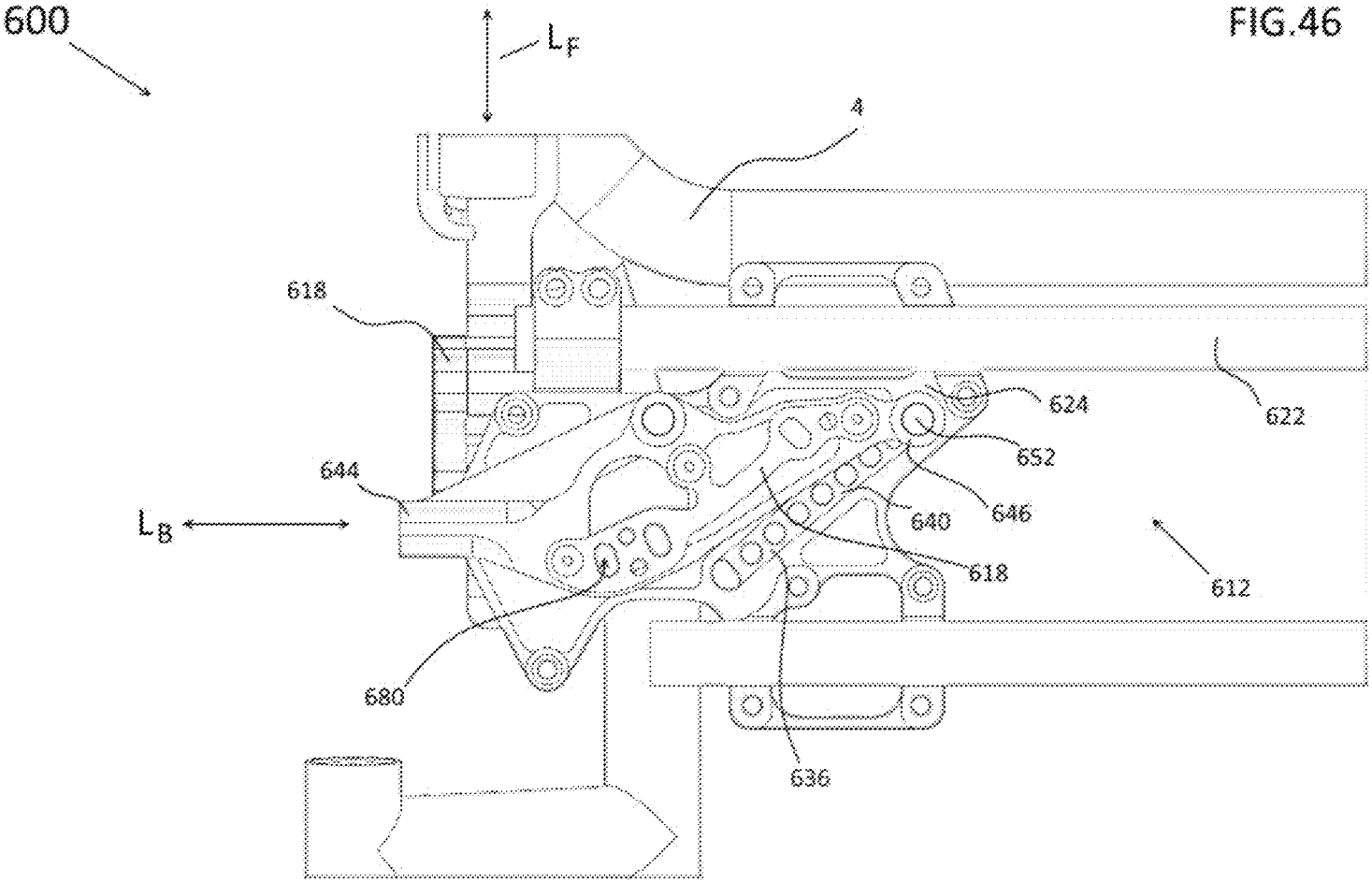
FIG. 46 is a rear elevational view of the wheelchair device and system of FIG. 39 in an uncambered position, in which portions of the device are not shown for clarity.
Figure 47:
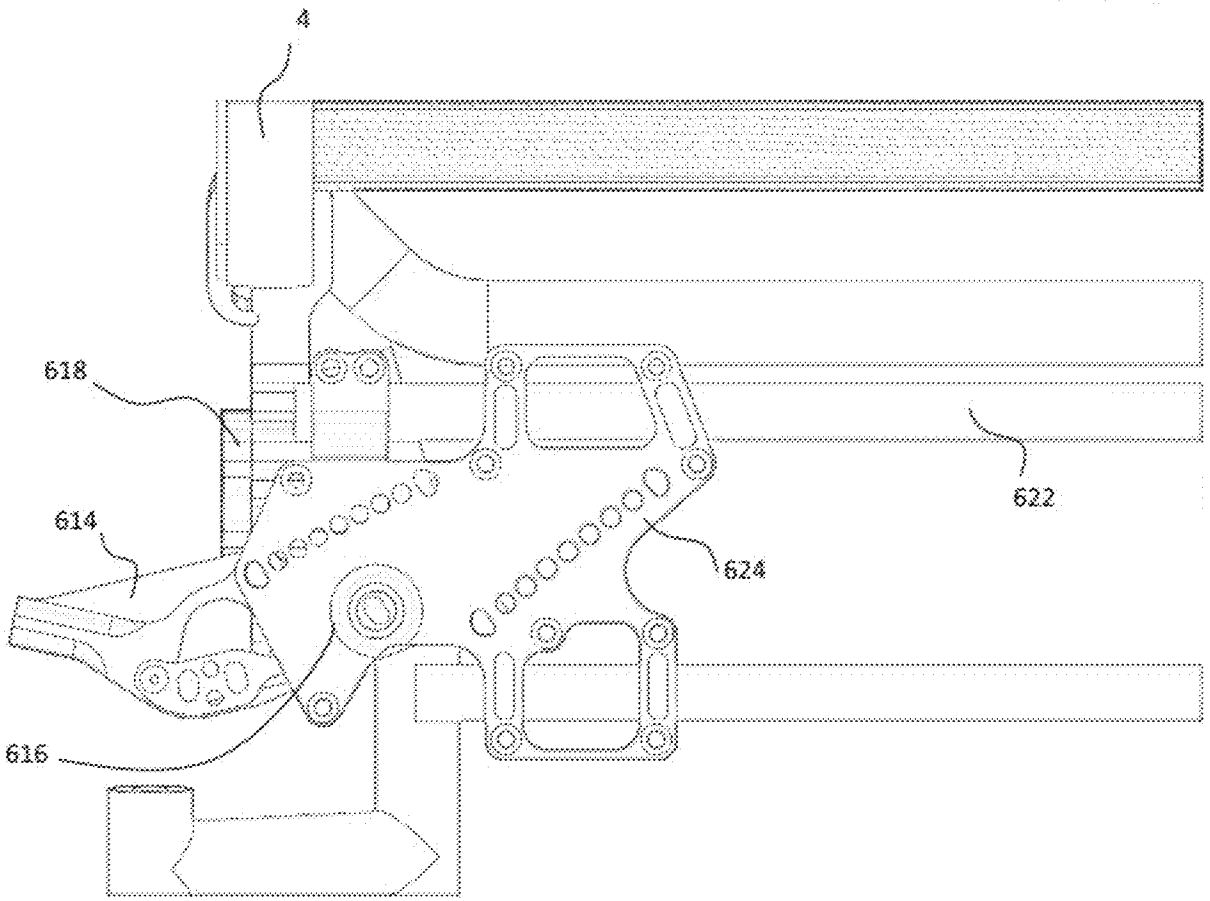
FIG. 47 is a rear elevational view of the wheelchair device and system of FIG. 39 in a cambered position.
Figure 48:
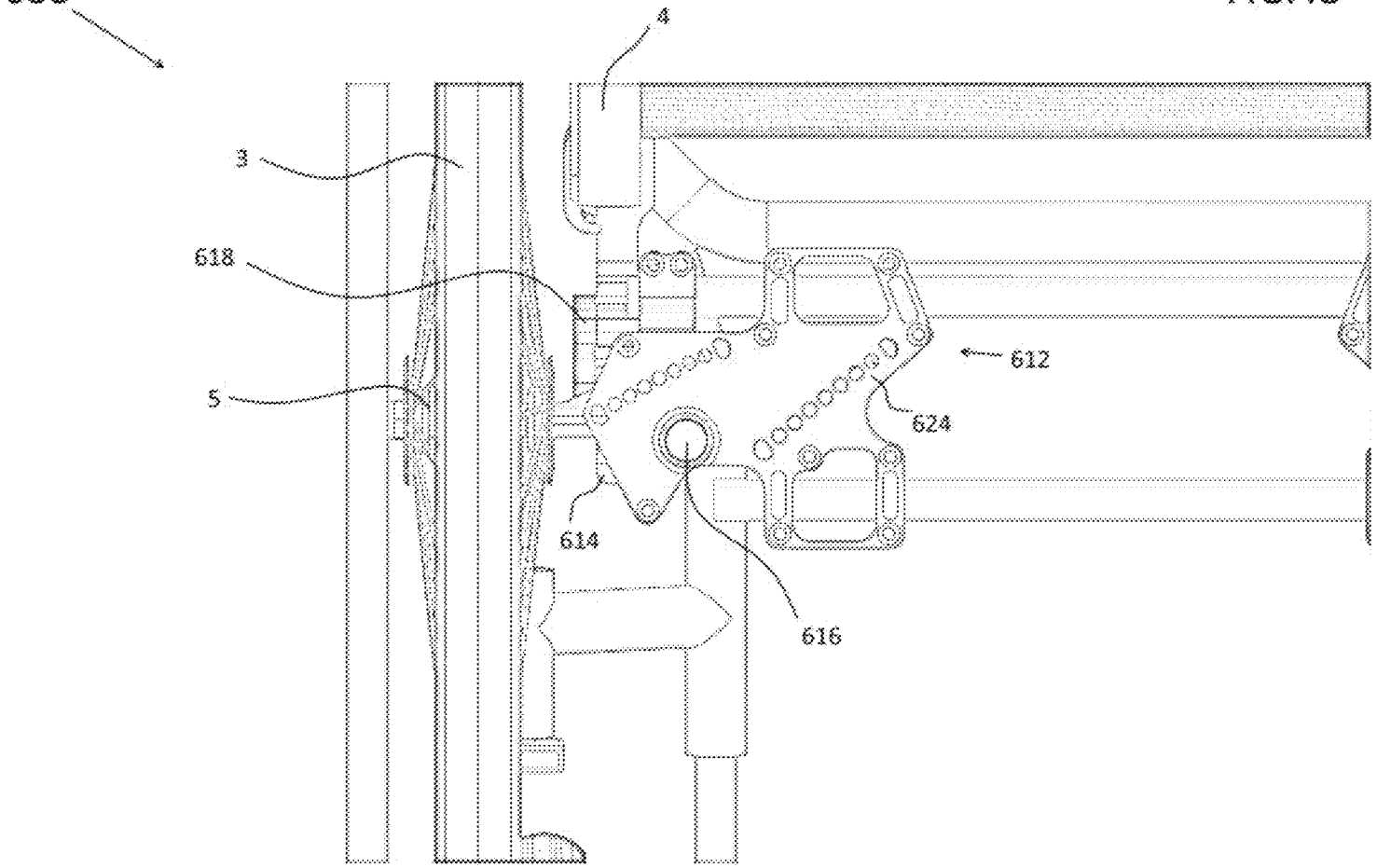
FIG. 48 is a rear elevational view of the wheelchair device and system of FIG. 39 in an uncambered position.
Figure 49:
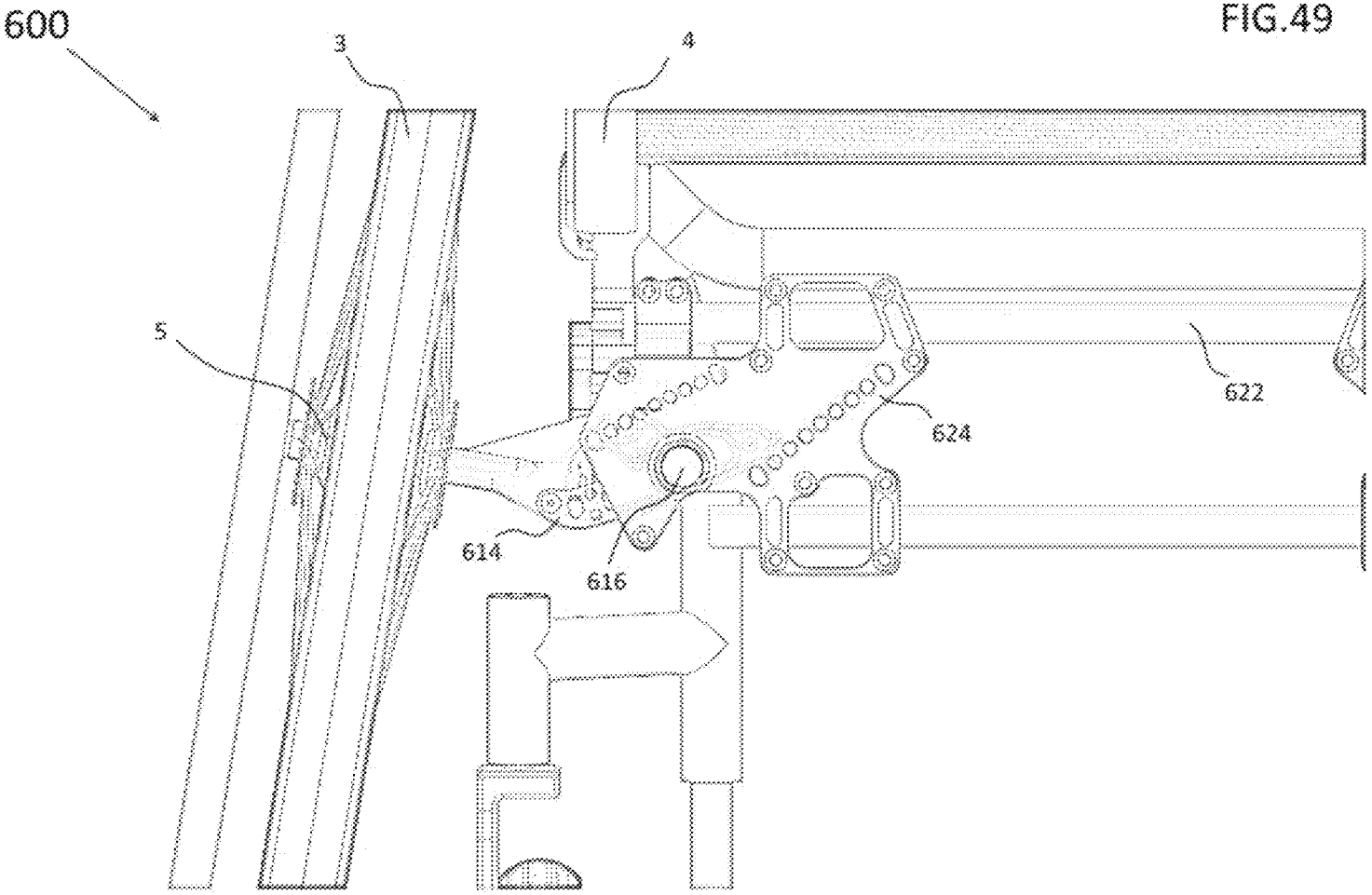
FIG. 49 is a rear elevational view of the wheelchair device and system of FIG. 39 in a cambered position, in which portions of the device are shown transparently for clarity.
Figure 50:
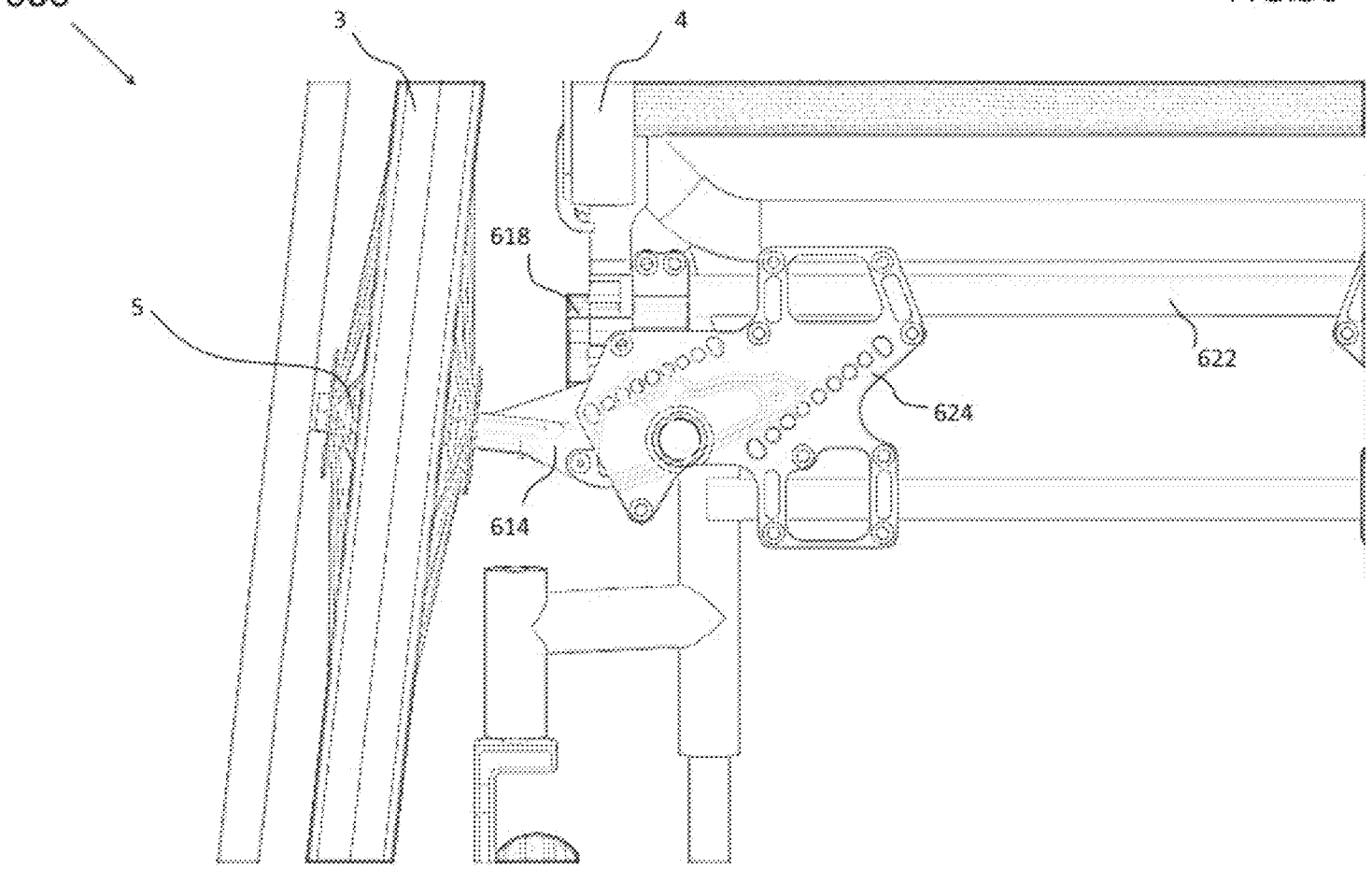
FIG. 50 is a rear elevational view of the wheelchair device and system of FIG. 39 in a cambered position, in which portions of the device are shown transparently for clarity.

Referring now to FIGS. 44-46, the receiver 614 is illustrated more closely. In one aspect, the receiver comprises a distal end 644, an opposed proximal end 646 and a central portion 648 extending therebetween. In use, the receiver can be a rigid element configured to couple the axle 5 of the rear wheel 3 to a wheel attachment assembly 624, 626 of the bracket 612. In another aspect, at least one elongate bore 650 having a bore axis $L_B$ can be defined in the distal end of the receiver, the bore configured to rotatingly engage the axle. For example, the bore can extend through the distal end 644 and at least a portion of the central portion 648 of the receiver so that an end of the axle 5 can be positioned in the bore and can be securedly, rotatably attached to the receiver. That is, a first end 6 of the axle can be secured to the rear wheel and a second end 7 of the axle 5 can be positioned in the bore.

Optionally, in one aspect, the at least one elongate bore 650 can comprise a plurality of elongate bores. For example, a second bore can be defined in the receiver 614 that is spaced from the first bore a predetermined distance. In another aspect, the position of the second bore can be selected to change the center of gravity of the chair 1. For example, the second bore could be positioned behind the first bore relative to the front of the chair (as viewed when assembled), to change the center of gravity of the chair to be more stable climbing hills. In another example, the second bore could be positioned below the first bore relative to the front of the chair 1 (as viewed when assembled), to change the center of gravity of the chair.

The proximal end 646 and/or the central portion 648 of the receiver 614 can be sized and configured to be selectively, releasably coupled to an end of the wheel attachment assemblies 624, 626. In one aspect, at least one pin 652 having a pin axis $L_A$ can extend through the proximal end of the receiver. In another aspect, the pin axis $L_A$ can be substantially normal to the bore axis $L_B$. In still a further aspect, there can be at least one pin 652 for each slot 636 defined in a wheel attachment assembly. Thus, if there are two slots in the first wheel attachment assembly 624, there can be at least two pin 652 positioned in the receiver. In one aspect, the receiver 614 can have a width sized so that each pin can be positioned adjacent to a slot 636 in a wheel attachment assembly. For example, if a portion of the first slot 640 is spaced two inches from the second slot 642, the receiver can have a first pin positioned two inches from a second pin. In another aspect, a cushioning or dampening material such as, for example and without limitation, urethane, can be positioned around the at least one pin 652 to act as a damper.

A plurality of locking pin holes 680 can be defined in the receiver 614 and extend through at least a portion of the receiver. In a further aspect, each locking pin hole of the plurality of holes 680 can be sized and configured to receive a portion of the locking pin 616 therein. In one aspect, the plurality of locking pin holes can comprise a row of holes. Alternatively, the plurality of locking pin holes 680 do not necessarily need to be arranged in a row. In another aspect, each locking pin hole can have a longitudinal axis $L_1$ substantially normal to the longitudinal axis $L_B$ of the bore 650. In another aspect, the position and arrangement of the plurality of locking pin holes 680 can be selected so that in use, described more fully below, a top portion 8 of the wheel 3 can remain in a vertical plane $P_1$ of travel regardless of the camber of the wheel and/or so the frame 4 of the chair stays in the same relative position to the ground regardless of what camber option is chosen. In various aspects, the plurality of locking pin holes can be formed integrally with the receiver, or alternatively, the locking pin holes 680 can be defined in a receiver plate 681 that can be coupled to the receiver 614.

The at least one locking pin 616 can be a conventional locking pin. In one aspect, the locking pin can have a pin length sized and configured to extend through the locking pin aperture 638 of the bracket 612 and the at least one locking pin hole 680 of the receiver 614. For example, the locking pin length can be sized to extend through the locking pin aperture 638 in the first plate 631, through a locking pin hole 680 defined in the receiver, and/or through the locking pin aperture 638 of the second plate 632 of the bracket. In another aspect, the at least one locking pin can be a removable locking pin. In a further aspect, the locking pin can be a non-removable locking pin that can be unlocked by rotating the locking pin. In use, the locking pin can be sized and configured to releasably secure the receiver 614 to the bracket 612.

To assemble the wheelchair 1 of the present application, the bracket 612 can be securedly attached to the wheelchair frame 4 with screws, bolts, pins and the like. In one aspect, the wheelchair can be a new wheelchair 1 assembled with the bracket attached. In another aspect, however, a conventional wheelchair can be retrofit with the bracket 612 to convert the conventional wheelchair 1 to a wheelchair with an adjustable camber. For example, a conventional wheelchair 1 has a frame element that can be detached and replaced with the bracket 612. In this aspect, the bracket can be provided in different lengths and widths to fit different sized chairs. Further, the bracket can be configured to couple to the wheelchair frame 4 having a tube diameter of less than about 1 inch, 1 inch, 1⅛ inches, 1¼ inches, 1½ inches, or greater than 1½ inches.

For example, the first chair attachment assembly 618 can be securedly attached to a portion of the frame 4 on a side of the wheelchair 1 and the second chair attachment assembly 620 can be securedly attached to a portion of the frame on an opposed side of the wheelchair. The at least one elongate rod 622 can be securedly attached to both the first chair attachment assembly and the second chair attachment assembly. The first wheel attachment assembly 624 and the second wheel attachment assembly 626 can be rotatably coupled to the elongate rod. In one aspect, the first wheel attachment assembly and/or the second wheel attachment assembly can slide axially along the elongate rod until the attachment assemblies are in a desired position relative to each other and to the wheelchair 1. Thus, for example, for a narrow wheelchair, the first wheel attachment assembly 624 and the second wheel attachment assembly 626 can be positioned closer to each other on the rod than for a wide wheelchair. In another aspect, the first wheel attachment assembly 624 and the second wheel attachment assembly 626 can be rotated relative to the rod to a desired orientation. For example, the wheel attachment assemblies can be rotated until the first plate 631 of the wheel attachment assemblies is substantially perpendicular to the ground.

The proximal end 646 of the receiver 614 can be positioned so that the at least one pin 652 of the receiver is adjacent to and/or co-axially aligned with a slot 636 defined in the first wheel attachment assembly 624 or the second wheel attachment assembly 626. In one aspect, if there are a plurality of slots, the proximal end of the receiver can be positioned so that a pin is adjacent each slot 636. For example, if there are two slots, the proximal end 646 can be positioned so that a pin is aligned with both of the slots. The pin 652 inserted through the receiver 614 and the slots can slidingly couple the receiver to the wheel attachment assemblies 624, 626.

The at least one locking pin 616 can be positioned in the locking pin aperture 638 of a wheel attachment assemblies 624, 626 and the at least one locking pin hole 680 of the receiver 614 to releasably securedly attach the receiver 614 to the bracket 612 in a desired position. The axle 5 of the wheel 3 can be positioned in the bore 650 of the distal end 644 of the receiver 614 and securedly, rotatably coupled to the receiver.

In use, the rider could select a desired wheel camber. To change the wheel camber, the rider could either dismount the wheelchair 1 to make the change, make the change before getting in the chair, or have a user assist in supporting the chair and the user could make the adjustment for the rider. In one aspect, to change the camber of a wheel, the rider or user could release or unlock each locking pin 616 on one end of the bracket 612. The proximal end 646 of the receiver 614 can then be moved so that a different locking pin hole 680 of the receiver is adjacent to and/or co-axially aligned with the locking pin aperture 638 of the bracket. The locking pin 616 can then be inserted into and/or locked to the different locking pin hole of the receiver, thereby changing the camber of the wheel 3.

In another aspect, the pattern of the locking pin holes 680 of the receiver and/or the slot angles of the slot 636 of the bracket can be predetermined to correspond to a wheel camber of 0 degrees to 15 degrees with 0.5 degree increments. Of course, it is contemplated that the wheel camber could be greater than 15 degrees or less than 0 degrees (a negative camber) if desired by changing the position of the locking pin holes 680 and/or the slots 636. It is also contemplated that the incremental change could be more or less than 0.5 degrees if desired so that a wider range of wheel camber is possible by changing the position of the locking pin holes 680 and/or the slots 536.

Regardless of the camber of the wheel 3, in one aspect, the top portion 8 of the wheel can remain in the vertical plane $P_1$ of travel. In another aspect, because a bottom portion 9 of the wheel does not raise or lower during the camber change, the frame 4 of the chair 1 can stay in the same relative position to the ground regardless of what camber option is chosen. Similarly, because the frame of the chair stays in the same relative position to the ground, the caster of the front wheels 2 can be unchanged regardless of what camber option is chosen.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A wheelchair comprising:

a bracket assembly coupled to and fixed relative to a frame of the wheelchair, the bracket assembly comprising:

a pair of chair attachment assemblies, wherein a first chair attachment assembly of the pair of chair attachment assemblies is coupled to the frame on a first side of the wheelchair, and wherein a second chair attachment assembly of the pair of chair attachment assemblies is coupled to the frame on a second side of the wheelchair that is opposed to the first side;

an elongate rod coupled to and positioned between the first chair attachment assembly and the second chair attachment assembly; and a pair of wheel attachment assemblies, wherein a first wheel attachment of the pair of wheel attachment assemblies is coupled to a distal end of the elongate rod, and a second wheel attachment assembly of the pair of wheel attachment assemblies is coupled to a proximal end of the elongate rod, and wherein each of the first and second wheel attachment assemblies defines an internal cavity;

the first and second wheel attachment assemblies each comprise a first plate positioned on a first side of the elongate rod and a second plate positioned on a second side of the elongate rod such that the plates are spaced a predetermined distance and an inner surface of the first plate faces an inner surface of the second plate;

a pair of receivers each having a proximal end and an opposed distal end, wherein a bore is defined in the distal end of each receiver, the bore configured to rotatingly engage an axle of a rear wheel of the wheelchair, wherein the proximal end of each receiver of the pair of receivers is positionable in the internal cavity of the pair of wheel attachment assemblies, wherein each receiver is slidable in the internal cavity about and between a first position in which the rear wheels are each in a first wheel position that is substantially perpendicular to a surface upon which the wheelchair is positioned, and a second position in which the rear wheels are in a second wheel position that is different than the first wheel position; and a plurality of locking pins, each locking pin configured to secure a receiver to the bracket assembly in a desired position.

2. The wheelchair of claim 1, wherein the first wheel attachment assembly is slidingly, rotatably coupled to the distal end of the elongate rod, and the second wheel attachment assembly is slidingly, rotatably coupled to the proximal end of the elongate rod.

3. The wheelchair of claim 1, further comprising at least one slot defined in the inner surface of the first plate and the inner surface of the second plate, wherein the at least one slot is configured to slidingly receive a portion of the receiver therein.

4. The wheelchair of claim 3, wherein the at least one slot is arcuate in shape.

5. The wheelchair of claim 1, wherein the first plate of each wheel attachment assembly is rotatable about a first attachment position, in which the first plate of each attachment assembly is substantially perpendicular to the surface on which the wheelchair rests, and a second attachment position, in which the first plate of each attachment assembly is at an angle relative to the surface on which the wheelchair rests.

6. The wheelchair of claim 1, wherein the first and second chair attachment assemblies are adjustable so that the elongate rod is positioned a predetermined distance from the frame.

7. The wheelchair of claim 1, wherein in the first wheel position, a top portion of a first rear wheel is in a first vertical plane, and in the second wheel position, the top portion of the first rear wheel is in the first vertical plane.

8. The wheelchair of claim 1, wherein in the first wheel position, the frame of the wheelchair is a first distance from the ground upon which the wheelchair sits, and in the second wheel position, the frame of the wheelchair is the first distance from the ground.

9. A system for converting a conventional wheelchair having a frame and two rear wheels into an adjustable camber wheelchair, the system comprising:

a bracket assembly coupled to and fixed relative to a frame of the wheelchair, the bracket assembly comprising:

a pair of chair attachment assemblies, wherein a first chair attachment assembly of the pair of chair attachment assemblies is coupled to the frame on a first side of the wheelchair, and wherein a second chair attachment assembly of the pair of chair attachment assemblies is coupled to the frame on a second side of the wheelchair that is opposed to the first side;

an elongate rod coupled to and positioned between the first chair attachment assembly and the second chair attachment assembly; and a pair of wheel attachment assemblies, wherein a first wheel attachment of the pair of wheel attachment assemblies is coupled to a distal end of the elongate rod, and a second wheel attachment assembly of the pair of wheel attachment assemblies is coupled to a proximal end of the elongate rod, and wherein each of the first and second wheel attachment assemblies defines an internal cavity;

the first and second wheel attachment assemblies each comprise a first plate positioned on a first side of the elongate rod and a second plate positioned on a second side of the elongate rod such that the plates are spaced a predetermined distance and an inner surface of the first plate faces an inner surface of the second plate;

a pair of receivers each having a proximal end and an opposed distal end, wherein a bore is defined in the distal end of each receiver, the bore configured to rotatingly engage an axle of a rear wheel of the wheelchair, wherein the proximal end of each receiver of the pair of receivers is positionable in the internal cavity of the pair of wheel attachment assemblies, wherein each receiver is slidable about and between a first position in which the rear wheels are each in a first wheel position that is substantially perpendicular to a surface upon which the wheelchair is positioned, and a second position in which the rear wheels are in a second wheel position that is different than the first wheel position; and a plurality of locking pins, each locking pin configured to secure a receiver to the bracket assembly in a desired position.

10. The system of claim 9, wherein the first wheel attachment assembly is slidingly, rotatably coupled to the distal end of the elongate rod, and the second wheel attachment assembly is slidingly, rotatably coupled to the proximal end of the elongate rod.

11. The system of claim 9, further comprising at least one slot defined in the inner surface of the first plate and the inner surface of the second plate, wherein the at least one slot is configured to slidingly receive a portion of the receiver therein.

12. The system of claim 11, wherein the at least one slot is arcuate in shape.

13. The system of claim 9, wherein the first plate of each wheel attachment assembly is rotatable about a first attachment position, in which the first plate of each attachment assembly is substantially perpendicular to the surface on which the wheelchair rests, and a second attachment position, in which the first plate of each attachment assembly is at an angle relative to the surface on which the wheelchair rests.

14. The system of claim 9, wherein the first and second chair attachment assemblies are adjustable so that the elongate rod is positioned a predetermined distance from the frame.

15. The system of claim 9, wherein in the first wheel position, a top portion of a first rear wheel is in a first vertical plane, and in the second wheel position, the top portion of the first rear wheel is in the first vertical plane.

16. The system of claim 9, wherein in the first wheel position, the frame of the wheelchair is a first distance from the ground upon which the wheelchair sits, and in the second wheel position, the frame of the wheelchair is the first distance from the ground.

* * * * *